US011573010B2

(12) United States Patent
Heo et al.

(10) Patent No.: US 11,573,010 B2
(45) **Date of Patent: *Feb. 7, 2023**

(54) SELF-CLEANING KITCHEN HOOD

(71) Applicant: LG ELECTRONICS INC., Seoul (KR)

(72) Inventors: Heejeong Heo, Seoul (KR); Younju Oh, Seoul (KR); Hyun byung Cha, Seoul (KR); Chin Soo Hyon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 328 days.

This patent is subject to a terminal disclaimer.

(21) Appl. No.: 16/937,879

(22) Filed: Jul. 24, 2020

(65) Prior Publication Data

US 2021/0123603 A1 Apr. 29, 2021

Related U.S. Application Data

(60) Provisional application No. 62/927,093, filed on Oct. 28, 2019.

(30) Foreign Application Priority Data

Jun. 17, 2020 (KR) ..... 10-2020-0073659
Jun. 17, 2020 (KR) ..... 10-2020-0073660
(Continued)

(51) Int. Cl.
*F24C 15/20* (2006.01)
*B08B 9/027* (2006.01)
(Continued)

(52) U.S. Cl.
CPC ..... *F24C 15/2085* (2013.01); *B08B 1/04* (2013.01); *B08B 3/10* (2013.01); *B08B 9/027* (2013.01);
(Continued)

(58) Field of Classification Search
CPC ..... F24C 15/2057; F24C 15/2085; F24C 15/2078; B08B 3/02; B08B 2209/055; B08B 9/0558
See application file for complete search history.

(56) References Cited

U.S. PATENT DOCUMENTS 369,161 A * 8/1887 Carlson ..... F24C 15/2085 126/299 D
399,430 A * 3/1889 Neef ..... F24C 15/2085 266/158
(Continued)

FOREIGN PATENT DOCUMENTS

CN 204240443 4/2015
CN 106949519 7/2017
(Continued)

OTHER PUBLICATIONS

U.S. Office Action dated Feb. 24, 2022 issued in U.S. Appl. No. 16/937,936.
(Continued)

*Primary Examiner* — Jorge A Pereiro
(74) *Attorney, Agent, or Firm* — Ked & Associates, LLP

(57) ABSTRACT

A kitchen hood has a first housing and a second housing that slides into and out of the first housing to adjust a length of the kitchen hood. The first housing has a fan to suction air, an outlet, and an air quality sensor assembly to continuously detect air quality in a kitchen. The second housing has an inlet and suction grill through which air is suctioned, a steam cleaning assembly to automatically steam clean an interior of the kitchen hood, and a height sensing assembly to sense a height of cookware seated on a cooktop surface below the second housing. The kitchen hood may be lengthened or shortened based on the sensed height of the cookware, and a speed of the fan and the height of the kitchen hood may be
(Continued)

automatically adjusted based on detections by the air quality sensor assembly.

20 Claims, 52 Drawing Sheets

(30) Foreign Application Priority Data

Jun. 17, 2020 (KR) ..... 10-2020-0073661
Jun. 17, 2020 (KR) ..... 10-2020-0073662

(51) Int. Cl.
*B08B 1/04* (2006.01)
*B08B 3/10* (2006.01)

(52) U.S. Cl.
CPC ..... *F24C 15/2021* (2013.01); *F24C 15/2042* (2013.01); *F24C 15/2057* (2013.01); *F24C 15/2064* (2013.01); *F24C 15/2092* (2013.01); *B08B 2203/007* (2013.01); *B08B 2209/027* (2013.01); *F24C 15/2071* (2013.01)

(56) References Cited

U.S. PATENT DOCUMENTS 467,096 A 1/1892 Harper
1,085,207 A 1/1914 Downey
3,530,784 A 9/1970 Courchesne
3,907,525 A * 9/1975 King ..... B01D 50/00 55/DIG. 36
4,556,046 A 12/1985 Riffel et al.
4,581,051 A 4/1986 Regehr
4,584,929 A 4/1986 Järmyr et al.
4,637,302 A 1/1987 Enberg
4,682,580 A 7/1987 Fukumoto
4,824,061 A 4/1989 Sumikama
4,929,262 A 5/1990 Balon, Jr. et al.
4,944,285 A 7/1990 Glassman
4,967,733 A 11/1990 Rousseau
5,235,963 A * 8/1993 Strause ..... B08B 9/0433 134/167 C
5,310,018 A 5/1994 Lahaie
5,312,296 A 5/1994 Aalto et al.
5,342,422 A 8/1994 Wimbock
5,570,644 A * 11/1996 Cheng ..... F23J 15/04 110/215
5,580,155 A 12/1996 Hildebrand
5,662,097 A * 9/1997 Panos ..... F24C 15/2057 55/DIG. 36
6,036,736 A 3/2000 Wallace et al.
7,832,391 B2 11/2010 Kellogg et al.
8,038,515 B2 10/2011 Livchak et al.
8,616,388 B2 12/2013 Butler
9,574,779 B2 2/2017 Ritzer et al.
10,060,142 B2 8/2018 Haessler
10,265,741 B1 4/2019 Kelyman
11,371,718 B2 6/2022 Ren et al.
2006/0005828 A1 1/2006 Musico
2006/0213501 A1 9/2006 Musico
2007/0079823 A1* 4/2007 Shin ..... F24C 15/2085 126/299 D
2007/0204853 A1* 9/2007 Cheng ..... F24C 15/2057 126/299 D
2007/0204855 A1* 9/2007 Cheng ..... F24C 15/2057 126/299 D
2008/0092576 A1 4/2008 Hoffman et al.
2009/0305621 A1* 12/2009 Eckardt ..... F24C 15/2085 248/336
2010/0043772 A1 2/2010 Grobleben
2010/0081370 A1 4/2010 Weng et al.
2010/0126123 A1 5/2010 Martic
2013/0074823 A1* 3/2013 Kellogg ..... F24C 15/2057 134/34
2014/0230662 A1 8/2014 Siegel
2016/0096208 A1 4/2016 Jang et al.
2016/0123603 A1 5/2016 Chen et al.
2016/0265790 A1 9/2016 Dahan
2017/0051717 A1* 2/2017 Kim ..... H02K 7/1823
2017/0292716 A1 10/2017 Biocco
2017/0321905 A1 11/2017 Buriola
2019/0301748 A1 10/2019 Milani
2020/0191410 A1* 6/2020 Scalf ..... F24C 15/2085
2020/0278119 A1 9/2020 Kenny
2020/0333019 A1 10/2020 Scalf

FOREIGN PATENT DOCUMENTS

CN 108278645 7/2018
CN 108278645 A * 7/2018 ..... F24C 15/2021
CN 108592118 A * 9/2018 ..... B08B 3/02
CN 208296256 12/2018
CN 208886865 5/2019
DE 9313542 1/1994
DE 29919452 1/2000
DE 10-2012-016630 2/2014
DE 102015106702 A1 * 11/2016
EP 1 630 478 3/2006
EP 2469188 6/2012
EP 3421891 1/2019
JP 06137627 A * 5/1994 ..... F24C 15/2085
JP 2003240296 A * 8/2003
JP 2018-048755 3/2018
KR 2003-065599 8/2003
KR 10-0612464 8/2006
KR 100859446 B1 * 9/2008 ..... F24C 15/2057
KR 10-2009-0081262 7/2009
KR 10-1830811 2/2018
SE 516 971 3/2002
TW 427534 4/2012
WO WO 2014/063348 5/2014
WO WO 2015/027581 3/2015
WO WO 2017/209534 12/2017
WO WO-2019190075 A1 * 10/2019 ..... F24C 15/20

OTHER PUBLICATIONS

U.S. Office Action dated Mar. 25, 2022 issued in U.S. Appl. No. 16/937,847.
United States Office Action dated Aug. 25, 2022 issued in co-pending related U.S. Appl. No. 16/937,917.
U.S. Appl. No. 16/937,847, filed Jul. 24, 2020.
U.S. Appl. No. 16/937,917, filed Jul. 24, 2020.
U.S. Appl. No. 16/937,936, filed Jul. 24, 2020.

* cited by examiner

SELF-CLEANING KITCHEN HOOD

CROSS-REFERENCE TO RELATED APPLICATION(S)

This application claims priority under 35 U.S.C. § 119 to U.S. Provisional Application No. 62/927,093 filed on Oct. 28, 2019, and to Korean Patent Application Nos. 10-2020-0073659, 10-2020-0073660, 10-2020-0073661, and 10-2020-0073662, all filed on Jun. 17, 2020, whose entire disclosures are hereby incorporated by reference.

BACKGROUND

Field

The present disclosure relates to a kitchen hood.

2. Background

Cooking often results in emission of harmful smokes, gases, oils, or contaminants into indoor air. Many kitchens have a kitchen hood installed above a stovetop to exhaust residual contaminants; however, when not maintained properly, the efficiency of the kitchen hood decreases, which increases the amount of harmful pollutants that remain inside the kitchen.

Recent research has shown that most kitchen hood owners do not regularly maintain or clean their kitchen hood. However, oil that accumulates under the kitchen hood or remains in the air when the kitchen hood is not properly maintained is a breeding ground for bacteria such as *Staphylococcus aureus* ("staph"), *Escherichia coli* ("*E. coil*"), and *Streptococcus pneumoniae* (which may cause meningitis, pneumonia, sinusitis, and other infections). In addition, when the kitchen hood isn't working properly, harmful substances produced during cooking such as fine dust, oil mist, carbon monoxide, nitrogen dioxide, formaldehyde, volatile organic compounds, black carbon, and polycyclic aromatics hydrocarbon may be dispersed throughout the kitchen. These bacteria and substances may pose health risks and further reduce the kitchen hood's efficiency.

In kitchens, harmful gases containing particles of 15-40 nm generated during cooking condense with oil to produce fine dust of 1-10 μm. For example, the following Table 1 illustrates hazardous substances, e.g., gas and/or volatile organic compounds, generated during cooking.

TABLE 1

| Substance | Cause | Danger |
|---|---|---|
| Fine Dust | Generated by condensation of moisture and oil on the initial particles formed on the surface of food | Enters the lungs through the respiratory system and decreases lung function and weakens immunity; Group 1 carcinogen |
| Nitrogen Dioxide | Caused by incomplete combustion of food ingredients | Reduction of hemoglobin's oxygen-carrying capacity; Respiratory diseases such as bronchitis in high concentrations |
| Formal-dehyde | During the combustion of organic matter, formaldehyde is produced by incomplete combustion | Skin irritation such as eyes, nose, and throat; Headache, vomiting and shortness of breath during prolonged exposure; Carcinogen |
| Volatile Organic Com-pounds | Occurs when the oil is heated | Damage to respiratory tract, eye irritation, headache, skin irritation; Chronic blood disorder, anemia |

TABLE 1-continued

| Substance | Cause | Danger |
|---|---|---|
| Polycyclic Aromatics Hydro-carbon | Incomplete combustion of oil, caused by the carbohydrate fat protein carbonization | Respiratory diseases and DNA modifications; Class 1 carcinogen. |
| Black Carbon | Caused by incomplete combustion of food ingredients | Respiratory diseases |

Initial particles (harmful substances such as volatile organic compounds and nitrogen oxides) of a size about 15-40 nm are generated during cooking of food, and when combined with moisture, oil, etc., the size of the particles increases to produce fine dust. The harmful gases generated during cooking are coated with oil vapor or mist. Vapors containing noxious gases, once deposited indoors, do not fall easily and remain indoors for an extended period of time. WO 2017209534 A1 discloses an automatically moving kitchen hood having an intake port resembling a spout or faucet installed behind a stovetop. Upon detection of a heat source, the intake port is moved over the heat source. The intake port moves in a left-right direction, and may only cover one piece of cookware. Since the kitchen hood is installed at a bottom behind the stove top instead of at a wall or a ceiling, installation may be hard, and harmful gases may not be released to an outside.

KR 100612464 B1 discloses a kitchen hood having a liftable exhaust drive motor. The hood and suction grill are provided directly over the cooktop, increasing a likelihood of oil residue dropping back down into food and decreasing efficiency in suctioning air from a side.

KR 101830811 B1 discloses a ceiling kitchen hood that is periodically sprayed with water and detergent via nozzles. Dirty water and detergent is discharged in a drain pipe, and an installation of the kitchen hood may be limited in view of the drain pipe.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
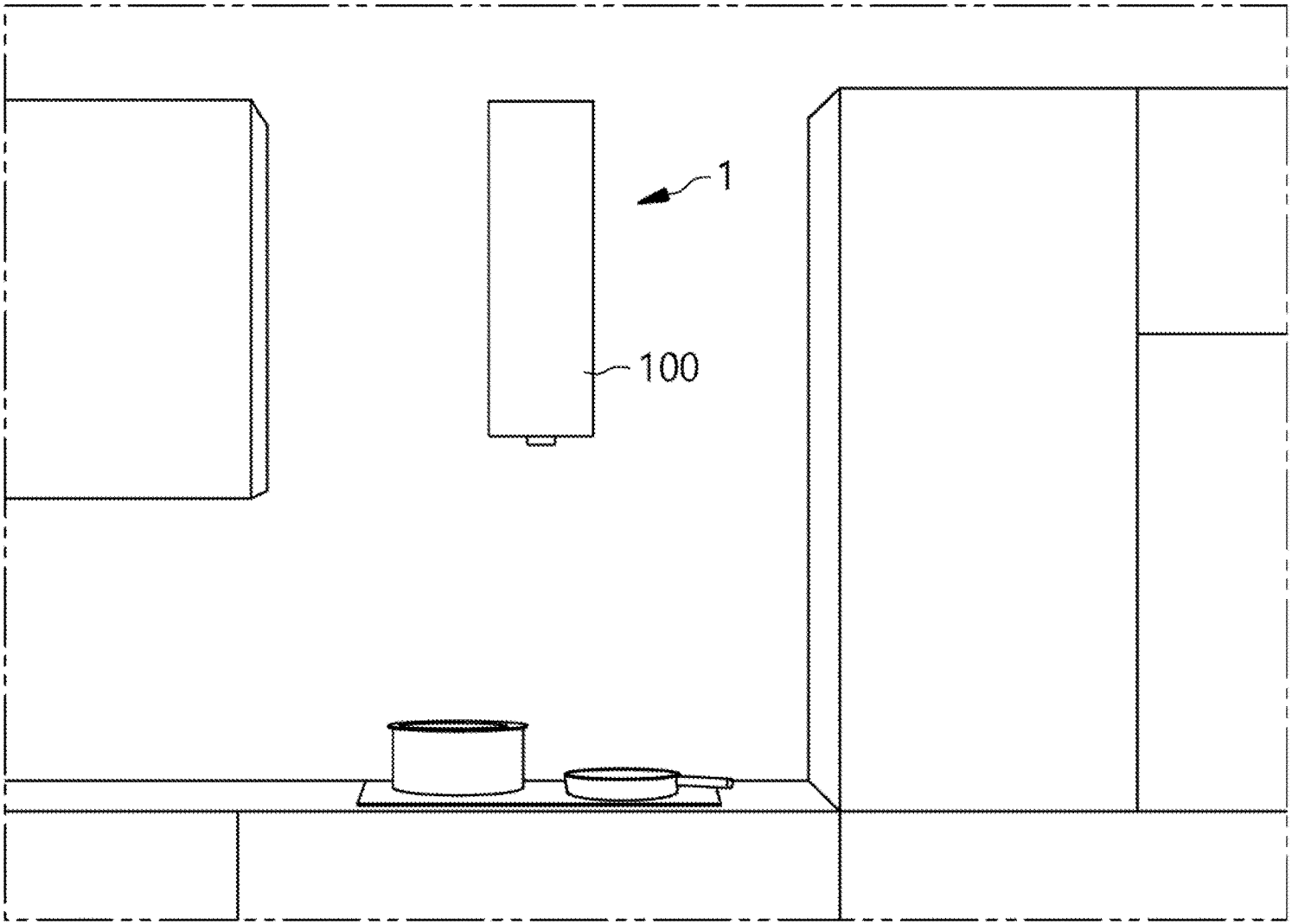
FIG. 1 is a front view of a kitchen hood according to an embodiment installed in a kitchen.
Figure 2:
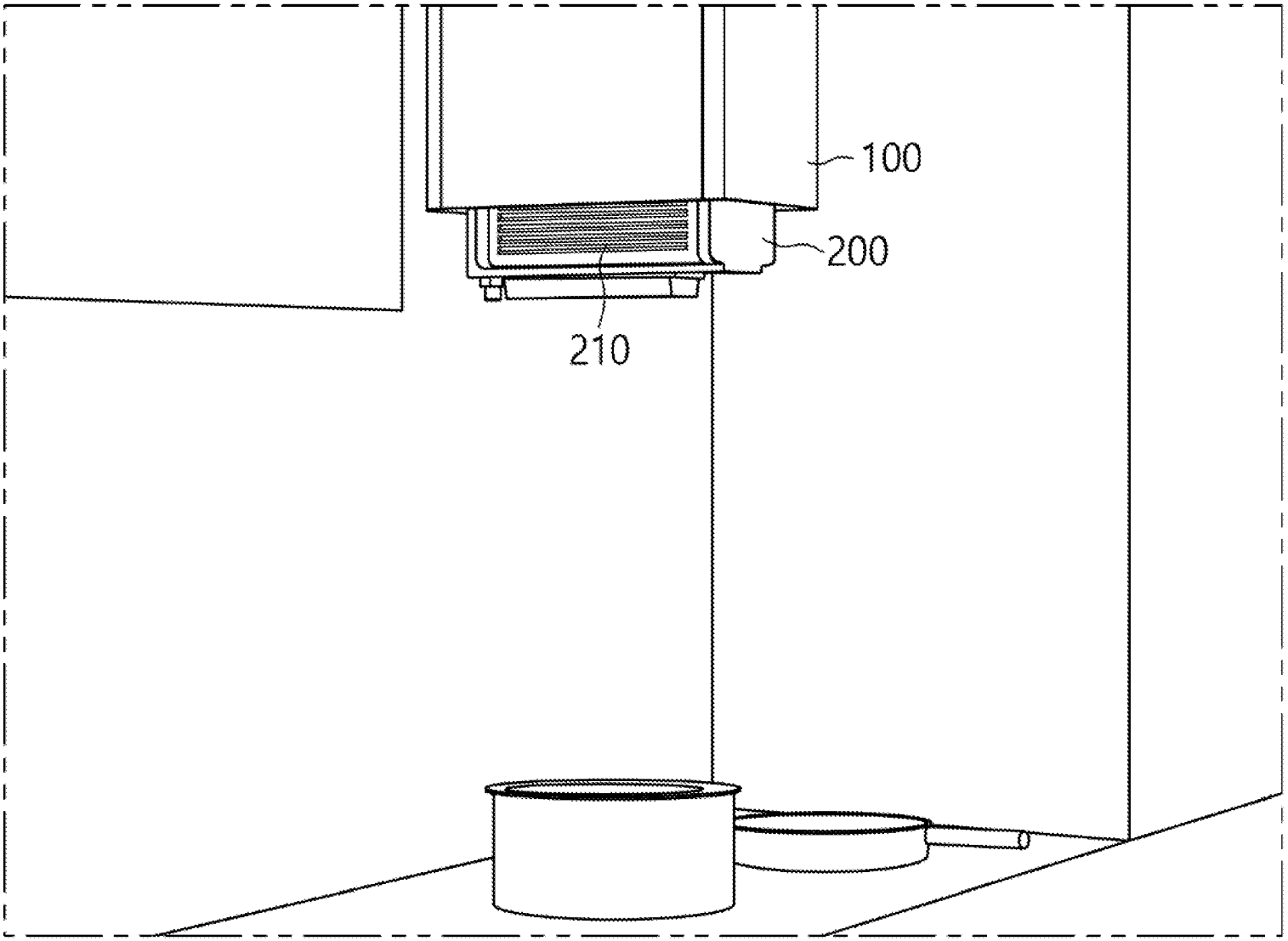
FIG. 2 is a side perspective view of the kitchen hood in FIG. 1 in a partially lengthened state.
Figure 3:
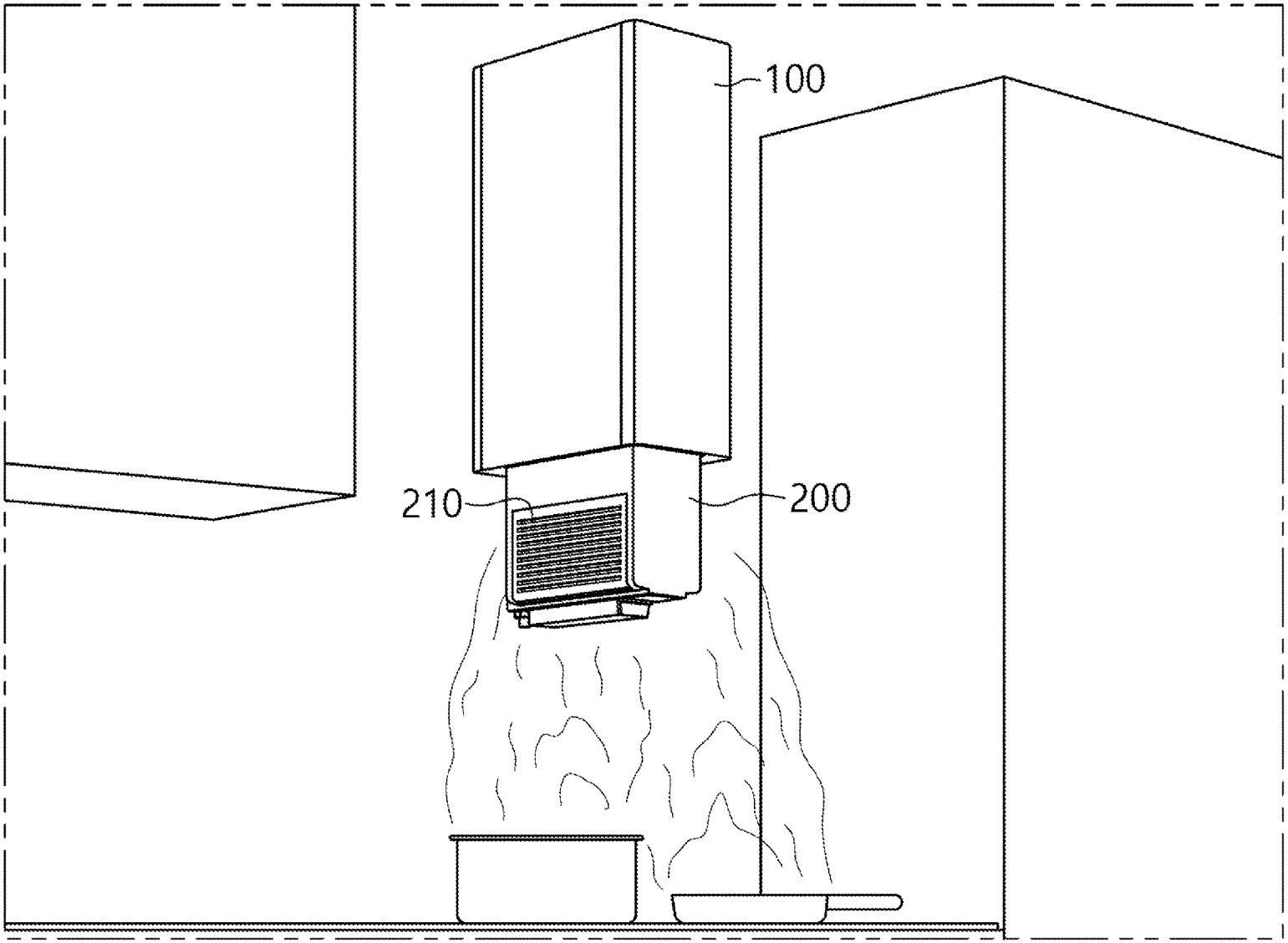
FIG. 3 is a side perspective view of the kitchen hood in FIG. 1 in a fully lengthened state.

Referring to FIGS. 1-3, a kitchen hood 1 according to an embodiment may be provided to suction ambient air into an interior space and discharge suctioned air. The kitchen hood 1 may include a housing or casing 100 having a rectangular or cuboid shape. An exterior of the casing 100 may be made out of a metal or glass-coated metal material (e.g., glass-coated stainless steel or brushed stainless steel), but embodiments disclosed herein are not limited hereto. The housing 100 may define an outermost surface of the kitchen hood 1 to form an exterior appearance.

The casing 100 may serve as a first housing 100, and the kitchen hood 1 may include a second housing 200 configured to slide into and out of the first housing 100. The second housing 200 may include a suction grill 210 through which ambient air is suctioned. A sliding movement of the second housing 200 may adjust a height of the suction grill 210. The first and second housings 100 and 200 may alternatively be referred to as an outer and inner housing or casing, respectively, or as female and male housings, respectively.

The second housing 200 may slide out of the first housing 100 so that the suction grill 210 is lowered to be closer to a stove surface or a pan, pot, or other dish (hereinafter, "cookware") provided on the stove surface. A sliding movement of the second housing 200 may be manually controlled by a user or automatically controlled based on a detected pan height or an amount of smoke or other gases detected by the kitchen hood 1. As an example, when a sauce pan or pot with boiling water is provided on the stove under the kitchen hood 1, the second housing 200 may have a higher height (as exemplified in FIG. 2) and remain partially inserted into the first housing 100, as there may not be many contaminants such as oil mist in the air. When a frying pan with oil or other fragrant food ingredients is provided on the stove under the kitchen hood 1, the second housing 200 may have a lower height (as exemplified in FIG. 3) and be mostly slid out of the first housing 100 to better suction contaminants (e.g., harmful gases, oil mist, and/or fine dust) emanated from the frying pan.

The second housing 200 may also be made of a metal material, but embodiments disclosed herein are not limited hereto. The first and second housings 100 and 200 may be rectangular shells having front, rear, left, and right sides relative to the user facing the kitchen hood 1. The second housing 200 may have smaller lengths in the front-rear and left-right directions than the first housing 100 so as to fit inside the first housing 100.

The suction grill 210 may be provided on left and right side surfaces of the second housing 200. The suction grill 210 may be made of a metal and have a structure configured to filter contaminants from air passing through the suction grill 210.

The second housing 200 may also include a steam cleaning assembly 600 (FIG. 11) described later configured to release steam to clean an interior of the kitchen hood 1. Steam cleaning may be automatically performed at regular intervals, after cooking, or based on a user's command.

Figure 4A:
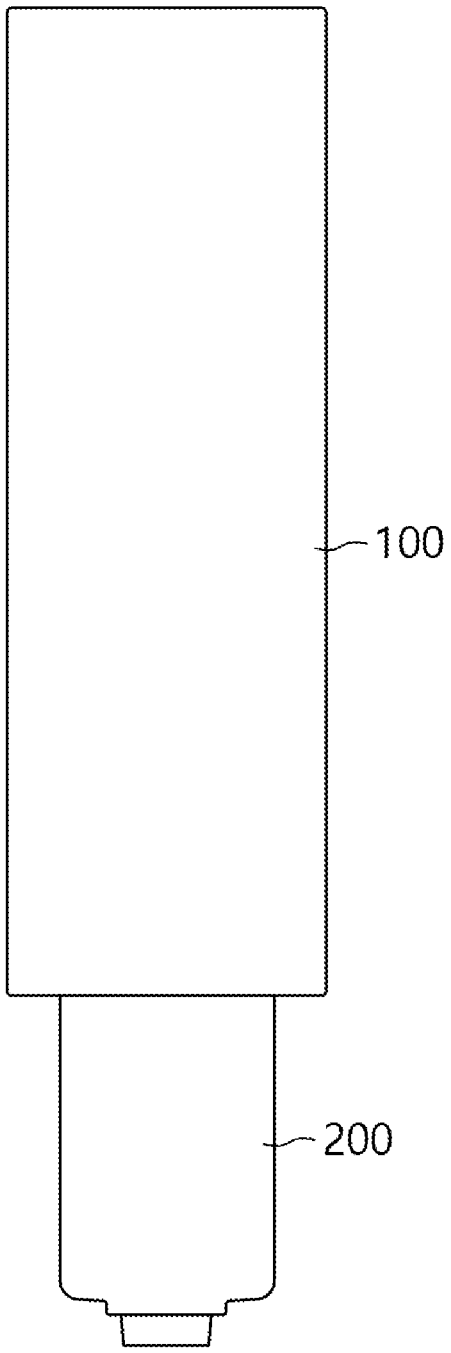
FIG. 4A is a front view of the kitchen hood in a fully lengthened state.
Figure 4B:
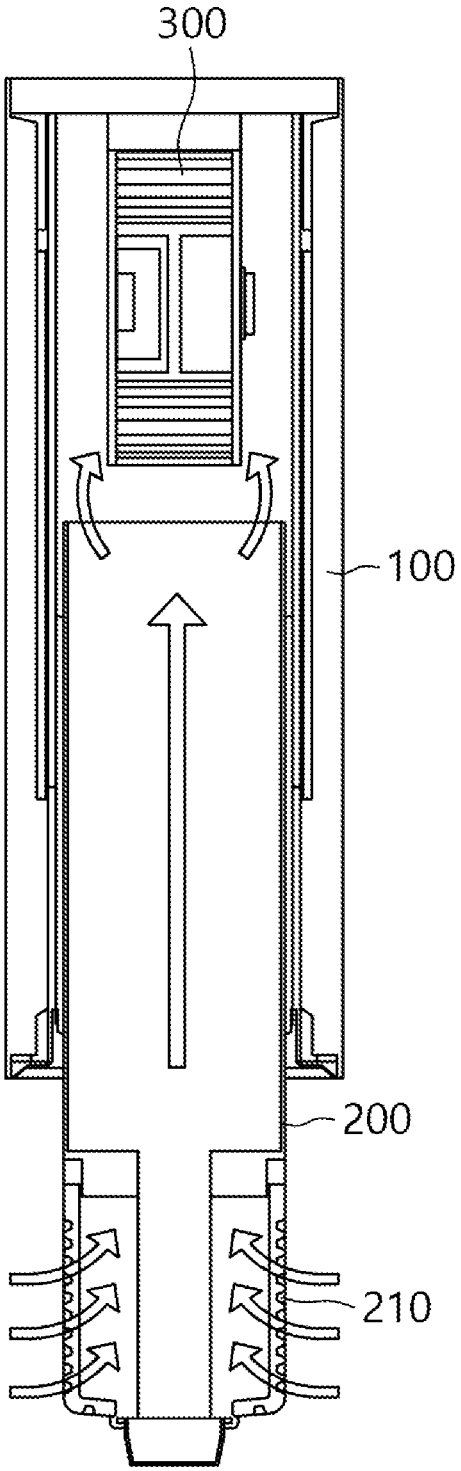
FIG. 4B is a front cut view of the kitchen hood showing an interior of the kitchen hood and an air flow.
Figure 5:
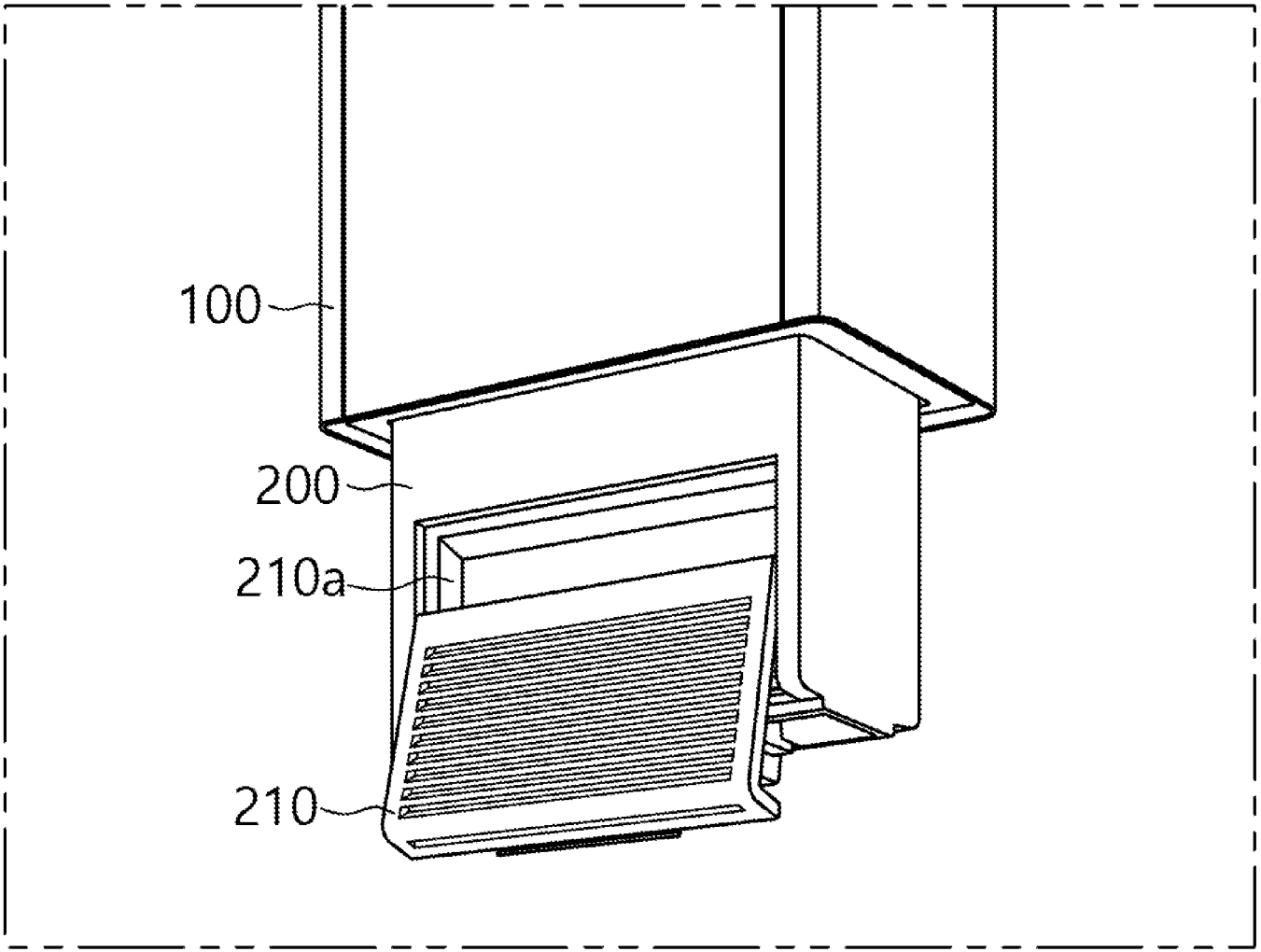
FIG. 5 is a side perspective view of the kitchen hood in a fully lengthened state and with the suction grill partially removed.

Referring to FIGS. 4A-5, a fan 300 may be provided inside an upper section of the first housing 100 to be above the suction grill 210. The fan 300 may be operated to suction air through the suction grill 210. A type, position, and orientation of the fan 300 may be configured so that air is suctioned through the suction grill 210, moved up toward the fan 300, and discharged out of a top of the kitchen hood 1 (or, if top ventilation is not possible, the suctioned air may be exhausted through a rear of the kitchen hood 1). The fan 300 may have a fixed position at a top of the first housing 100, while the suction grill 210 may move up and down with a sliding movement of the second housing 200.

The suction grill 210 may be lifted and removed from the second housing 200 for cleaning or repairs, and the suction grill 210 may have an optional contamination or dust sensor to alert a user to clean the suction grill 210. The suction grill 210 may be configured to be dishwasher-safe. The left and right side surfaces of the second housing 200 may each be formed with a hole or opening 210*a* in which the suction grill 210 may be received to couple with the second housing 200. The opening 210*a* may also be partially formed in a bottom surface of the second housing 200, and the suction grill 210 may have a bottom surface curved and extended from a side surface that is configured to fit within the opening 210*a*. The suction grill 210 may be coupled to the second housing 200 via a magnetic coupling. Details of the suction grill 210 and the fan 300 will be described later in more detail with reference to FIGS. 11-12.

Figure 6:
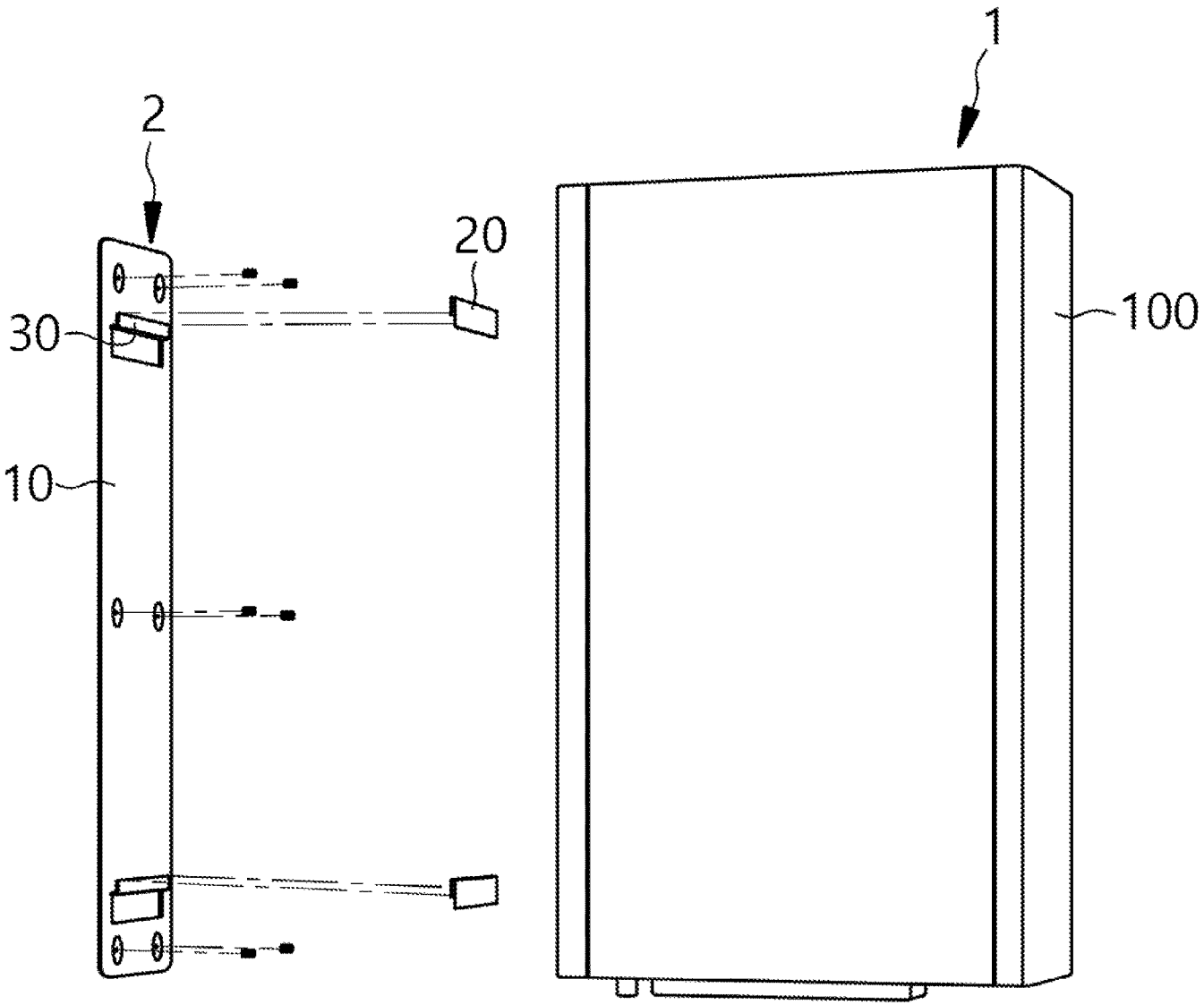
FIG. 6 is a side perspective view of a kitchen hood and a bracket to show how the kitchen hood is installed on a kitchen wall.
Figure 7:
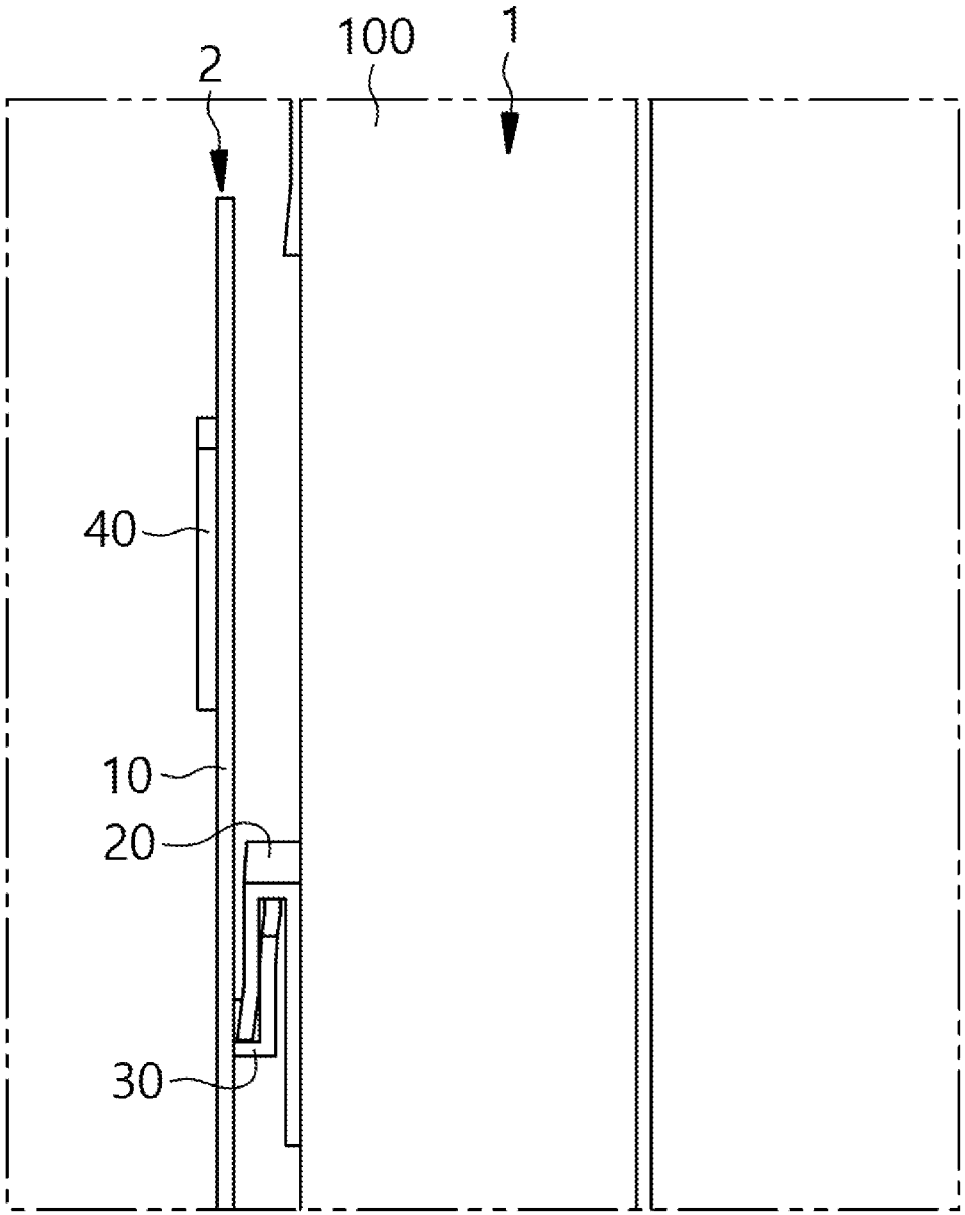
FIG. 7 is an enlarged side view of a kitchen hood coupled to the bracket of FIG. 6.

Referring to FIGS. 6-7, the kitchen hood 1 may be mounted to a kitchen wall via a bracket 2. The bracket 2 may include a plate 10 having a rectangular shape and configured to be screwed to a wall. A rear surface of the plate 10 may include at least one spacer or protrusion 40 configured to space the plate 10 apart from the wall 10 so that the plate 10 does not damage the wall. The spacer 40 may also deform according to any abnormal curves in the wall that a front surface of the plate 10 may be flat. The plate 10 may be made of a metal material. The spacer 40 may also be formed of a metal material and may be formed integrally with the plate 10. Alternatively, the space 40 may be formed of a pliable material (e.g., plastic) or an elastic material (e.g., a cushion or foam material) so as not to damage the wall.

Mounting holes may be formed to penetrate the plate 10 and the spacer 40, and the spacer 40 may alternatively be referred to as a mount. Screws or bolts may be inserted into the mounting holes to secure the plate 10 to the wall. A plurality of spacers 40 may be spaced apart in the vertical direction so that the plate 10 may be secured to the wall at a plurality of positions. For example, a spacer 40 and a pair of mounting holes may be formed in an upper section, a middle section, and a bottom section of the bracket 2.

At least one bracket hook 30 may extend from a front surface of the plate 10. The bracket hook 30 may be formed by cutting a portion of the plate 10, optionally heating the portion, and bending it upward so that the bracket hook 30 is formed integrally with the plate 10. Alternatively, the bracket hook 30 may be formed separately and later combined (e.g., bonded or welded) to the plate 10.

A rear surface of the first housing 100 may be coupled to (or alternatively formed integrally with) at least one hook 20. A front surface of the hook 20 may be flat so as to couple to (e.g., adhere to, screw onto, or bonded or fused with) the rear surface of the first housing 100. Alternatively, if the rear surface of the first housing 100 is slightly curved, then the front surface of the hook 20 may have a corresponding curvature so as to attach.

The hook 20 may hang on the bracket hook 30 of the bracket 2. The bracket hook 30 may be oriented to extend in an upward direction, while the hook 20 attached to the first housing 100 may be oriented to extend in a downward direction so as to hang on the bracket hook 30. The hook 20 may extend across a majority of the left-right length of the first housing 100.

A plurality of hooks 20 may be configured to hang on a plurality of bracket hooks 30. There may be a predetermined distance between hooks 20, and the bracket hooks 30 may also be spaced apart by the predetermined distance. There may be one bracket hook 30 in the upper section of the plate 10 and another bracket hook 30 in the lower section of the plate 10, and one hook 20 may be coupled to an upper section of the rear surface of the first housing 100 and another hook 20 may be coupled to a lower section of the rear surface of the first housing 100.

Openings may be formed in the plate 10 between the bracket hooks 30 to provide ventilation of suctioned air to the outside in a case where air may be discharged out of the rear of the first housing 100 instead of the top. Alternatively, or in addition thereto, the plate 10 may be formed with openings, but not bracket hooks 30, and the hooks 20 may hang from the openings.

Figure 8:
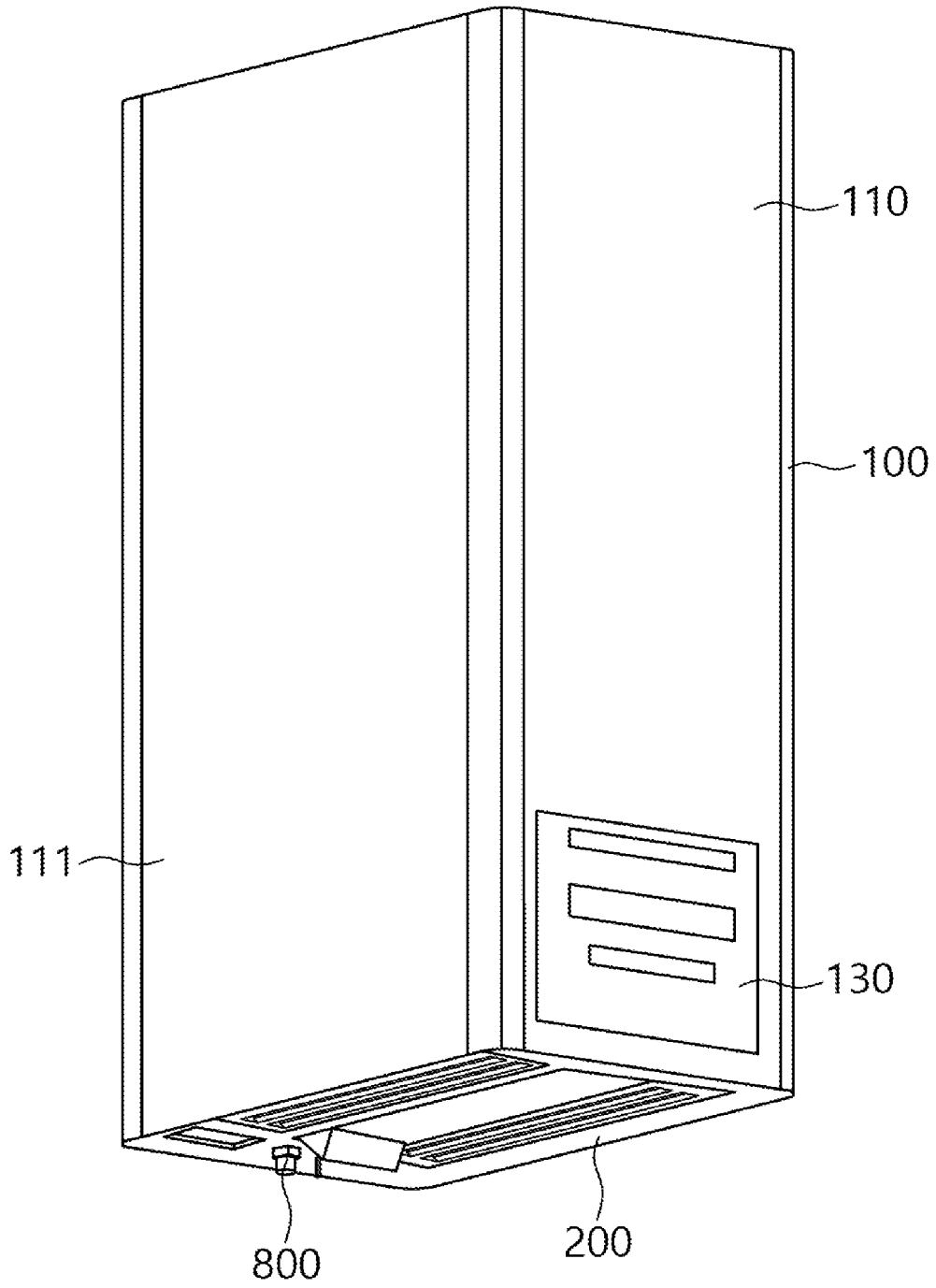
FIG. 8 is a perspective view of the kitchen hood showing a display.
Figure 9:
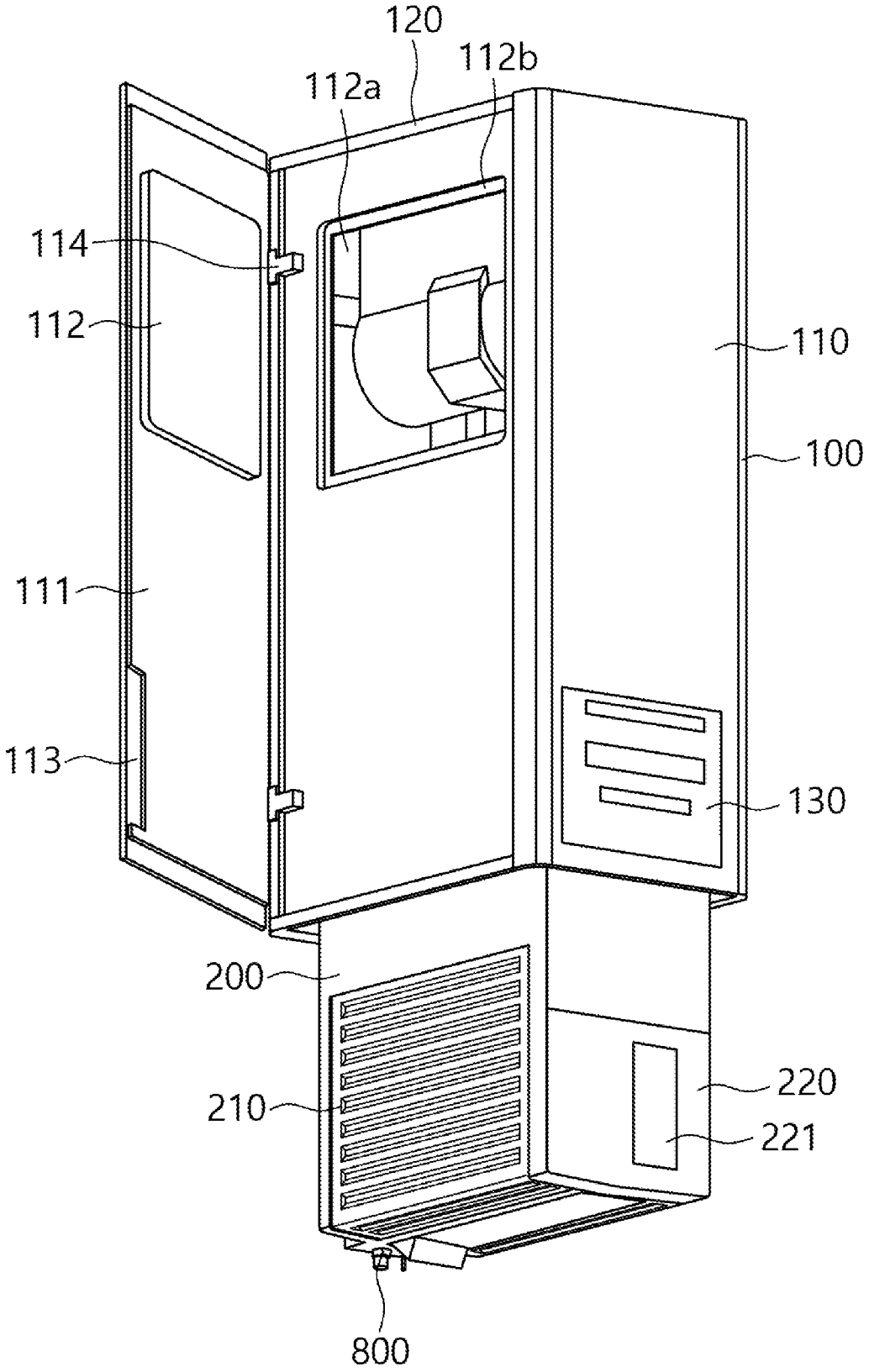
FIG. 9 is a perspective view of the kitchen hood in a lengthened state showing an outer case of the first housing opened.
Figure 10:
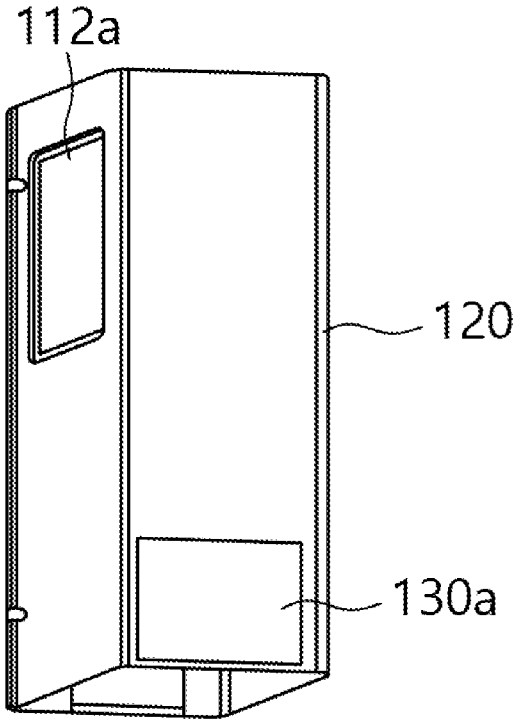
FIG. 10 is a perspective view of an inner case of the first housing and the second housing forming the kitchen hood.
Figure 10:
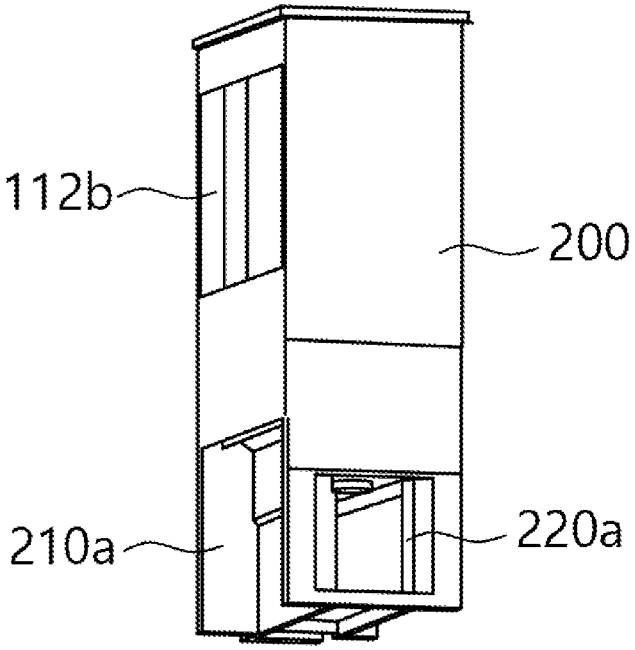

Referring to FIGS. 8-10, the first housing 100 may include an outer case or housing 110 and an inner case or housing 120. The outer case 110 may define an exterior appearance of the kitchen hood 1 and include the outermost surface of the kitchen hood 1. The outer case 110 may include the hooks 20 that attach to the bracket 2 (FIG. 7).

The second housing 200 may slide into and out of the inner case 120. The inner case 120 may include an air quality (AQ) sensor assembly 500 described later with reference to FIG. 25 to sense contaminants (e.g., carbon monoxide, smoke, dust, oil, or other harmful substances and gases) in the ambient air.

The outer case 110 may include a display 130, which may be configured to display air quality information, light information, cleaning information, temperature information, other operation information, or suggestions for the user to steam clean or remove the suction grill 210. The inner case 120 may be formed with a display mount or recess 130*a* in which the display 130, including circuitry for the display 130, may be provided.

The outer case 110 may include a door 111 that is hinged to the inner case 120. The door 111 may open to expose the inner case 120. The outer case 110 may be formed of four rectangular panels that are attached to front, rear, left, and right side surfaces of the inner case 120. The door 111 may be a panel (e.g., a left panel) that is hinged to a corner of the inner case 120 via at least one hinge 114. The door 111 may include a hook or latch 113 that secures the door 111 in a closed state. The hook 113 may hook or clip onto a corresponding groove or latch provided at an inner side of a corner of the outer case 110 and/or an outer side of a corner of the inner case 120. Alternatively, or in addition thereto, the door 111 may be secured in the closed state via magnetic coupling.

The inner case 120 may include an opening 112*a* through which an interior of the inner case 120 may be exposed and a recess 112*b* bordering the opening 112*a*. Devices inside of the inner case 120 (e.g., the fan 300) may be repaired and/or replaced by opening the door 111 on the outer case 120 and working through the opening 112*a*. An inner surface of the door 111 may include a protrusion or seal 112 configured to fit inside of the opening 112*a* or to seal with the recess 112*b* formed around the opening 112*a* and close the opening 121*a*. The inner surface of the door 111, or at least the seal 112, may include a rubber, cushion, or other soft or elastic material. Length, width, and depth dimensions of the protrusion 112 of the door 111 may be equal to or slightly less than length, width, and depth dimensions of the recess 112*b* and/or the opening 112*a* of the inner case 120. When the door 111 is closed, the protrusion 112 may cover the opening 112*a* and prevent air, steam, dust, or other contaminants from seeping through the opening 112*a* and becoming trapped between the outer and inner cases 110 and 120.

Figure 11:
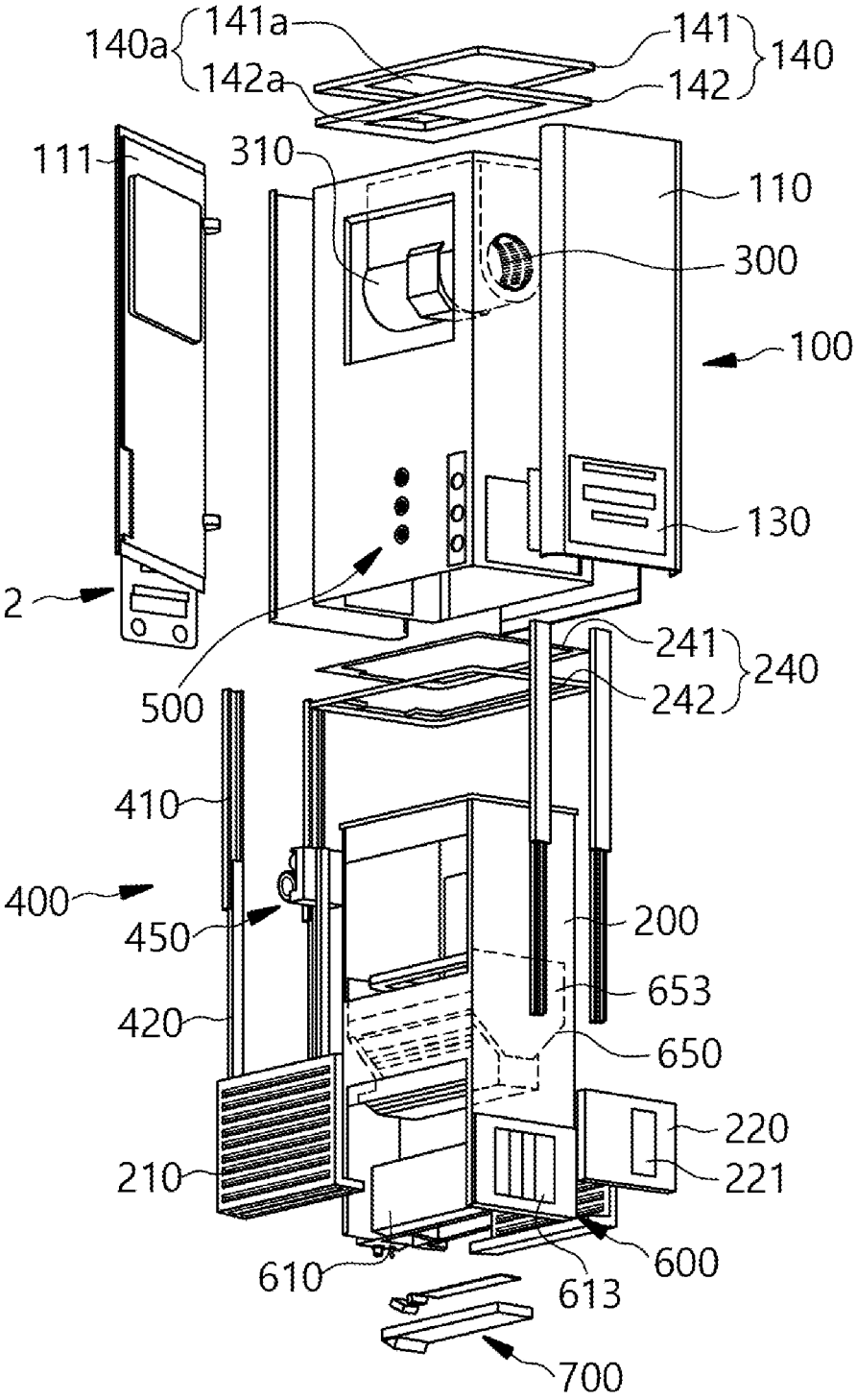
FIG. 11 is an exploded perspective view of the kitchen hood to show a sliding assembly and a steam cleaning assembly.

The second housing 200 may include a door or cover 220 having a handle 221 (e.g., a push button or recess). The cover 220 may be removed from the second housing 200 to expose an opening or container passage 220*a* in which a liquid storage container 610 described with reference to FIG. 11 is inserted. The cover 220 may be provided on a front surface of the lower housing 200, and the liquid storage container 610 may be removed when the second housing 200 is lowered. As described with more detail with reference to FIGS. 11 and 17-24, water and/or cleaning fluid may be placed in the tray, heated up, and used for automatic steam cleaning to clean devices (e.g., inner sides of the inner case 120, the fan 300, etc.) inside of the kitchen hood 1. Steam cleaning may occur upon a user's command, at automatic or regular intervals, after a predetermined cooking frequency, or optionally based on sensed levels of contaminants or air quality. Residue or condensate generated during steam cleaning may be guided back down to the liquid storage container 610 to be discarded.

An optional fire emergency assembly 800 may be provided on a bottom of the second housing 200 to detect and extinguish fires. Details of the fire emergency assembly 800 will be described in more detail with reference to FIGS. 17-20.

Figure 12:
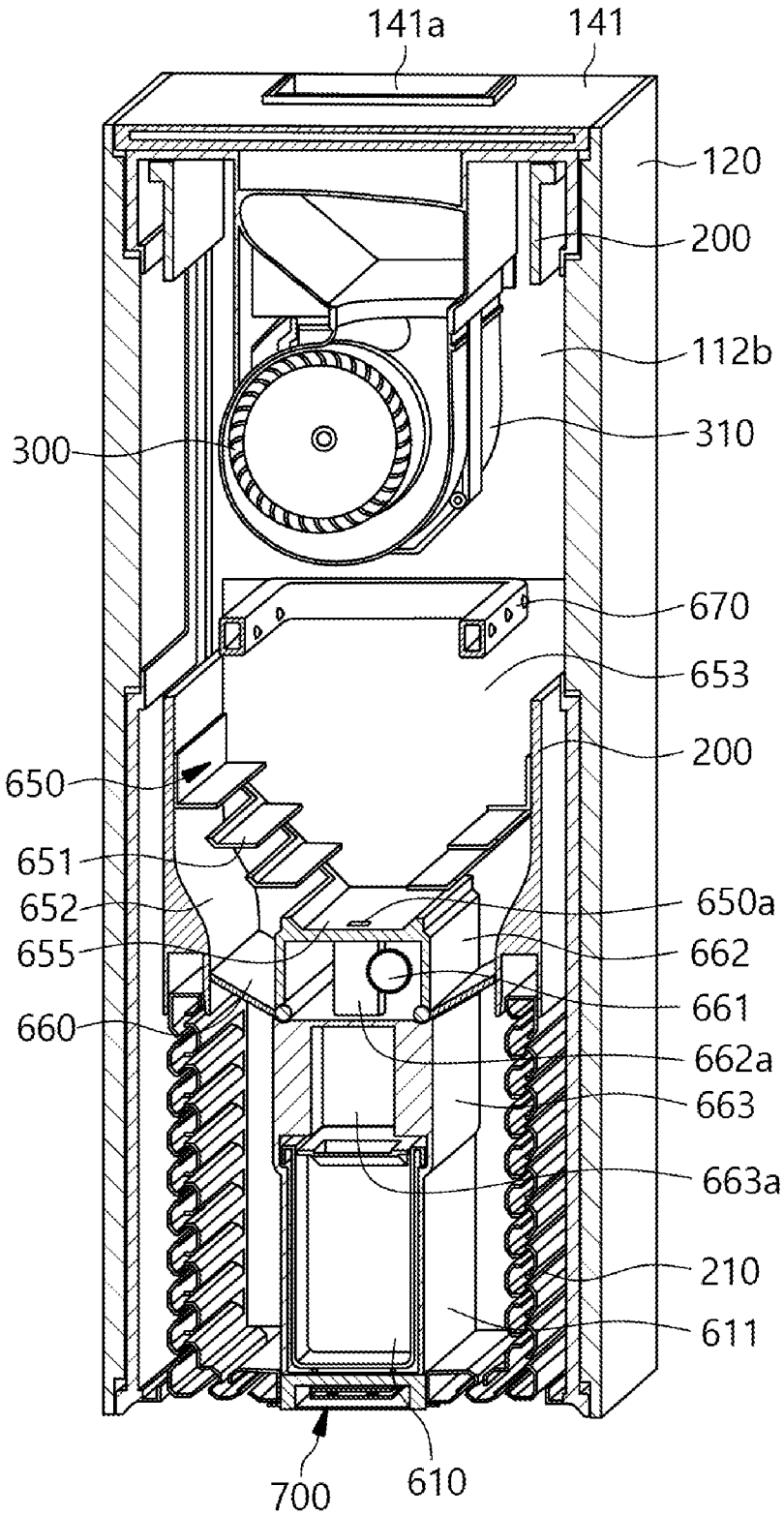
FIG. 12 is a cut front view of the first housing and the second housing in a shortened state.
Figure 13:
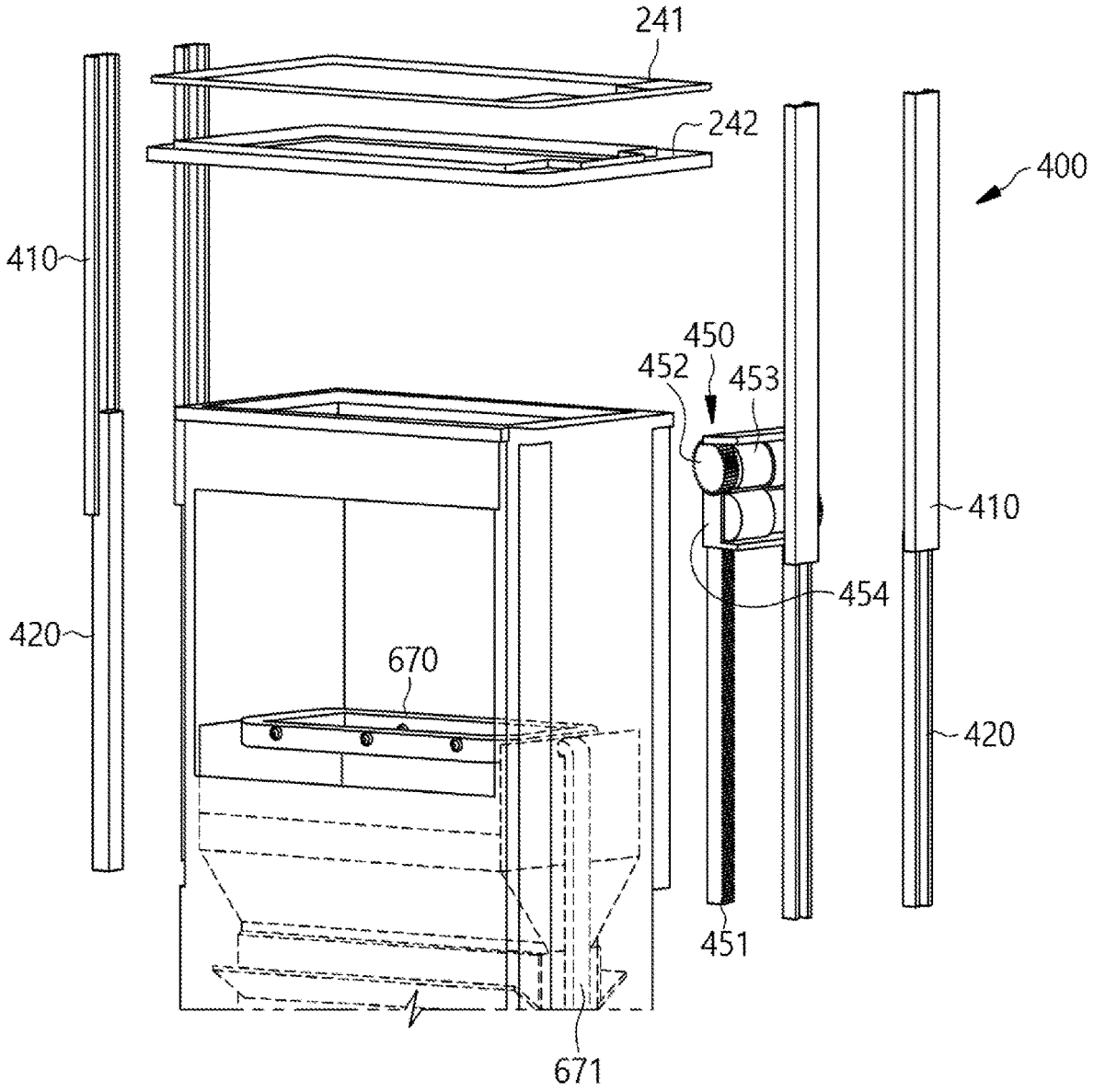
FIG. 13 is an exploded perspective view of the sliding assembly.
Figure 14:
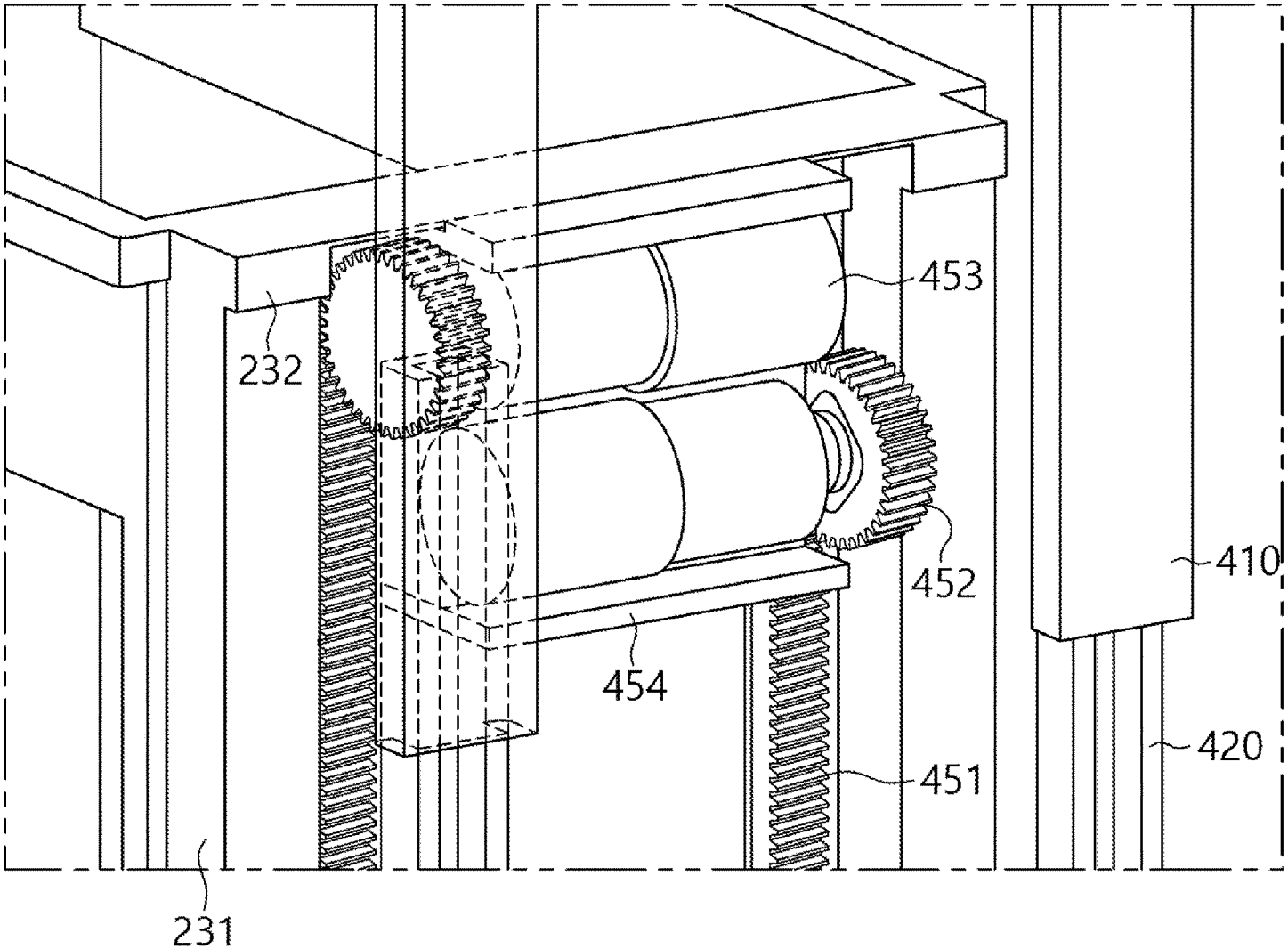
FIG. 14 is an enlarged exploded perspective view of gears of the sliding assembly.
Figure 15:
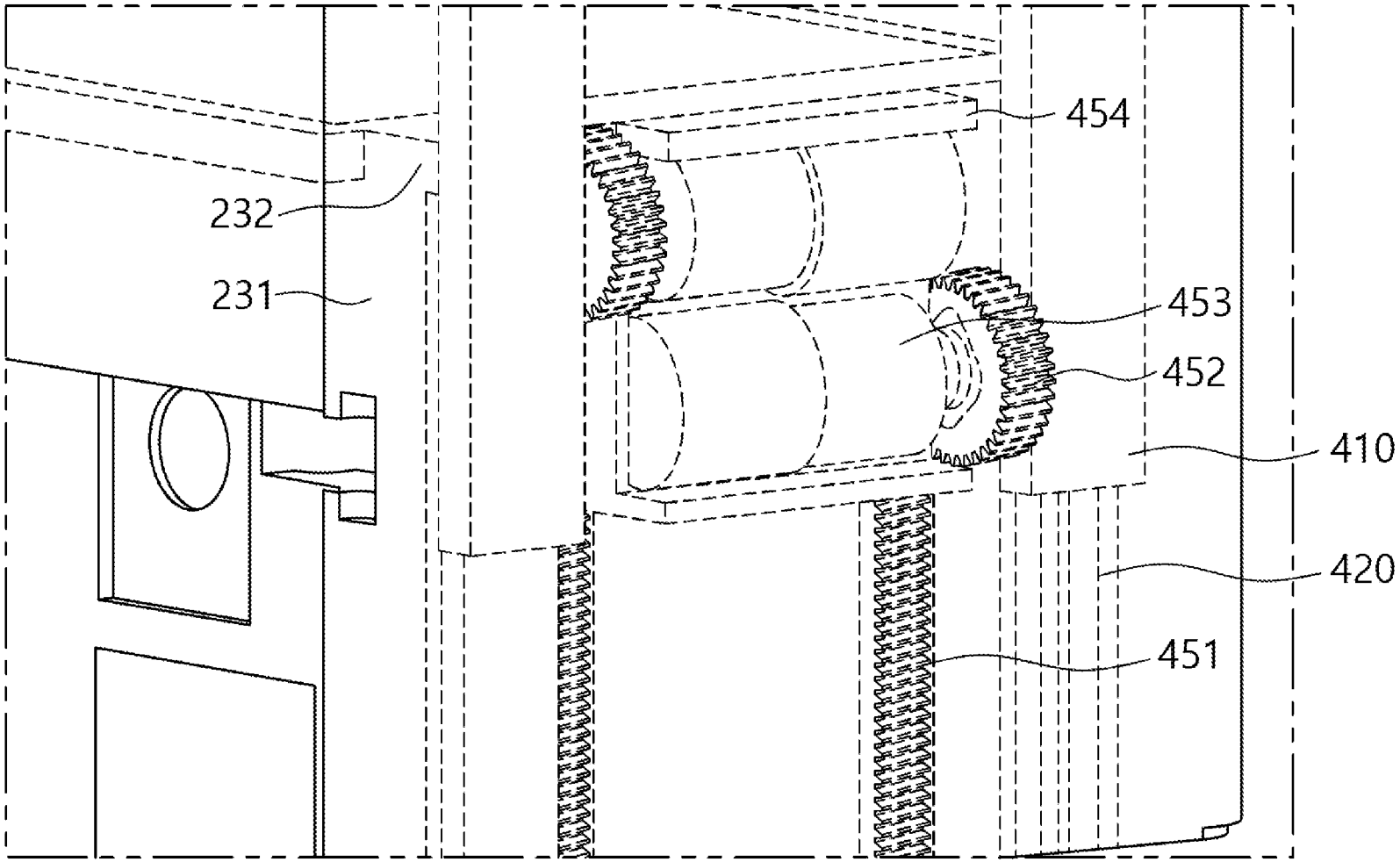
FIG. 15 is an enlarged assembled perspective view of gears of the sliding assembly.

Referring to FIGS. 11 and 12, the second housing 200 may slide into and out of the first housing 100 via a sliding assembly 400. The sliding assembly 400 may include at least one first rail 410 provided on an inner surface of the inner case 120 and at least one second rail 420 provided on an outer surface of the lower housing 200. The second rail 420 may slide into and out of a groove, slot, or guide formed in the first rail 410, and the first and second rails 410 and 420 may alternatively be referred to as female and male rails, respectively. Alternatively, the second rail 420 may have a groove, slot, or guide that slides around the first rail 420. The sliding assembly 400 may include a driving assembly 450 (e.g., motor, actuator, pneumatic or hydraulic pump, or rack and pinion) to automatically raise and lower the second housing 200 with respect to the first housing 100. Details of the sliding assembly 400 will be described with reference to FIGS. 13-16.

The panels forming the outer case 110 may each have a rectangular shape with rounded corner sections. The panels of the outer case 110 may be slightly longer and wider than side surfaces of the inner case 120 so as to surround the inner case 120. The panels of the outer case 110 may be snap-fit together. Alternatively, or in addition thereto, the panels of the outer case 110 may be secured to (e.g., screwed to, adhered, fused, bonded, or welded) the side surfaces of the inner case 120. The door 111 may not be adhered to the inner case 120, and instead be hinged to a corner of the outer case via a hinge or hinge structure 114. As an example, the inner case 120 may have shafts or pinions that protrude from a corner, and the outer case 110 may have hinge knuckles or brackets configured to rotate around the shafts or pinions of the inner case 120. As an alternative, the outer case 110 may have shafts or pinions that protrude from a corner and insert into hinge brackets protruding from a corner of the inner case 120. As another alternative, the door 111 may be hinged to another panel of the outer case 110 instead of to the inner case 120. Embodiments disclosed herein are not limited to such a hinge coupling.

An air quality (AQ) sensor assembly 500 may be provided in a side surface (e.g., a left side surface) of at least one of the inner case 120 or the outer case 110. The AQ sensor assembly 500 may include sensors to sense dust, oil, smoke, odors, carbon monoxide, carbon dioxide, and other harmful gases or substances in the air. A height adjustment of the second housing 200, an operation of the fan 300, and/or a steam cleaning operation may be based on detections by the AQ sensor assembly 500. The outer case 110 may have openings or holes so that air, dust, smoke, oil, etc. may reach the AQ sensor assembly 500. As an example, the AQ sensor assembly 500 may be provided in a left side of the inner case 120 to be behind the door 111, and the door 111 may have holes or openings aligning with the AQ sensor assembly 500. The AQ sensor assembly 500 will be described in more detail with reference to FIGS. 23A, 23B, and 25A.

Sides of the inner case 120 may define a top opening. The top opening of the inner case 120 may be at least partially covered by first and second top frames 141 and 142 that are coupled (e.g., welded or pressed-fit) onto a top of the inner case 120. The first and second top frames 141 and 142 may be coupled to each other to form a first housing top frame 140. The first top frame 141 may be made of a metal or hard plastic material fixed (e.g., welded or snap fit) to a top of the inner case 120 to provide rigidity, while the second top frame 142 may be made of a rubber or other elastic material that is fit inside of a groove formed in a bottom of the first top frame 141, and the second top frame 142 may serve as a seal, gasket, or cushioning for a top of the second housing 200.

The first top frame 141 may include a hole or opening 141*a*, and the second top frame 142 may include a hole or opening 142*a*. When the first and second top frames 141 and 142 are coupled to the top of the inner case 120, the openings 141*a* and 142*a* of the first and second top frames 141 and 142 may align to form an upper opening 140*a*. Suctioned air may be discharged or exhausted through the upper opening 140*a*. An exterior exhaust duct or tube may be coupled to the first housing top frame 140 and communicate with the upper opening 140*a* so that suctioned air may be exhausted to an outside space. Alternatively, or in addition thereto, a discharge grill or replaceable filter may be formed or provided in at least one of the openings 141*a* and 142*a*.

An optional wire hole may be formed in the first and second top frames 141 and 142 so that electricity may be supplied via a wire to the fan 300, AQ sensor assembly 500, display 130, the sensor assembly 700, the sliding assembly 400, and the steam cleaning assembly 600. The wire may be coupled to a terminal provided at a top or side of the first housing 100 (e.g., in or under the first housing top frame 140 or at a rear of the inner case 120). The terminal may be configured to receive external power from a commercial power supply (e.g., wall socket) and may include a socket or plug to which a cable may be connected.

The fan 300 may be a centrifugal fan to suction air in an axial direction and discharge air radially. The fan 300 may, for example, be a straight radial fan, a forward curved fan, or a backward curved fan. The fan 300 may be positioned so that the axial direction of the fan 300 aligns with a front-rear direction, but embodiments disclosed herein are not limited hereto. Blades of the fan 300 may be shaped and angled so as to reduce noise from suctioning and discharging air.

The fan 300 may be provided in a fan housing 310. The fan housing 310 may serve as an air guide, and may extend in a spiral shape and be configured to guide air discharged from the fan 300 upward. The fan housing 310 may be secured to a bottom surface of the second top frame 142 at a center so as not to interfere with a sliding movement of the second housing 200, and the first top frame 141 may be provided on top of the second top frame 142 to further seal the top. An orientation of the fan 300 and fan housing 310 may be configured so the discharged air is guided through the openings 141*a* and 142*a* of the first housing top frame 140. If top venting is not possible, an adapter may be used to close the upper opening 140*a*, and a rear adapter plate (not shown) may be removed to exhaust through the rear.

A front-rear length of the fan housing 310 may be greater than or equal to a front-rear length of the fan 300 so as to protect the fan and guide discharged air. An upper portion of the fan housing 310 may be greater in a left-right length and a front-rear length than left-right lengths and front-rear lengths of the first and second openings 141*a* and 142*a* of the first housing top frame 140. The upper portion of the fan housing 310 may include an incline extending upward from above a center of the fan 300 toward a side (e.g., a left side) so as to guide discharged air evenly outside of the first and second openings 141*a* and 142*a* of the first housing top frame 140.

The second housing 200 may define an upper opening. First and second top frames 241 and 242 may be coupled (e.g., pressed-fit or welded) onto a top of the second housing 200. The first and second top frames 241 and 242 may be coupled to each other to form a second housing top frame 240. The second top frame 242 may be coupled (e.g., welded or pressed-fit) to an upper edge or rim of the second housing 200 to provide rigidity to the second housing 200, while the first top frame 241 may fit into a groove provided on top of the second top frame 242. The first top frame 241 may be made of an elastic material (e.g., a rubber) or cushion to serve as a cushion, seal, or gasket when the second housing 200 is fully inserted into the first housing. When the second housing 200 is fully inserted into the first housing 100, the second housing top frame 240 may contact the first housing top frame 140, and noise may be reduced during collision or contact. The second top frame 142 of the first housing 100 may have grooves in which a rim of the first top housing 241 of the second housing 200 may be inserted so as to form a seal and prevent air, steam, dust, or other foreign matter from entering into a space between the first and second housings 100 and 200 or to prevent suctioned air or steam from escaping. Each of the top frames 241 and 242 may have large holes or openings so as to allow the fan housing 310 to pass through the top frames 241 and 242 and so as not to obstruct suctioned air from being discharged by the fan 300 out of the openings 141*a* and 142*a* of the first and second top frames 141 and 142 of the first housing 100.

A steam cleaning assembly 600 may be provided in the second housing 200. The steam cleaning assembly 600 may include a liquid storage container 610 in which water, detergent, chemicals, or other cleaning fluid may be inserted. The liquid storage container 610 may be removed and inserted into a container guide 611 formed in a bottom of the second housing 200. The container guide 611 may be a rectangular frame that defines the opening 220*a* through which the liquid storage container 610 is inserted. A front frame or plate 613 may be provided on a front surface of the liquid storage container 610. The front frame 613 may be coupled to the cover 220.

Water or an aqueous solution provided in the liquid storage container 610 may be heated by a steam generator 612 (FIG. 19) to generate steam. The generated steam may be transferred to a steam distributor 670 provided at an upper section of the inner case 120 to clean the fan 300 and an interior of the inner case 120. The steam distributor 670 may be a tube or a pipe shaped in a square or ring shape coupled to a top of the steam cleaning assembly 600 or alternatively to the inner surface of the second housing 200. Alternatively, the steam distributor 670 may form a U-Shape or |_|-shape, where an opening faces the front of the second housing 200. In yet another alternative, the steam distributor may be formed as a hollow square frame or shower head. Shapes and configurations of the steam distributor 670 are not limited.

A tube or channel 671 (FIG. 13) of a prescribed shape may couple the steam distributor 670 to the steam generator 612 (FIG. 19) so that steam may travel through the tube 671 to the steam distributor 670. Alternatively, the tube 671 may be a pipe. The stream distributor 670 may have a plurality of holes or nozzles 672 (FIG. 16) through which steam may be discharged to clean the interior of the inner case 120. Depending on the design requirements, a cross-sectional shape of the tube may be circular, rectangular, polygonal, triangular, etc.

The steam cleaning assembly 600 may include a condensate guide or collector 650 configured to collect condensate and other residual substances and guide the condensate downward back to the liquid storage container 610 to be disposed. Left and right sides of the condensate guide 650 may have a general inward inclination from a top to a bottom to guide fluid downward and back to the liquid storage container 610. Front and rear plates 653 of the condensate guide 650 may be coupled to (e.g., screwed to, pressed-fit within, bonded, or welded) to an upper section of the inner surface of the second housing 200. The rear plate 653 may be spaced apart from the inner surface of the first housing 100 so as to leave room for the tube 671, or alternatively may be formed with a recess in which the tube 671 may be provided.

The left and right sides of the condensate guide 650 may include a plurality of tabs or ribs 651 spaced apart from each other along the general inclination defined by the condensate guide 650. The tabs 651 may resemble stairs and extend between the front and rear plates 653 of the condensate guide 650. The tabs 651 may be spaced apart from each other in the vertical direction, and the tabs 651 may not vertically overlap with each other or at least may only partially vertically overlap with each other. The tabs 651 may have a slight downward inclination to guide condensate downward. Alternatively, the tabs 651 may extend horizontally. The tabs 651 will be described in more detail with reference to FIGS. 17-20.

A damper assembly 662 may be provided below the condensate guide 650. The damper assembly 662 may include dampers 660 and house gears 661 to rotate the dampers 660, which will be described later. A first condensate passage 662*a* provided inside of the damper assembly 662. A bottom plate 655 of the condensate guide 650 may be provided on top of the damper assembly 662 to close an upper opening of the damper assembly 662, and the bottom plate 655 may have a hole or opening 650*a* aligning with the first condensate passage 662*a*. The bottom plate 655 may be slightly inclined or curved toward the opening 650*a* to guide condensate toward the opening 650*a* so that the condensate may fall through the first condensate passage 662*a* and eventually down to the liquid storage container 610.

An optional liquid guide 663 may be provided between the damper assembly 662 and the container guide 611, and an optional second condensate passage 663*a* may be provided in the liquid guide 663 at a position aligning with the first condensate passage 662*a* of the damper assembly 662. Heights of the liquid guide 663 and the condensate passage 662*a* may be configured so that there is a continuous passage from the opening 650*a* of the condensate guide 650 down to the liquid storage container 610 inserted into the container guide 611.

The container guide 611 may define the opening 220*a* in which the liquid storage container 610 is inserted, and the liquid storage container 610 may be slid into and out of the container guide 611. The second condensate passage 663*a* may communicate with an opened top of the container guide 611, or alternatively, if the liquid guide 663 is omitted, the first condensate passage 662*a* may communicate with an opened top of the container guide 611. Condensate may be guided downward through the opening 650*a* of the condensate guide 650 and the first and second condensate passages 662*a* and 663*a* inside of the damper assembly 662 and liquid guide 663 so as to reenter the liquid storage container 610 for disposal.

The damper assembly 662, liquid guide 663, and container guide 611 may be rectangular frames all having opened tops, but embodiments disclosed herein are not limited hereto. The damper assembly 662 and liquid guide 663 may be formed integrally as one frame, or alternatively may be formed separately and later combined.

An inner surface of the second housing 200 may include a curved portion 652 at left and right sides that curves inward under the condensate guide 650. The curved portion 652 may have an inward curve or inclination from top to bottom so as to guide any errant condensate downward. A bottom of the curved portion 652 may have an opening in which a top of the suction grill 210 is inserted, and the curved portion 652 may support a top of the suction grill 210.

Dampers 660 (e.g., butterfly, guillotine, louver, or vane type) may be provided between a lower section of the curved portion 652 and a lower section of the damper assembly 662. The damper 660 may be configured to open and close a suction passage defined between the steam cleaning assembly 600 and left and right sides of the second housing 200. The damper 660 may be inclined inward from a top to bottom when closed. A gear 661 may be provided inside of the damper assembly 662 to open, partially open, and close the dampers 660. There may be an optional wall or frame inside of the damper assembly 662 to surround and protect the gear 661.

A degree of opening of the dampers 660 may be adjusted during steam cleaning, and the fan 300 may be operated toward an end of the steam cleaning process to suction steam upward to clean the fan 300, fan housing 310, and upper sections of the inner case 120 and second housing 200. Alternatively, the dampers 660 may be closed during steam cleaning so as to prevent residual oil and dirt on the suction grill 210 from rising upward and to capture errant residue falling through the tabs 651. At least one damper 660 may be opened or partially opened during air cleaning or purifying when the fan 300 is operating. More details of the steam cleaning assembly 600 will be described later with reference to FIGS. 20-24.

The suction grill 210 may be provided in lower sections of side surfaces (e.g., left and right side surfaces) of the second housing 200. The suction grill 210 may be made of metal, and may be formed of a plurality of curved or semi-cylindrical slats or tabs that are vertically aligned so as to resemble window blinds. There may be multiple layers or grills in the left-right direction formed of the semi-cylindrical slats. For example, FIG. 12 shows a first or inner grill of semi-cylindrical slats and a second or outer layer of semi-cylindrical slats.

From an outside view, the outer grill of semi-cylindrical slats may appear to have a convex curvature, while the inner grill of semi-cylindrical slats may have an opposite curvature. Front-rear cross-sections of the inner grill of semi-cylindrical slats may have a C shape, while front-rear cross-sections of the outer grill of semi-cylindrical plates may have a ↄ Shape. The semi-cylindrical slats of the inner grill may be staggered with the semi-cylindrical slats of the outer grill. A shape of the suction grill 210 may be configured to capture foreign matter (e.g., oil or fine dust) from suctioned air.

Figure 26:
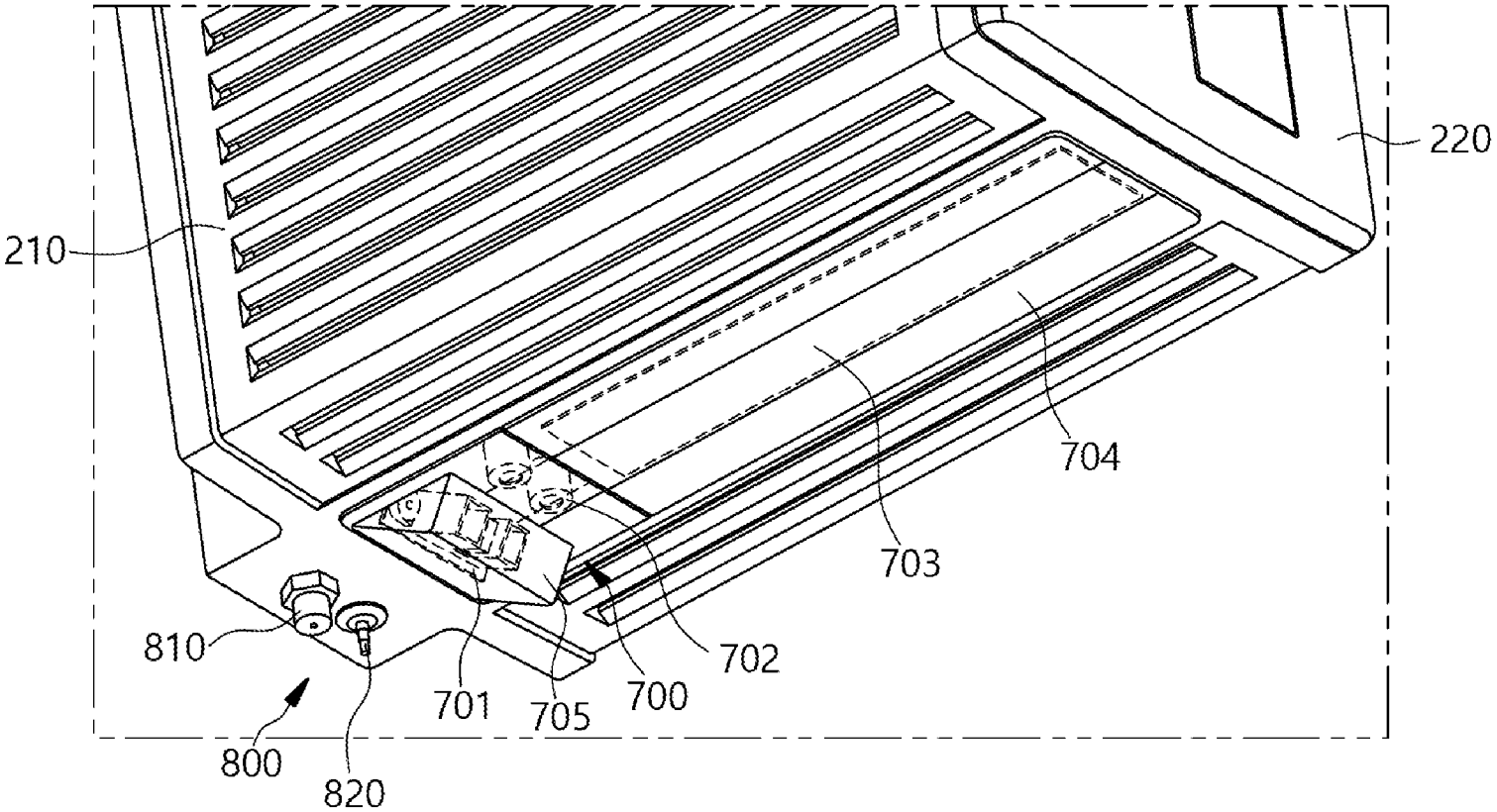
FIG. 26 is a perspective view of the height sensing assembly when viewed from below.

A bottom of the second housing 200 may include a sensor assembly 700 to sense a height of cookware provided on a stove below the kitchen hood 1. A height adjustment of the second housing 200 and/or an operation of the fan 300 may be based on a detection by the sensor assembly 700. The sensor assembly 700 may also sense how close a user is to the kitchen hood 1 and emit light or operate the fan 300 based on how close the user is. Details of the sensor assembly 700 will be described later with reference to FIGS. 26-27.

Referring to FIGS. 13-16, the sliding assembly 400 may be automatically operated by the driving assembly 450. An operation of the driving assembly 450 may be based on detections by the AQ sensing assembly 500 or the sensor assembly 700 (FIG. 11), an initiation of a steam cleaning operation, or based on a command input by a user.

At least one first rail 410 may be coupled (e.g., screwed, adhered, bonded, or welded) to an inner surface of the inner case 120. There may be four first rails 410 provided near the edges of the inner case 120. For example, one first rail 410 may be provided at each of a left section of a front surface or side, a right section of a front surface or side, a left section of a rear surface or side, and a right section of a rear surface or side of the inner case 120, but embodiments disclosed herein are not limited to the described number and positions of the first rails 410. As an alternative example, one first rail 410 may be provided at a center of the rear surface of the inner case 120, and another first rail 410 may be provided at a center of the front surface of the inner case 120. In yet another alternative example, one first rail 410 may be provided at a center of a left surface or side of the inner case 120, and another first rail 410 may be provided at a center of a right surface or side of the inner case 120 so that the first rails 410 are at left and right sides. Depending on a structural rigidity of the first rail 410 and the second rail 420, there may only be one first rail 410 (e.g., at the rear surface).

At least one second rail 420 may be coupled (e.g., screwed, adhered, bonded, or welded) to an outer surface of the second housing 200 at a position corresponding to the first rail 410 so as to engage with the first rail 410. In the example of four first rails 410 provided near the edges of the inner case 120, there may be four second rails 420 provided near the edges of the second housing 200. For example, one second rail 420 may be provided at each of a left section of a front surface, a right section of a front surface, a left section of a rear surface, and a right section of a rear surface, but embodiments disclosed herein are not limited to the described number and positions of the second rails 420.

The first rail 410 may be formed as a rectangular frame or bar having a groove. The entire second rail 420 may fit within the groove of the first rail 410, or alternatively, the second rail 420 may include a protrusion having a size configured to fit within the groove of the first rail 410. As another alternative, the second rail 420 may include a groove, and the first rail 410 and/or an optional protrusion of the first rail 410 may be configured to slide in the groove of the second rail 420. Shapes and contours of the first and second rails 410 and 420 are not limited.

A top of the first rail 410 may have an optional ledge or stopper to prevent the second housing 200 from sliding too far up and potentially knocking off the housing top frame 140 or having the condensate guide 650 collide with the fan housing 310. The second rail 420 may be formed as a solid bar or may have a solid top surface configured to interfere with the stopper of the first rail 410 to prevent further upward movement.

A bottom of the first rail 410 may include an optional ledge or stopper to prevent the second housing 200 from becoming separated from the first housing 100 and to also help support the second housing 200 in a fully lengthened state. The ledge may be provided at a position that does not interfere with an upward sliding of the second rail 420 (e.g., at a side). A top of the second rail 420 may have a hook or protruding rim configured to hang from the ledge provided at the bottom of the first rail 420 in the fully lengthened state.

The driving assembly 450 may be provided inside the inner case 120 at a position so as not to interfere with the first rail 410 (e.g., at a rear surface between two first rails 410 or, as another example, at a side of a centrally positioned single first rail 410). The driving assembly 450 may include a housing 454 that is coupled (e.g., bonded, welded, or screwed) to sides of the first rails 410. Alternatively, or in addition thereto, the driving assembly 450 may be coupled (e.g., bonded, welded, or screwed) to a rear inner surface of the inner case 120. The housing 454 may include a drive 453 (e.g., at least one of a motor, actuator, or hydraulic or pneumatic pump) configured to raise and lower the second housing 200. For convenience of description, the drive 453 will be referred to as a motor that provides a rotational movement.

The motor 453 may rotate a shaft or pinion that is coupled to a gear 452. A rack 451 may be provided on an outer rear surface of the second housing 200. Positions of the housing 454, motor 453, gear 452, and rack 451 may be configured so that the gear 452 aligns with the rack 451. The gear 452 may have teeth formed on an outer circumferential surface, and the rack 451 may be formed with grooves or teeth configured to engage with the teeth of the gear 452. When the motor 453 rotates the gear 452 in a first direction (e.g., clockwise), the teeth of the gear 452 may push the teeth of the rack 451 downward, and the second case 200 may be lowered. When the motor 453 rotates the gear 452 in a second direction opposite the first direction (e.g., counter-clockwise), the teeth of the gear 452 may push the teeth of the rack 451 upward, and the second case 200 may be raised or lifted. Top and bottom ends of the rack 451 may each have an optional ledge or stopper to prevent the rack 451 from disengaging with the gear 452.

There may be two gears 452 and two racks 451 so that a raising and lowering of the second housing 200 may be stable and secure. There may be two motors 453, which may be synced in motion so that each gear 452 is rotated at a same speed. Alternatively, the same motor 453 may rotate each gear 452 so that a speed of the gears 452 may be consistent and to reduce a weight of the driving assembly 450. Embodiments disclosed herein are not limited to two gears 452 and two racks 451, and multiple gears 452, racks 451, and/or motors 453 may be provided to better secure and support the second housing 200. As another alternative, there may be only one rack 451, one gear, 452, and one motor 453.

The rear surface of the second housing 200 may include a rectangular bar or protrusion 231 and an upper ledge 232. There may be two bars 231 formed at left and right sides or edges of the rear surface of the second housing 200 and two upper ledges 232 on top of the two bars 231. A number of bars 231 and upper ledges 232 may be equal to a number of second rails 420.

The second rail 420 may be coupled to the bar 231 underneath the upper ledge 232 such that a top of the second rail 420 contacts a bottom of the upper ledge 232. When a stopper or ledge is formed on a top of the first rail 410 to protrude forward, the stopper or ledge of the first rail 410 may rest on a top of the upper ledge 232 when the kitchen hood 1 is in a completely shortened or compact state. A protruding length of the upper ledge 232 may be less than or equal to a front-rear length of the second rail 420. A left-right length of the upper ledge 232 may be less than or equal to a left-right length of the groove formed in the first rail 410 so as not to interfere with a sliding movement.

The racks 451 may be provided on the rear surface of the second housing 200 at positions adjacent to the bars 231, and the housing 454 may be provided between the racks 451 so as not to interfere with a raising and lowering of the second housing 200. The gears 452 may protrude in a left-right direction from the housing 454 so as to align with the racks 451.

Figure 16:
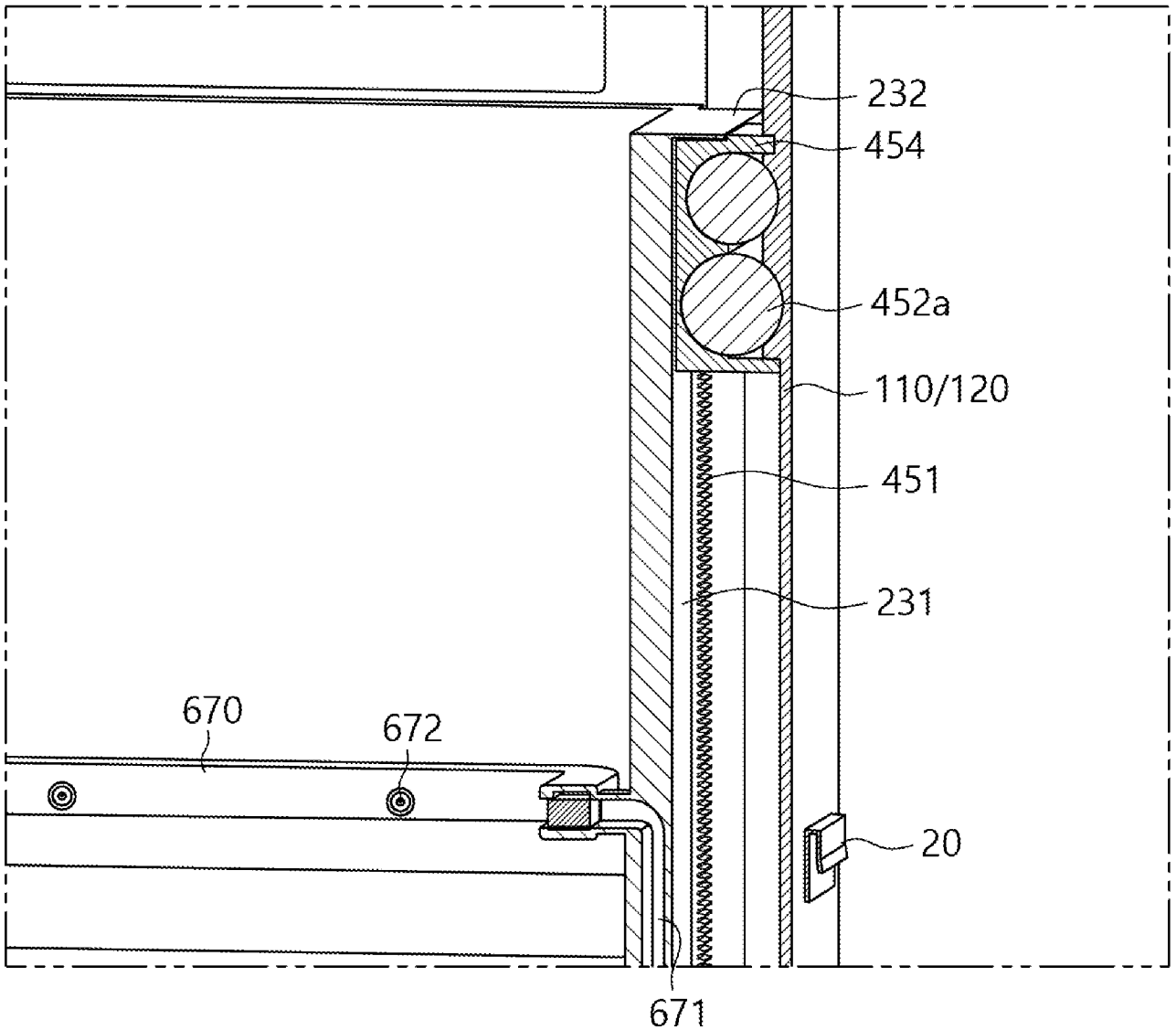
FIG. 16 is a side view of the sliding assembly.

As shown in FIG. 16, the housing 454 may cover the gear 452 and extend toward the bars 231 to couple to the first rails 410, and the housing 452 may include a front opening or hole through which the gear 452 may be exposed to engage with the rack 451. The housing 454 may optionally have left and right side openings or holes, and an optional gear cover **452*a* may be provided on a side surface of the gear 452 to protect the gear 452. The gear cover 452*a* may rotate with the gear 452. The gear cover 452*a* may not be flush with the side of the housing 454 so that the bars 231 and/or the first rails 410 do not interfere with a rotation of the gear 452 and gear cover 452*a*, Alternatively, if the housing 454 is primarily coupled to the rear inner surface of the inner case 120 and is not coupled to the first rails 410 so as to be spaced apart from the bars 231 in the left-right direction, the gear cover 452*a* may be flush with the side of the housing 454**.

As another alternative, the housing 454 of the sliding assembly 400 may penetrate the inner case 120 to be fixed to an inner surface of the outer case 110 of the first housing 100 so as to be closer to a bracket installation of the kitchen hood 1 for added support. The inner case 120 may include an opening through which the housing 454 may protrude so that the gear 452 may engage with the rack 451 fixed to the second housing 200. Although FIG. 16 shows a hook 20 provided below the housing 454, Alternatively, or in addition thereto, a hook 20 may be provided at a height corresponding to a height of a center of mass of the housing 454 so as to better support the housing 454.

Referring to FIGS. 17-20, the liquid storage container 610 may be configured to slide into and out of the container guide 611. The container guide 611 may be provided in a lower portion of the second housing 200 to define a passage having a left-right length that is greater than or equal to a left-right length of the liquid storage container 610. The container guide 611 may be formed to have a |_|-shape (or alternatively a U-shape), but embodiments disclosed herein are not limited hereto. The liquid storage container 610 may be a rectangular container (or alternatively a cylindrical container) defining an upper opening. A lid 614 may be provided to close the upper opening of the liquid storage container 610.

The lid 614 may be provided on top of the liquid storage container 610 during steam cleaning. The lid 614 may be formed with a guide 614*a*, which may be an inclined portion that is inclined downward from a top of the lid 614. There may be an opening 614*b* formed at or adjacent to a bottom of the guide 614*a*. The opening 614*b* may extend between a bottom of the guide 614*a* and the top of the lid 614. The guide 614*a* may communicate with a bottom of the second condensate passage 663*a* (or alternatively, if the liquid guide 663 is omitted, with a bottom of the first condensate passage 662*a*). Condensate that is collected and guided downward by the condensate collector 650 and first and second condensate passages 662*a* and 663*a* may be guided down into the liquid storage container 610 via the guide 614*a* and the opening 614*b* of the lid 614.

The left-right length of the container guide 611 may be less than a left-right length of an entire front surface of the second housing 200 and/or a distance between the suction grills 210. A side surface (e.g., a left or right side surface) of the container guide 611 may be spaced apart by a predetermined distance from the suction grill 210 so that air may be efficiently suctioned through the suction grill 210 and discharged through a top of the first housing 100.

The front frame 613 and cover 220 may have a left-right length that is greater than the left-right length of the container guide 611 and extend between left and right side surfaces of the lower housing 200. The cover 220 may have a handle 221 (e.g., a button or a recess), and the front frame 613 may have a recess to receive a rear side of the handle 221. The user may pull the handle 221 to slide the liquid storage container 610 out of the container guide 611.

The user may fill the liquid storage container 610 with water, chemicals, detergent, or other cleaning fluid. The liquid storage container 610 may have an optional wall to divide the liquid storage container 610 into two or more bins or sections. For example, the liquid storage container 610 may include a first bin or liquid dispenser 610*a* and a second bin or condensate collector 610*b*. The first bin 610*a* may be provided at a position adjacent to the steam generator 612 (i.e., at a rear), while the second bin 610*b* may be provided at a position aligning with the guide 641*a* of the lid (i.e., at a front). Cleaning fluid may be filled in a first bin 610*a*, while condensate may be guided down and deposited into the second bin 610*b*.

At least one of the container guide 611 or the liquid storage container 610 may have an optional water level sensor to sense an amount of liquid provided in the liquid storage container 610. For example, the container guide 611 may have a weight sensor. As another example, the liquid storage container 610 may have a capacitive sensor. Embodiments disclosed herein are not limited hereto. An operation of the steam generator 612 may be based on an amount of water sensed by the optional water level sensor. Steam cleaning may not begin until a sufficient amount of liquid (e.g., 350-400 ml) is provided in the liquid storage container 610, the second housing 200 is slid into the first housing 100, and the dampers 660 are closed.

A rear of the first bin 610*a* may have a seal or nozzle 615 that is configured to be opened and closed. A steam generator 612 (e.g., a heater) may be provided inside of the second housing 200 behind the container guide 611 or, alternatively, inside the container guide 611 to be behind the liquid storage container 610. The steam generator 612 may have a protrusion 617 with an opening 617*a* configured to couple to the seal 615. The seal 615 may be formed of an elastic material (e.g., rubber) and have an opening that is configured to be closed in an initial or resting state. The protrusion 617 may be pressed-fit into the opening of the seal 615 to open the seal 615 and allow liquid from the liquid storage container 610 to enter the steam generator 612 via the opening 617*a*. Alternatively, or in addition thereto, at least one of the seal 615 or the opening 617 may have a valve configured to be opened and closed.

During steam cleaning, the entered liquid in the steam generator 612 is heated. The steam generator 612 may be coupled to the steam distributor 670 via the tube 671. Steam generated in the steam generator 612 may flow up the tube 671 and into an inside of the steam distributor 670. The tube 671 may have a left-right length longer than a front-rear length so that steam may be diffused when entering the steam distributor 670.

The steam distributor 670 may resemble a rectangular or square frame so as to have a horizontal cross-sectional shape matching a horizontal cross-sectional shape of the second housing 200. Alternatively, the steam distributor 670 may be a ring. An interior of the steam distributor 670 may be hollow. The steam distributor 670 may have an opening at a center to reduce interference with suctioned air travelling upward and condensate dropping downward. As exemplified in FIGS. 16-20, the steam distributor 670 may cover only a periphery of an internal space of the second housing 200. The steam distributor 670 may be coupled to the front and rear plates 653 of the condensate collector 650 below the fan 300. Alternatively, the steam distributor 670 may be fixed to an inner surface of the second housing 200 adjacent to the condensate collector 650.

Steam may enter the internal space of the steam distributor 670 via the tube 671. The steam distributor 670 and the tube 671 may be formed of one tube or pipe, or alternatively be formed separately and later coupled. The nozzles 672 may be opened to discharge the steam and closed to collect steam. The nozzles 672 may be formed on an inner side of the steam distributor 670 so as to face a center of the housing. The nozzles 672 may be formed at left and right inner sides of the steam distributor 670 and spaced apart by equal intervals. Alternatively, or in addition thereto, the nozzles 672 may also be formed at front and rear inner sides of the steam distributor 670.

The nozzles 672 may be formed of an elastic material (e.g., rubber) configured to open based on pressure inside of the steam distributor 670. Alternatively, or in addition thereto, the nozzles 672 may have a valve controlled based on an optional pressure sensor provided in the steam distributor 670, and when the pressure inside of the steam distributor 670 is sensed to be at or above a predetermined pressure level, the nozzles 672 may automatically open to release the steam. The steam may be diffused into the inner space of the second housing 200. Some of the steam may rise to clean the fan 300, fan housing 310, and interior of the inner case 120 of the first housing 100, and some of the steam may fall to clean the condensate collector 650, and/or the interior of the second housing 200.

The steam may produce condensate, which may be caught by the condensate collector 650. Other falling substances (e.g., dust or oil) may also slide down sides of or fall through the interiors of the second housing 200 and/or optionally the first housing 100 and be caught by the condensate collector 650.

The condensate collector 650 may be a guide having inclined left and right sides defined by a plurality of tabs 651, front and rear plates 653, and an upper opening. A top of the condensate collector 650 defining the upper opening may have a left-right length and front-rear length that is equal to or slightly less than a left-right length and a front-rear length, respectively, of the interior space of the second housing 200 so that falling dust, oil, or condensate does not bypass the condensate collector 650.

The condensate collector 650 may guide the condensate back into the liquid storage container 610. The bottom plate 655 of the condensate collector 650 may be formed with the opening 650*a* through which condensate is guided. The opening 650*a* may communicate with an opening of the first condensate passage 662*a* (FIG. 21), and may have a left-right length and front-rear length that is equal to or less than a left-right length and front-rear length of the first condensate passage 662*a*. The bottom plate 655 of the condensate collector 650 may be optionally inclined or curved so as to guide collected condensate and other liquid toward the opening 650*a* to drop down through the first condensate passage 662*a* and the second condensate passage 663*a* inside of the damper assembly 662 and liquid guide 663, respectively, and into the liquid storage container 610. For example, the bottom plate 655 of the condensate guide 650 may be inclined downward from a rear to a front where the opening 650*a* is provided, and/or inclined inward from left and right sides toward a center where the opening 650*a* is provided.

Front and rear sides of the condensate collector 650 may be formed of front and rear plates 653*a* and 653*b*, respectively, which may have a rectangular and/or trapezoidal shape. A front face of the front plate 653*a* may be coupled (e.g., screwed, adhered, bonded, or fused) to the front of the second housing 200, and sides of the front plate 652*a* may be coupled to left and right sides of the second housing 200. A rear face of the rear plate 653*b* may be spaced apart from the rear of the second housing 200 so as to allow room for the pipe 671, or alternatively may be coupled to the rear of the second housing 200 and be formed with a recess to receive the pipe 671. Sides of the rear plate 653*b* may be coupled to the left and right sides of the second housing 200.

An upper section of the front and rear plates 653 may be square or rectangular shaped and extend between left and right sides of the second housing 200. A lower section of the front and rear plates 653 may have a trapezoidal shape so that a left-right length decreases from top to bottom. The lower end of the front and rear plates 653 may be coupled to the damper assembly 662, which may be formed as a hollow rectangular frame.

The steam distributor 670 may be coupled to upper ends of the front and rear plates 653*a* and 653*b*. The rear plate 653*b* may have an opening through which an upper end of the tube 671 is inserted to couple to the steam distributor 670.

Rectangular side plates 654 may extend between the front and rear plates 653. The side plates 654 may be coupled (e.g., welded or bonded) to a lower portion of the rectangular or square section of the front and rear plates 653 so as not to interfere with the steam distributor 670. The side plates 654 may be coupled (e.g., screwed, bolted, adhered, bonded, or welded) to left and right inner sides of the second housing 200, and may alternatively be referred to as left and right side plates.

The tabs 651 may extend between the lower or trapezoidal sections of the front and rear plates 653*a* and 653*b*. Since the left-right length of the lower sections of the front and rear plates 653*a* and 653*b* decrease from top to bottom to have an upside down trapezoid shape, the lowest tab 651 may be closer to a center of the second housing 200 than the highest tab 651.

Side bars or plates 653*c* may be formed at edges of the lower sections of the front and rear plates 653*a* and 653*b* to protrude inward. The tabs 651 may be coupled to or formed with the side bars 653*c*, which may add rigidity and stability to the tabs 651 and also the entire condensate guide 650. A top of the highest tab 651 may be coupled to a bottom of the side plate 654. The lowest tab 651 may be coupled to the bottom plate 655 of the condensate guide 650 and/or the damper assembly 662, There may be an optional bar connecting centers of the tabs 651 to provide additional support and rigidity. The tabs 651 may be slightly angled downward so as to guide condensate down to the damper assembly 662.

Figure 21:
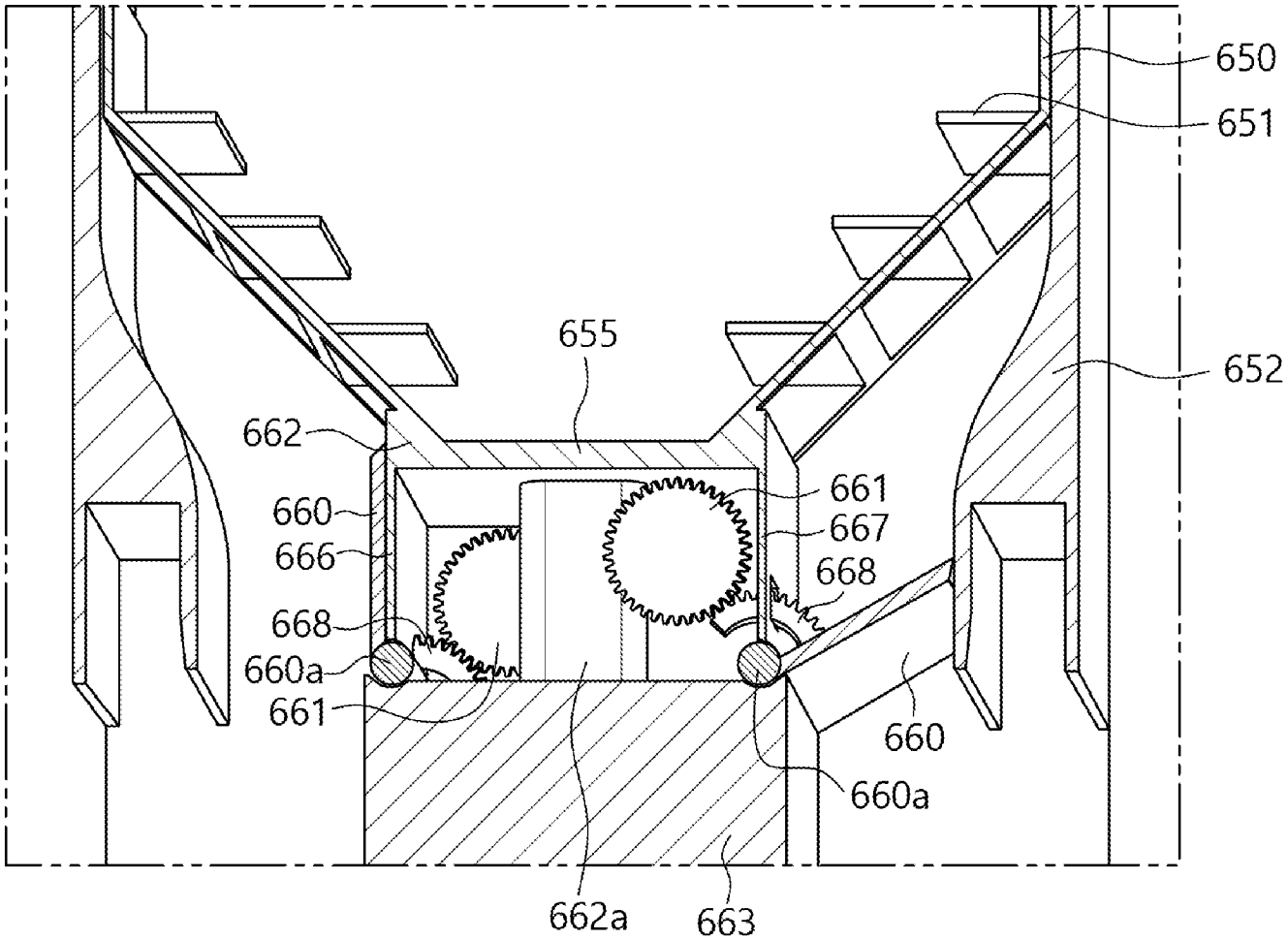
FIG. 21 is a view of the dampers that open and close left and right suction passages.
Figure 22:
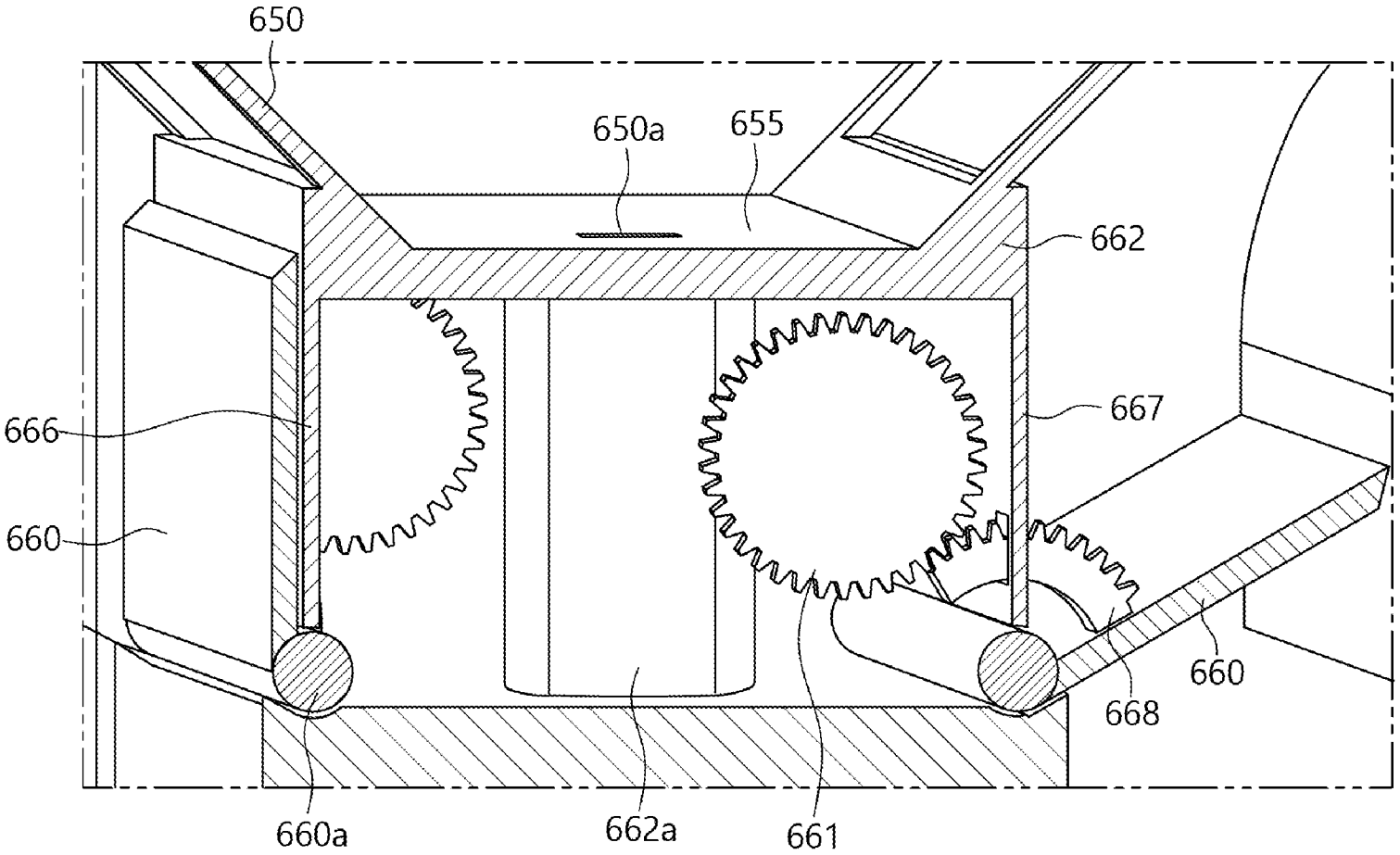
FIG. 22 is an enlarged view of the dampers and gears.

The damper assembly 662 may have outer walls 666 and 667 forming a rectangular housing to house motors and gears 661 that turn the dampers 660 (FIGS. 21 and 22). The first condensate guide 662*a* (FIGS. 21 and 22) may be positioned so as not to interfere with the gears 661 and motors.

Figure 17:
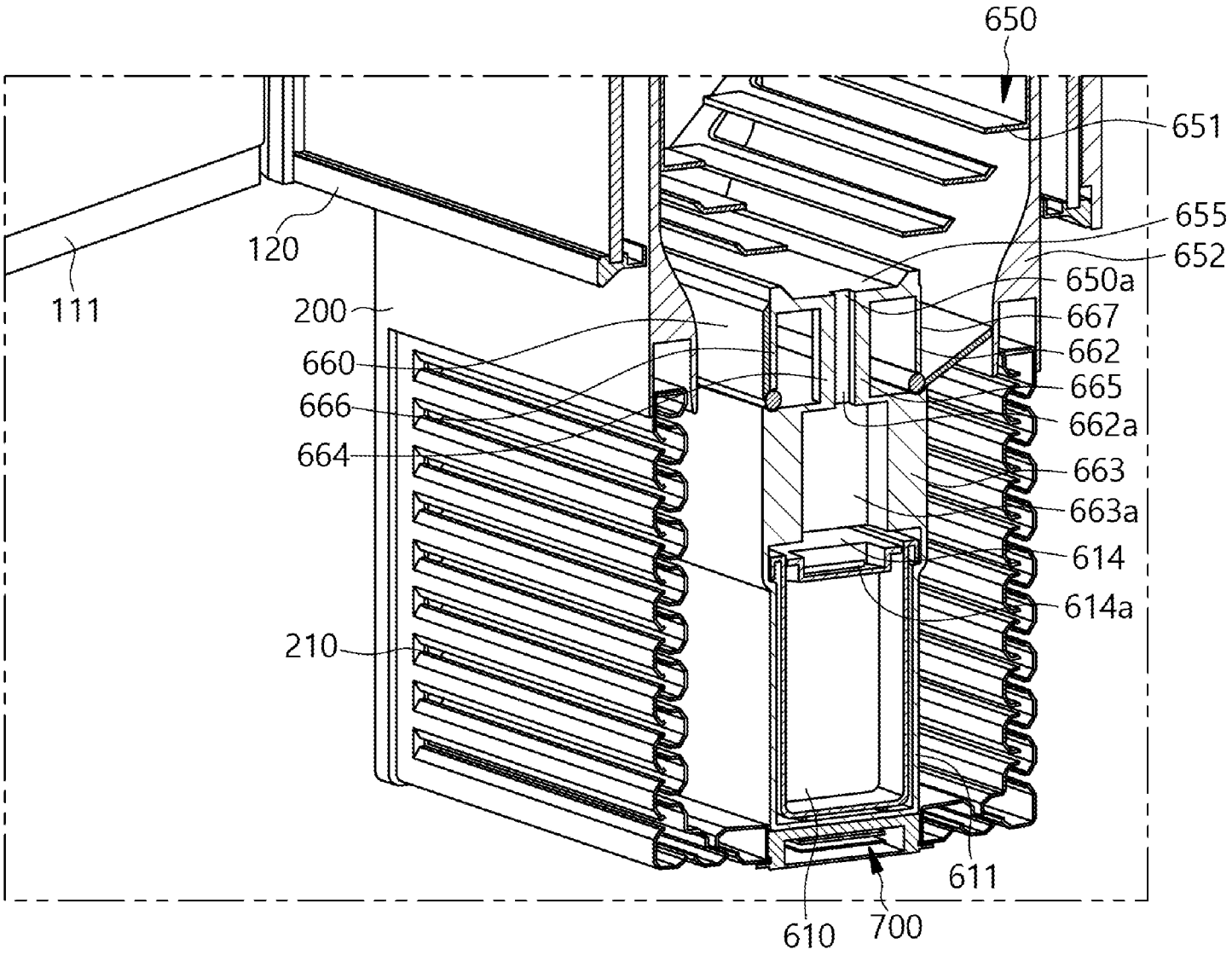
FIG. 17 is an enlarged cut perspective view of the steam cleaning assembly.
Figure 18:
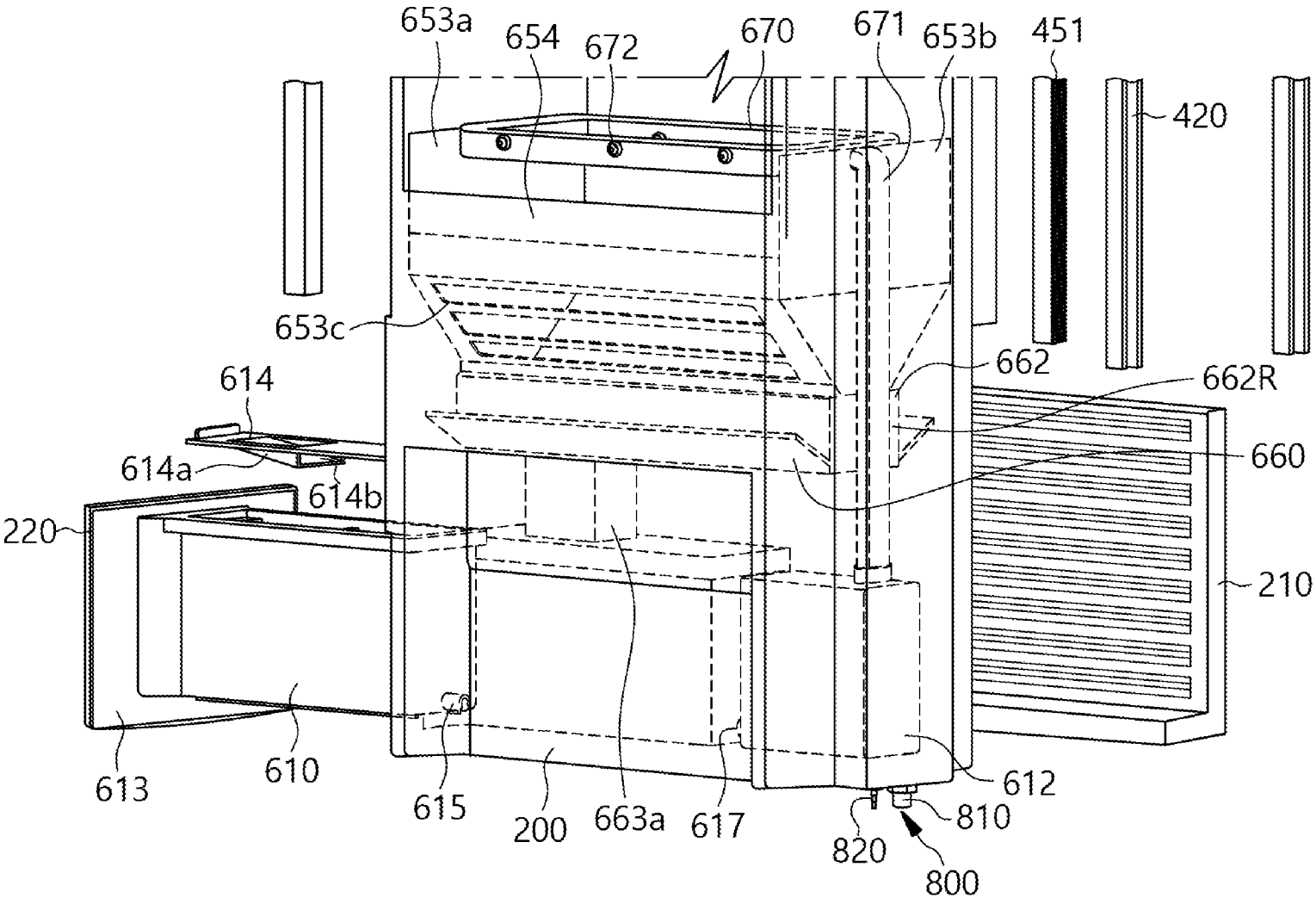
FIG. 18 is an enlarged perspective view of the steam cleaning assembly.
Figure 19:
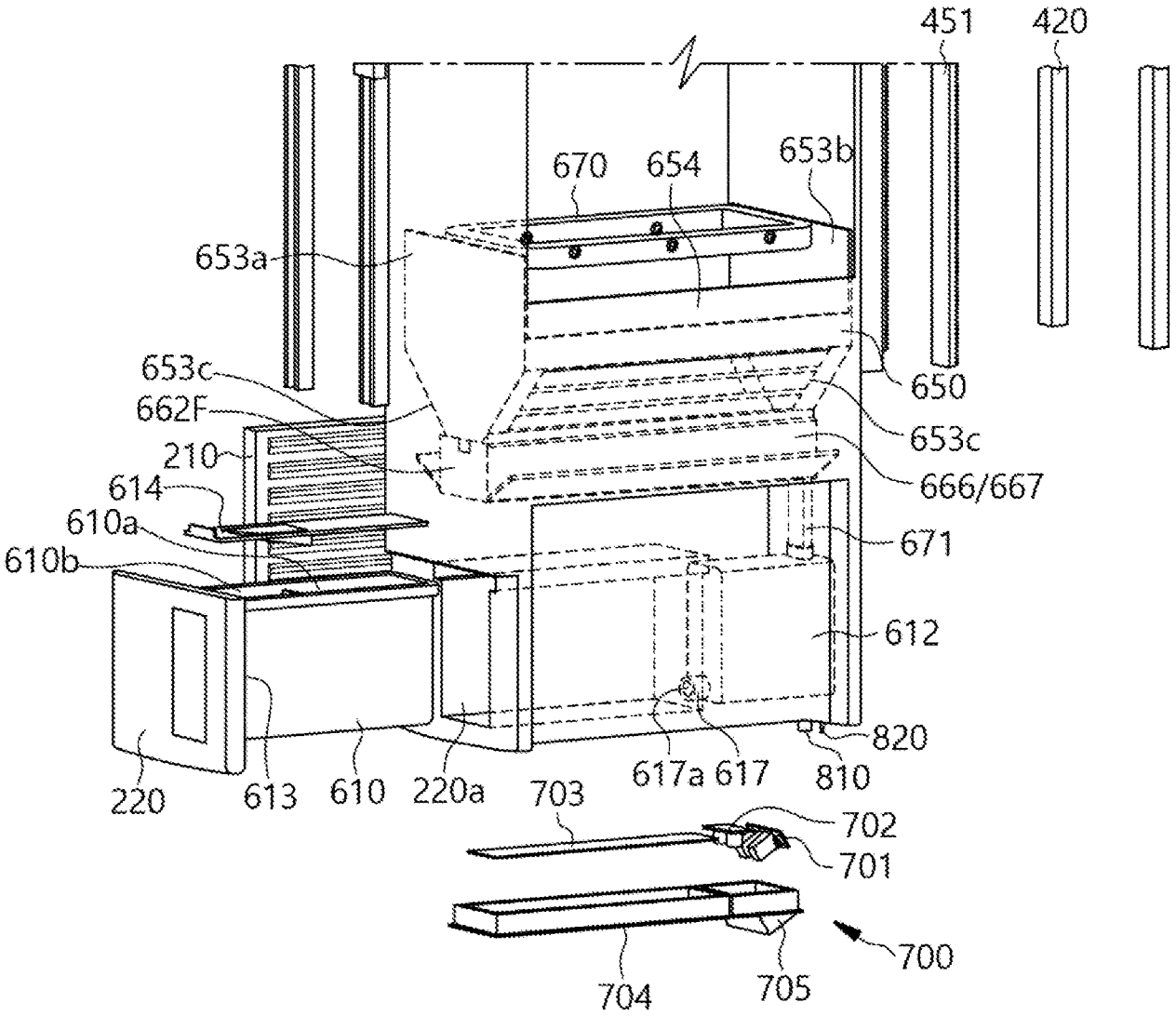
FIG. 19 is an enlarged perspective exploded view of the steam cleaning assembly and the height sensing assembly.
Figure 20:
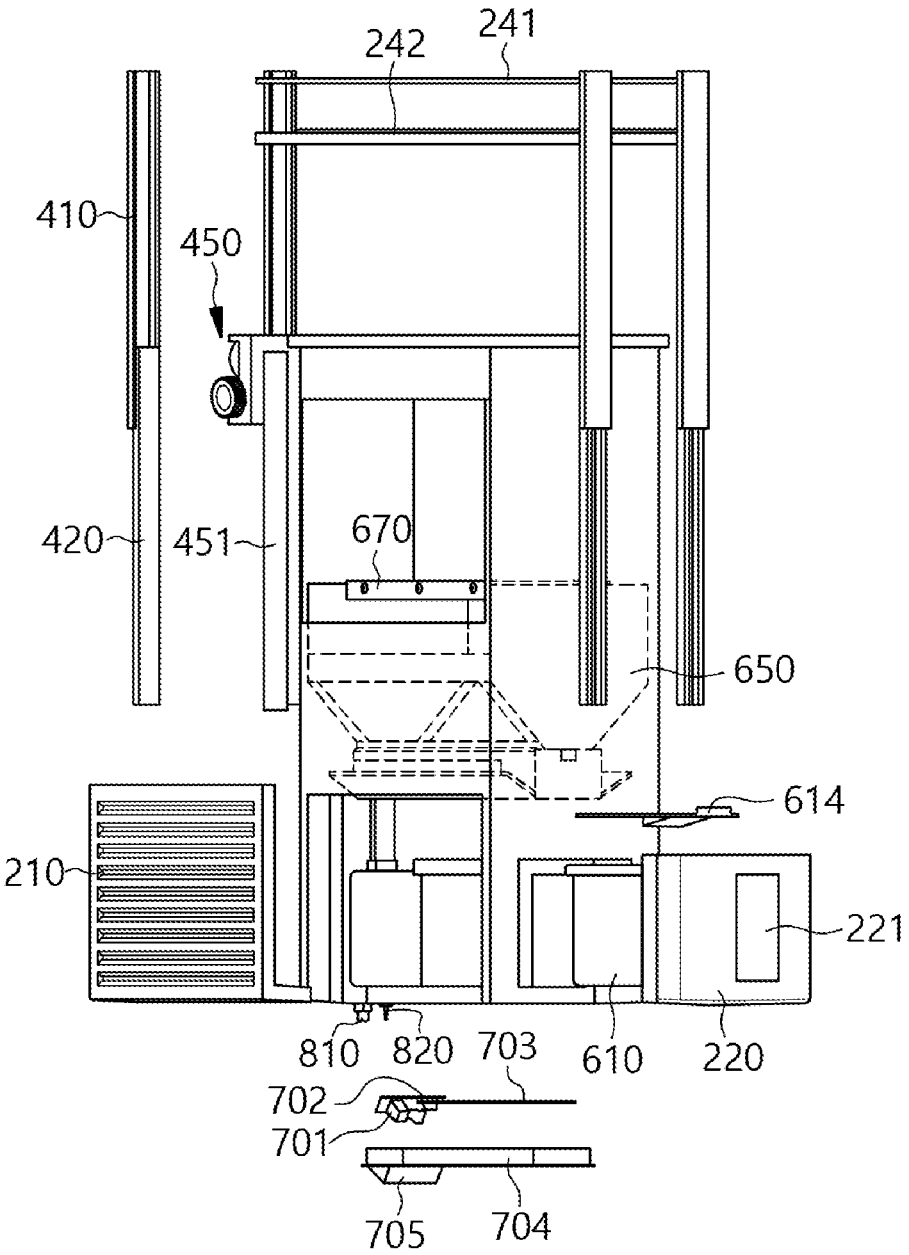
FIG. 20 is a perspective exploded view of the steam cleaning assembly and the height sensing assembly.

The damper assembly 662 may also include inner walls 664 and 665 that extend between the upper and lower surfaces of the damper assembly 662 at positions inside of the outer walls 666 and 667. The inner walls 664 and 665 may extend between a front of the bottom plate 655 of the condensate guide 650 and a bottom of the damper assembly 662, and the first condensate passage 662*a* may be provided between the inner walls 664 and 665. Alternatively, or in addition thereto, the inner walls 664 and 665 may be formed to partition an inside of the damper assembly 662 to protect the gears 661 and motors from falling condensate. Although FIG. 17 shows a cut view, FIGS. 18 and 19 show that the damper assembly has a front wall 662F and a rear wall 662R so that the outer walls 666 and 667 and the front and rear walls 662F and 662R form a rectangular housing. The front wall 662F may cover the inner walls 664 and 665 and the first condensate passage 662*a* (FIG. 21).

The first condensate passage 662*a* (FIG. 21) may be provided inside of the damper assembly 662 under the opening 650*a* in the bottom plate 655 of the condensate collector 650. The damper assembly 662 may have an optional top surface having an opening communicating with the opening 650*a* and the first condensate passage 662*a*. Falling condensate may be guided down through the damper assembly 662 and the liquid guide 663 via the first condensate passage 662*a*.

The outer walls 666 and 667 may define outer left and right surfaces of the damper assembly 662. The dampers 660 may be hinged to bottoms of the outer walls 666 and 667 so that upper ends of the dampers 660 contact the curved portion 652 of the inner surface of the second housing 200 when closed. Details of the gears 651 and dampers 660 will be described with reference to FIGS. 21-23B.

The liquid guide 663 may be a rectangular frame defining an upper opening provided under the damper assembly 662. The bottom of the damper assembly 662 may be coupled to the liquid guide 663 to close the upper opening, and the first condensate passage 662*a* may align with the second condensate passage 663*a* provided inside of the liquid guide 663. Left and right sides of the liquid guide 663 may include guide provided below a bottom end of the damper 660 to guide condensate falling down the dampers 660 into the second condensate passage 663*a*.

The first condensate passage 662*a* and the second condensate passage 663*a* may align with a guide 614*a* formed in the lid 614. The guide 614*a* may be formed as an inclined surface that is inclined downward from a top of the lid 614 downward so that an opening or gap 614*b* is formed between a bottom of the guide 614*a* and the top of the lid 614. Liquid or condensate may flow through the bottom opening down into the liquid storage container 610. Embodiments disclosed herein are not limited to the described configurations of the damper assembly 662, liquid guide 663, and condensate collector 650 so long as there is a downward passage connecting the condensate collector 650 to the liquid storage container 610 and the lid 614.

The lid 614 may cover a top opening of the liquid storage container 610. There may be a ledge or groove formed in an inner upper section of the liquid storage container 610, and the lid 614 may be configured to rest on the ledge so as to be secure. The liquid storage container 610 may be configured to slide onto and off of a bottom surface of the container guide 611 formed in the second housing 200. Left and right inner side surfaces of the container guide 611 and/or the bottom surface of the container guide 611 may include optional guide rails or guide grooves, and left and right outer side surfaces of the liquid storage container 610 and/or a bottom surface of the liquid storage container 610 may include optional guide grooves or guide rails to guide a sliding motion of the liquid storage container 610.

The front frame 613 of the liquid storage container 610 may be configured to cover opening 220*a* defined in the container guide 611 and provided at the front surface of the second housing 200 when the liquid storage container 610 is completely inserted into the second housing 200. The front frame 613 may be coupled to the cover 220, which may include a handle 221. A front surface of the front frame 613 may be recessed to accommodate a recess or cavity formed in the handle 221. The user may pull the handle 221 to remove the liquid storage container 610 from the container guide 611 and second housing 200.

The liquid storage container 610 may be pulled completely out of the opening 220*a* and the container guide 611 so that condensate collected in the second bin 610*b* of the liquid storage container 610 may be discarded and so that water or other liquid may be filled in the first bin 610*a* of the liquid storage container 610 from a sink or other water supply. When the liquid storage container 610 is slid out, the condensate collected in the second bin 610*b* of the liquid storage container 610 may be discarded. The seal 615 may be disconnected from the opening 617, and the seal 615 may be closed so that the liquid may be filled in the first bin 610*a* of the liquid storage container 610 or so that unused liquid may be discarded.

The optional fire emergency assembly 800 may extend downward from a rear of the bottom surface of the second housing 200. The fire emergency assembly 800 may include a fire detector 820 and a liquid or foam hose or nozzle 810. The fire detector 820 may be a smoke detector, a gas detector (e.g., a photoionization detector or PID), or heat detector. When an amount of smoke or heat sensed by the fire detector 820 reaches a predetermined level or more, water, foam, or other fire extinguisher agents (e.g., carbon dioxide, dry chemical agents, wet chemical agents, halogens or clean agents, or dry powder) may be spouted downward through the foam nozzle 810. The foam nozzle 810 may connect to an optional liquid basin or foam container provided at a rear inside of the second housing 200.

A sensor assembly 700 may be provided at a center of the bottom surface of the second housing 200. The bottom surface of the housing 200 may include a recess or slot into which the sensor assembly 700 may be inserted into and secured. The sensor assembly 700 may include a proximity sensor 701 and height sensor 702. The proximity sensor 701 may sense a distance of a user or other moving object from the kitchen hood 1. The height sensor 702 may be configured to sense a height of cookware sitting on top of the stove top. The proximity and height sensors 701 and 702 may be implemented as cameras, laser sensors, radar sensors, thermosensors or infrared sensors, ultrasonic sensors, etc.

The driving assembly 450 of the sliding assembly 400 and a speed of the fan 300 may be operated based on a sensing by the height sensor 702. Adjustments of the height of the second housing 200 via the driving assembly 450 and a suction strength via the speed of the fan 300 may be implemented in various ways by a controller, and will be described in more detail with reference to FIGS. 25-27.

Figure 27:
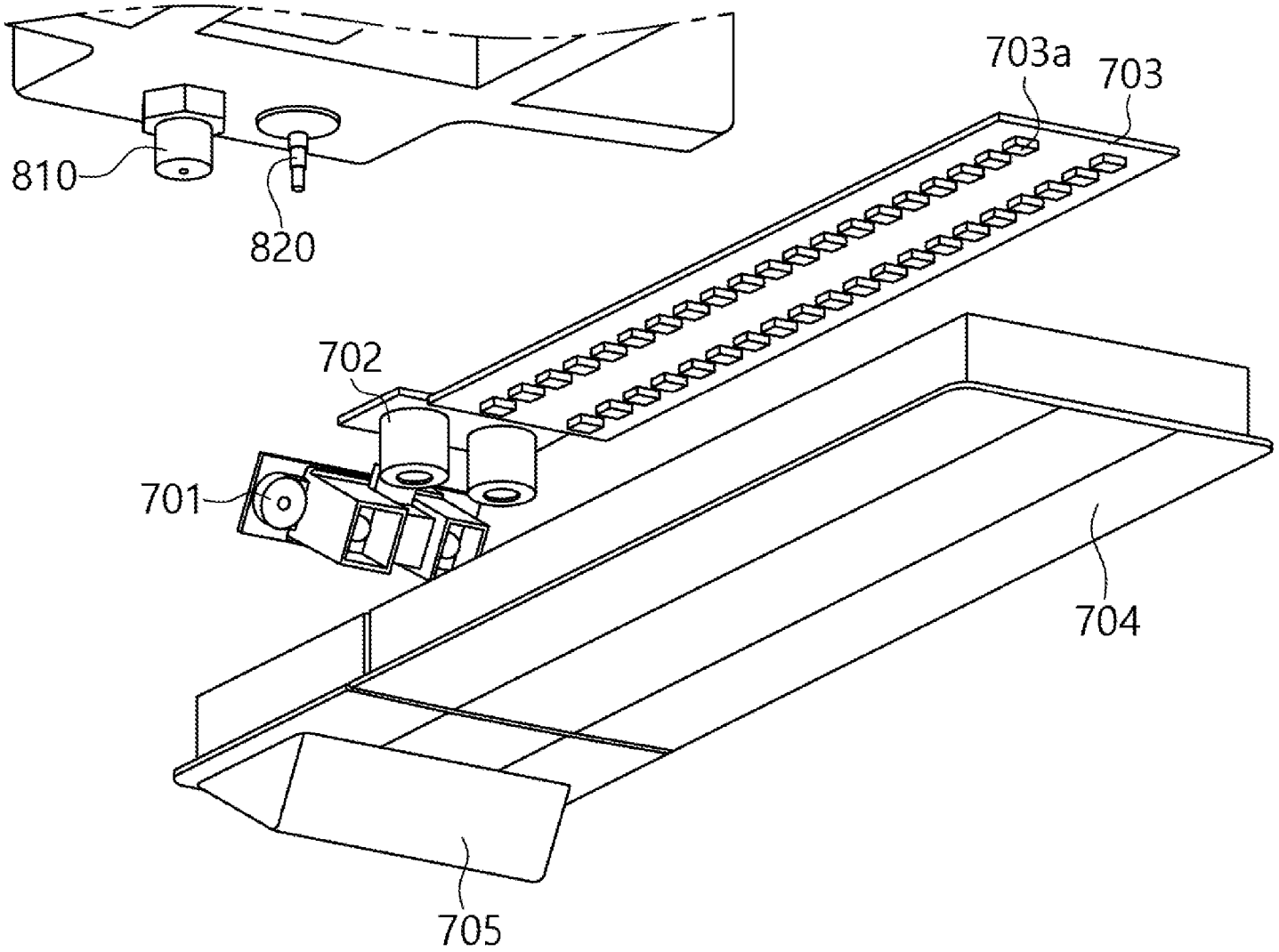
FIG. 27 is an exploded perspective view of the height sensing assembly.

The sensing assembly 700 may also include a light 703. The light 703 may be implemented as a printed circuit board (PCB) having a plurality of light emitting diodes 703*a* (FIG. 27). An operation of the light 703 may be based on detections by the proximity sensor 701. When a user approaches the kitchen hood 1, the proximity sensor 701 may detect that the user is within a predetermined distance range, and the light 703 may be automatically turned on to illuminate a stove top or surrounding area of the kitchen hood 1. Alternatively, or in addition thereto, the light 703 may also be operated based on the height sensor 702. When the height sensor 702 detects that cookware has been placed on the stove top, the light 703 may be automatically turned on. The light 703 may optionally include a sterilizing light on the printed circuit board including at least one ultraviolet (UV) light to sterilize a stove.

The sensor assembly 700 may include a case or cover 704. A bottom surface of the cover 704 may be transparent or translucent or serve as a light diffuser, and the light 703 may be provided on top of the bottom surface in an orientation so that light emitted by the light 703 is emitted through the bottom surface. Alternatively, the cover 704 may be provided with an opening, and the light 703 may be exposed through the opening. A transparent, translucent, or diffusing lens may be provided in the opening under the light 703 to protect the light 703.

A rear section of the cover 704 may include a sensor mount 705 in which the proximity and height sensors 701 and 702 are provided. The sensor mount 705 may be inclined, and the proximity sensor 701 may be oriented at an angle so as to sense a user approaching in a horizontal direction. The height sensor 702 may face down so as to detect cookware on a stove top below the kitchen hood 1. The sensor mount 705 may be transparent or translucent so that the height and proximity sensors 701 and 702 may transmit and receive signals. Alternatively, the height and proximity sensors 701 and 702 may be radar sensors, and the sensor mount 705 may be opaque. In yet another alternative, the sensor mount 705 may include openings through which ends of the height and proximity sensors 701 and 702 are exposed, and an optional transparent cover may be provided in the opening. The cover 704 may be coupled to the bottom of the second housing 200. More details of the sensing assembly 700 will be described with reference to FIGS. 25-27.

Referring to FIGS. 11 and 21-22, the steam cleaning assembly 600 may include dampers 660 provided at left and right sides to open, partially open, and close an air suction pathway from the suction grill 210 to the fan 300. During an air exhausting operation, at least one of the dampers 660 may be at least partially opened so that air may be suctioned upward toward the fan 300 and discharged out of the first housing top frame 140. During a steam cleaning operation, the dampers 660 may be initially closed to keep steam distributed from the steam generator 670 in upper sections of the first and second housings 100 and 200 to isolate the steam inside of the first and second housings 100 and 200. The dampers 660 may be later opened when the fan 300 is operated.

The dampers 660 may be rotatably coupled to the outer walls 666 and 667 of the damper assembly 662 via a hinge or hinge structure 660*a*. The hinge 660*a* may be a shaft coupled to or formed on an inner end of the damper 660, and may rotate within a bracket defined by front and rear lower ends of the outer walls 666 and 667. Alternatively, the hinge 660*a* may be a hollow hinge knuckle that rotates around a shaft or pin provided on the lower ends of the outer walls 666 and 667. However, a coupling of the dampers 660 to the damper assembly 662 may not be limited to a hinge structure.

Each damper may be coupled to a rack or gear 668, which may have a round arc shape (e.g., semicircle). The rack 668 may include teeth that engage with teeth provided on an outer circumference of the gear 661 provided inside of the damper assembly 662. The outer walls 666 and 667 may have an opening through which the rack 668 is inserted. The gear 661 may be coupled to a motor so as to be automatically rotated. The steam cleaning assembly 600 may have left and right gears 661 provided inside of left and right sections of the damper assembly 662, and each gear 661 may be coupled to its own motor so that the left and right gears 661 may be operated independently from each other. The damper assembly 662 may serve as a motor housing or include a separate motor housing (e.g., defined by inner walls 664 and 665 of FIG. 17) to protect the motors from steam and condensate.

A passage or guide may be formed inside of the liquid guide 663 at a position below the hinge 660*a* to collect condensate and other residue sliding down the dampers 660. For example, the liquid guide 663 may be formed to be slightly wider than (i.e., have a left-right length slightly longer than a left-right length of) the damper assembly 662. There may be at least one slit or opening formed in the damper 660 at a position adjacent to the hinge, and left and right side walls of the liquid guide 663 may be positioned further outward than a position of the slit in the damper 660. Inner surfaces of the left and right side walls of the liquid guide 663 may have inner protrusions, inclined surfaces, or tunnels that extend inward toward a center of the liquid guide 663, and condensate falling through the slit of the damper 660 may be guided down these guides. The guides may extend to and/or communicate with the second condensate passage 663*a* and/or the guide 614*a* of the lid 614. An upper surface of the damper 660 may be slightly inclined or curved toward the slit, which may also be referred to as a drain.

The kitchen hood 1 may be installed above a center of the stove top, and the sensor assembly 700 may detect a left-right position of cookware on the stove top. Alternatively, or in addition thereto, the AQ sensing assembly 500 may be formed at both left and right sides of the first housing 100. The AQ sensing assembly 500 may detect what side cookware is placed on the stove top by comparing contamination levels at left and right sides. Based on detections from the sensor assembly 700 and/or the AQ sensing assembly 500, a damper 660 closest to the cookware may be opened or at least partially opened, while a damper 660 furthest from the cookware may be closed or at least partially closed so as to increase a suction action closer to the cookware. An implementation of the dampers 600 may be binary (i.e., either completely opened or completely closed) or adjusted on a continuum of opening and closing degrees based on a position of the cookware. Examples of implementations using left and right dampers 660L and 660R will be described with reference to FIGS. 23A and 23B.

To open the damper 660, the gear 661 may be rotated in a first direction, and the rack 668 may be moved inward toward a center of the damper assembly 662 to rotate the damper 660 inward until the damper 660 is parallel to the outer walls 666 and 667. To close the damper 660, the gear 661 may be rotated in a second direction opposite to a first direction, and the rack 668 may be moved outward away from the center of the damper assembly 662 to rotate the damper 660 outward until an outer end of the damper 660 contacts the curved portion 652, which may prevent further rotation of the damper 660.

The first condensate passage 662*a* may be provided between the outer walls 666 and 667 of the damper assembly 662 and defined by the inner walls 664 and 665 or alternatively formed as a separate rectangular frame or pipe, but embodiments disclosed herein are not limited. Condensate may be dropped through the first condensate passage 662*a* so as not to interfere with the gears 661. The bottom plate 655 of the condensate collector 650 may be seated on a top rim the damper assembly 662. The first condensate passage 662*a* may be formed with the damper assembly 662. Alternatively, the first condensate passage 662*a* may be a tube formed with the bottom plate 655 and inserted into the upper opening of the damper assembly 662 to align with the second condensate passage 663*a*.

Figure 23A:
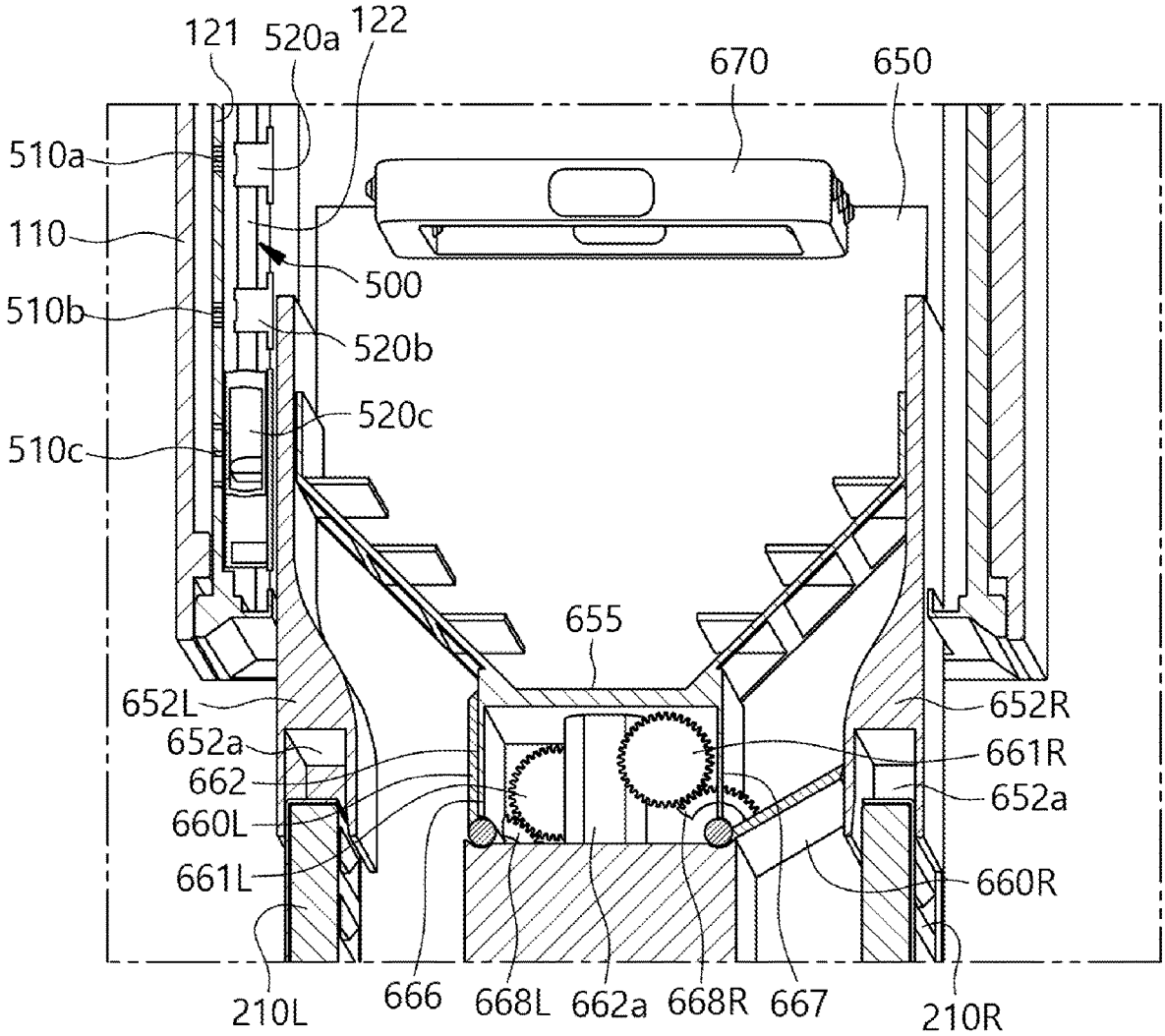
FIG. 23A shows a left damper opened and a right damper closed.
Figure 23B:
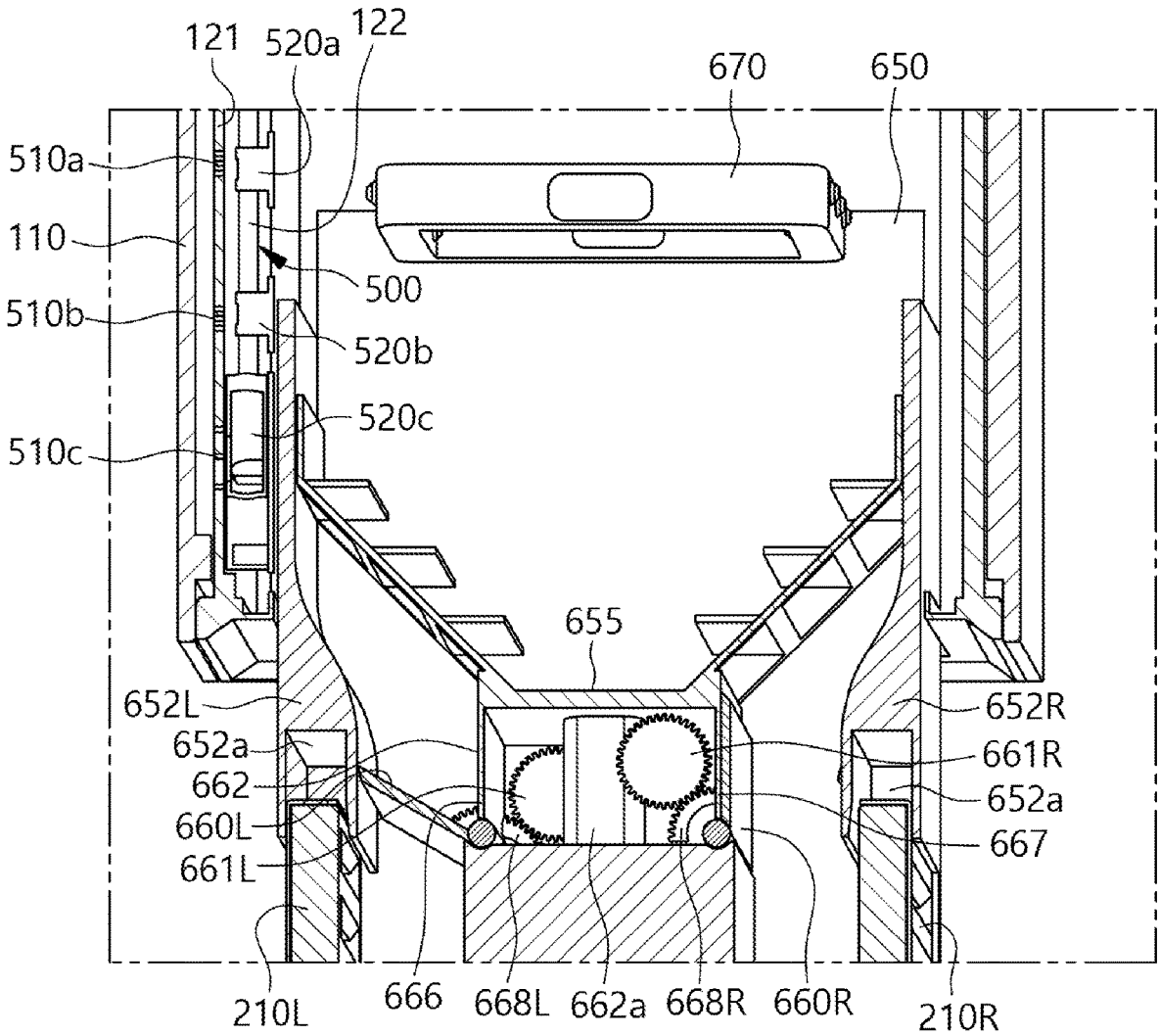
FIG. 23B shows a right damper opened and a left damper closed.
Figure 24:
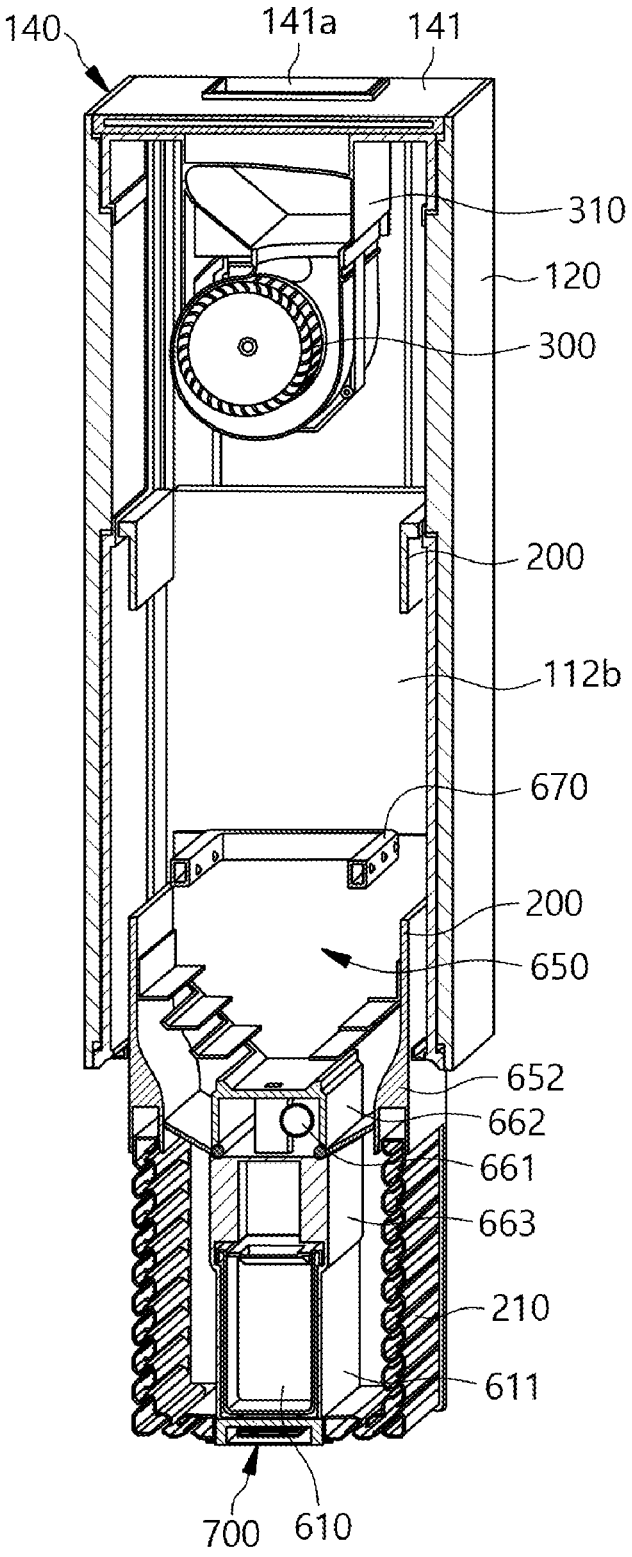
FIG. 24 is a cut front view of the first housing and the second housing in a lengthened state.

Referring to FIGS. 23A and 23B, the gear 661 provided at the left may be referred to as a left gear 661L, the gear 661 provided at the right may be referred to as a right gear 661R, the damper 660 provided at the left may be referred to as a left damper 660L, and the damper 660 provided at the right may be referred to as a right damper 660R. The rack 668 coupled to the left damper 660L may be referred to as a left rack 668L, and the rack 668 coupled to the right damper 660R may be referred to as a right rack 668R.

The outer wall 666 defining a left outer surface of the damper assembly 662 may be referred to as the left outer wall 666, while the outer wall 667 defining a right outer surface of the damper assembly 662 may be referred to as the right outer wall 667. The curved portion 652 formed on the left inner surface of the second housing 200 may be referred to as the left curved portion 652L, and the curved portion 652 formed on the right inner surface of the second housing 200 may be referred to as the right curved portion 652R.

The left and right gears 661L and 661R may be staggered in a front-rear direction so as not to interfere with each other during rotation. The left rack 668L may be inserted through a rear side of the left outer wall 666. The right rack 668R may be inserted through a front side of the right outer wall 667. The left and right gears 661L and 661R may be controlled based on detections by the sensor assembly 700 and/or the AQ sensing assembly 500.

The left gear 661L may be rotated by a left shaft coupled to a left motor provided at a rear of the damper assembly 662. Alternatively, the left shaft and the left motor may be provided on a front of the damper assembly 662 or coupled to an outside of the first condensate passage 662*a*. The left gear 661L may be provided on an inner side of the left outer wall 666. The left outer wall 666 may have an opening provided at the rear side through which the left rack 668L is inserted. The left rack 668L may engage with the left gear 661L to rotate the left damper 660L.

The left gear 661L may be rotated clockwise to open the left damper 660L and turn the left damper 660L toward the left outer wall 666. When the left damper 660L is in a completely opened position, the left damper 660L may be parallel to the left outer wall 666 such that an inner surface of the left damper 660L faces an outer surface of the left outer wall 666. An angle of the left damper 660L relative to the hinge 660*a* (FIG. 21) may be configured such that, when the left damper 660L is completely opened, the left damper 660L may contact the outer surface of the left outer wall 666, and a left suction passage may be formed between the left inner surfaces of the first and second housings 100 and 200 and between the steam cleaning assembly 600 provided at a center.

The left gear 661L may be rotated counterclockwise to completely close the left damper 660L and turn the left damper 660L toward the left curved portion 652L. A bottom section of the left curved portion 652L may have a longer left-right length than that of an upper section. A left-right length of the left damper 660L may be configured such that, when the left damper 660L is completely closed, the outer end of the left damper 660L may contact the bottom section of the left curved portion 652L to close the left suction passage. A front-rear length of the left damper 660L may be configured so as to extend between the front and rear inner surfaces of the second housing 200 to further close the left suction passage.

The right gear 661R may be rotated by a right shaft coupled to a right motor provided at a rear of the damper assembly 662. The right shaft may be longer than the left shaft. Alternatively, the right shaft and the right motor may be provided on a front of the damper assembly 662 or coupled to an outside of the first condensate passage 662*a*. The right gear 661R may be provided on an inner side of the right outer wall 667. The right outer wall 667 may have an opening provided at the front side through which the right rack 668R is inserted. The right rack 668R may engage with the right gear 661R to rotate the right damper 660R.

The right gear 661R may be rotated counterclockwise to open the right damper 660R and turn the right damper 660R toward the right outer wall 667. When the right damper 660R is in a completely opened position, the right damper 660R may be parallel to the right outer wall 667 such that an inner surface of the right damper 660R faces an outer surface of the right outer wall 667. An angle of the right damper 660R relative to the hinge 660*a* (FIG. 21) may be configured such that, when the right damper 660R is completely opened, the right damper 660R may contact the outer surface of the right outer wall 667, and a right suction passage may be formed between the right inner surfaces of the first and second housings 100 and 200 and between the steam cleaning assembly 600 provided at a center.

The right gear 661R may be rotated clockwise to close the right damper 660R and turn the right damper 660R toward the right curved portion 652L. A bottom section of the right curved portion 652L may have a longer left-right length than that of an upper section. A left-right length of the right damper 660R may be configured such that, when the right damper 660R is completely closed, the outer end of the right damper 660R may contact the bottom section of the right curved portion 652L to close the right suction passage. A front-rear length of the right damper 660R may be configured so as to extend between the front and rear inner surfaces of the second housing 200 to further close the right suction passage.

The suction grill 210 provided on the left side of the second housing 200 may be referred to as a left suction grill 210L and the suction grill 210 provided on the right side of the second housing 200 may be referred to as a right suction grill 210R. There may be a recess or inner space 652*a* formed between outer and inner sides of each of the left and right curved portions 652L and 652R. The recess 652*a* may communicate with the opening 210*a* formed in the left and right surfaces of the second housing 200. A top of the left suction grill 210L may be inserted into the recess 652*a* of the left curved portion 652L to be between the inner and outer sides of the left curved portion 652L. A top of the right suction grill 210R may be inserted into the recess 652*a* of the right curved portion 652R to be between the inner and outer sides of the right curved portion 652R.

A top of the left suction grill 210L may be secured in the recess 652*a* of the left curved portion 652L via optional magnetic coupling. For example, the left curved portion 652L may be formed of a ferromagnetic material, and the top of the left suction grill 210L may include at least one magnet configured to magnetically attract to the left curved portion 652L. Similarly, a top of the right suction grill 210R may be secured in the recess 652*a* of the right curved portion 652R via optional magnetic coupling. For example, the right curved portion 652R may be formed of a ferromagnetic material, and the top of the right suction grill 210R may include at least one magnet configured to magnetically attract to the right curved portion 652R.

The sensor assembly 700 may sense a left-right position of cookware on the stove top. When the cookware is at a first predetermined position, the left damper 660L may be completely opened and the right damper 660R may be completely closed. When the cookware is at a second predetermined position, the right damper 660R may be completely opened and the left damper 660L may be completely closed. When the cookware is at a third predetermined position between the first and second predetermined positions, both left and right dampers 660L and 660R may be completely opened or partially opened.

Opening degrees of the right and left dampers 660R and 660L may be adjusted on a continuum based on a specific position of the cookware between the first and second positions. The closer the cookware is toward the right damper 660R, the more the right damper 660R may be opened. The closer the cookware is toward the left damper 660L, the more the left damper 660L may be opened. The further the cookware is from the right damper 660R while still between the first and second positions, the more the right damper 660R may be closed. The further the cookware is from the left damper 660L while still between the first and second positions, the more the left damper 660L may be closed. When the cookware is at a center underneath the kitchen hood 1, the right and left dampers 660R and 660L may each be halfway opened, or alternatively, may be completely opened.

Referring to FIGS. 24-27, the sensor assembly 700 and steam cleaning assembly 600 may be coupled to the second housing 200 such that the sensor assembly 700 and steam cleaning assembly 600 are raised and lowered with a raising and lowering of the second housing 200. The fan 300 and fan housing 310 may be secured to the first housing top frame 140 (i.e., the second top frame 142) so as to remain in a fixed position with the first housing 100. When the second housing 200 is lowered, lengths of the left and right suction paths may be increased, as a distance from the suction grill 210 to the opening 141*a* formed in the first top frame 141 may be increased.

The AQ sensing assembly 500 may be provided on a lower section of the left side of the inner housing 120 behind the door 111. The left side of the inner case 120 may have an internal space formed between outer and inner walls 121 and 122 of the inner case 120. The sensing assembly 500 may be housed within the internal space of the inner case 120. Alternatively, the AQ sensing assembly 500 may be provided on a lower section of the right side of the inner housing 120, and the right side of the inner case 120 may have an internal space formed between outer and inner walls 121 and 122 of the inner case 120 in which the AQ sensing assembly 500 is provided. A second AQ sensing assembly 500 may be optionally provided so that air quality may be sensed at both left and right sides of the kitchen hood 1.

A first molecule passage path 510*a* having a plurality of openings may be formed in the outer wall 121. The first molecule passage path 510*a* may be formed as a plurality of holes that penetrate the outer wall 121. Alternatively, the first molecule passage path 510*a* may be formed as a separate disc having a plurality of holes, and the disc may be inserted into a corresponding opening or recess formed in the outer wall 121.

A first sensor 520*a* may protrude from the inner wall 122 to align with the first molecule passage path 510*a*. The sensing assembly 500 may include a plurality of sensors and corresponding molecule passage paths. As exemplified in FIGS. 23A, 23B, and 25, there may be first, second, and third sensors 520*a*, 520*b*, and 520*c* that align with first, second, and third molecule passage paths 510*a*, 510*b*, and 510*c*, but embodiments disclosed herein are not limited to three sensors.

The first, second, and third sensors 520*a*, 520*b*, and 520*c* may be arranged in a vertical direction and provided at positions that align with rears of the first, second, and third molecule passage paths 510*a*, 510*b*, and 510*c*, respectively. Air containing dust, oil, gases, and other foreign matter may be detected by the first, second, and third sensors 520*a*, 520*b*, and 520*c* via the first, second, and third molecule passage paths 510*a*, 510*b*, and 510*c*, respectively. The first, second, and third sensors 520*a*, 520*b*, and 520*c* may be photoionization detectors (PID), particle sensors, or other sensors configured to detect gas or harmful substances.

The first, second, and third sensors 520*a*, 520*b*, and 520*c* may be provided on a printed circuit board (PCB) 530 provided on the inner wall 122. The PCB 530 may be wired to a controller and/or include a communication module to communicate with the controller so that data corresponding to detections sensed by the first, second, and/or third sensors 520*a*, 520*b*, and/or 520*c* may be transmitted to the controller. The communication module may include an optional Bluetooth or Wi-Fi module to transmit data to a remote device or mobile or web application, such as on a smartphone. As another alternative, the stovetop, an external air purifier, or other smart appliance may be configured to receive information from the AQ sensor assembly 500 and/or transmit air quality data or other data to the communication module of AQ sensor assembly 500. As an example, the first sensor 520*a* may be configured to sense an amount or density (e.g., parts-per-million or PPM) of a gas such as carbon dioxide ($CO_2$). A high amount or density of $CO_2$ may indicate a high level of smoke or other carcinogens. However, embodiments disclosed herein are not limited to $CO_2$. Alternatively, or in addition thereto, the first sensor 520*a* may be configured to sense an amount or density of carbon monoxide (CO), nitrogen dioxide ($NiO_2$), formaldehyde ($CH_2O$ or HCHO), volatile organic compounds (VOCs), black carbon (BC) or soot, and/or polycyclic aromatic hydrocarbons (PAHs).

The second sensor 520*b* may be configured to sense an amount or density of oil, oil mist, dust, or other dirt or grime. The third sensor 520*c* may be configured to sense an amount or density of odors or smells. The outer case 110 and/or the door 111 may have optional slits or openings so as not to obstruct the first, second, and third molecule passage paths 510*a*, 50*b*, and 510*c*. Alternatively, there may be a gap between the door 111 and the inner case 120 so that fumes and gases may enter the first, second, and third molecule passage paths 510*a*, 510*b*, and 510*c*.

An operation of the fan 300 may be automatically controlled based on detections by the first, second, and third sensors 520*a*, 520*b*, and 520*c*. The controller may have a memory to store first, second, and third predetermined amounts or densities. When an amount or density sensed by at least one of the first, second, or third sensors 520*a*, 520*b*, and 520*c* is greater than or equal to the first, second, or third predetermined amounts or densities, respectively, the fan 300 may be turned on or a speed of the fan 300 may be increased by a predetermined fan speed amount.

Alternatively, or in addition thereto, a speed of the fan 300 may be controlled to be proportional to the amounts or densities sensed by the first, second, and third sensors 520*a*, 520*b*, and 520*c*. As another alternative, the amounts or densities of the first, second, and third sensors 520*a*, 520*b*, and 520*c* may be added to calculate a total contamination level, and a speed of the fan 300 may be controlled to be proportional to the calculated total contamination level or based on a comparison of the calculated total contamination level with stored predetermined contamination levels in the memory. When the speed of the fan 300 is increased to respond to detections by the first, second, and third sensors 520*a*, 520*b*, and 520*c*, the fan 300 may be considered as performing an air cleaning operation.

The second housing 200 may also be raised or lowered to optimize air flow based on detections by the first, second, and third sensors 520*a*, 520*b*, and 520*c*. For example, after cooking is complete and no cookware is present, the second housing 200 may be lowered and the fan 300 may be operated at a predetermined speed, e.g., maximum speed, to reduce residual pollution. Or, if other undesired particles are detected in the kitchen (e.g., during microwave cooking or toasting), the second housing 200 may be lowered by a predetermined amount (e.g., a maximum amount) and the fan 300 may be operated at a predetermined speed (e.g., a maximum speed) so as to exhaust contaminants, including contaminants that emanate from appliances in the kitchen, and/or to improve air quality in the house.

A steam cleaning operation may also be started or operated based on detections by the first, second, and third sensors 520*a*, 520*b*, and 520*c* and/or based on a current operation of the fan 300. For example, after the fan 300 has been turned off after an air cleaning operation or after certain contamination levels have been reduced so as to indicate an end to cooking, the controller may determine that steam cleaning may be beneficial to remove any residual gas, dust, oil, odors, etc. remaining inside of the kitchen hood 1. The display 130 may alert the user to fill the liquid storage container 610, or alternatively, if the liquid storage container 610 has been pre-filled, the steam cleaning operation may be automatically performed. A more detailed description of the steam cleaning operation will be described later with reference to FIGS. 26-27.

Figure 25A:
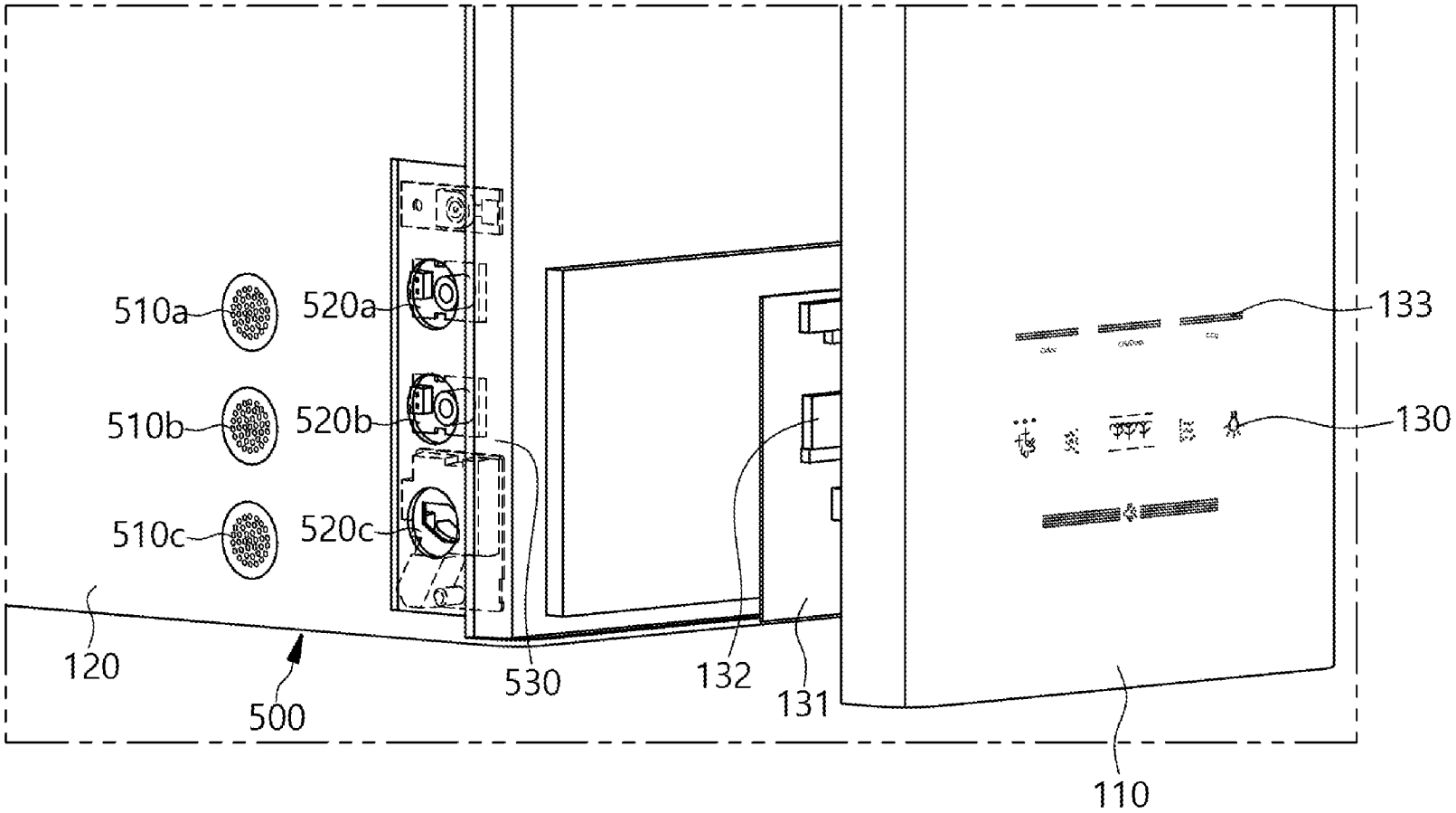
FIG. 25A is a perspective view of the display and the air quality sensor assembly.

Referring to FIG. 25A, the display 130 may be provided at a lower section of the front panel of the outer case 110. Alternatively, or in addition thereto, there may be a second and/or third display provided on the door 111 and/or a side of the outer case 110 opposite to the door 111. The outer case 110 may include a plurality of openings or through holes 133 defined, by example, by surface or laser processing, printing, or etching. The through holes 133 may be formed in various arrangements to denote numbers, letters, or images. A printed circuit board 131 may be provided behind the front panel of the outer case 110 to align with the through holes 133. The printed circuit board 131 may include a plurality of light emitting diodes (LEDs) 132 to illuminate the through holes 133.

The through holes 133 may be divided into sections that define separate notifications. A number of LEDs 132 may be equal to a number of notifications defined by the through holes 133, and the LEDs 132 may be positioned so as to be aligned with the notifications defined by the through holes 133. The controller may determine which LED 132 to turn on based on which notification should be illuminated to the user, and light emitted from the LED 132 may be transmitted through the through holes 133 defining the corresponding notification.

The notifications defined by the through holes 133 may convey information to the user such as when the fan 300 is turned on, when the fan 300 is operating during an air cleaning operation, when sensed amounts or densities of the AQ sensing assembly 500 are above or below predetermined amounts or densities, when the steam cleaning assembly 600 is operating, when the liquid storage container 610 has been filled with liquid, when the light 703 is turned on, or other operations or detections made by the AQ sensing assembly 500, sensor assembly 700, fire emergency assembly 800, or any other optional sensors. In addition, the LEDs 132 may be configured to emit light of various visible wavelengths to convey a completion of a process (e.g., a steam cleaning operation or an air purifying operation) or to convey a wide range of values sensed by the AQ sensing assembly 500.

For example, the plurality of through holes 133 may define a first notification, a second notification, and a third notification. An LED 132 provided behind the first notification may be configured to emit red light when a carbon dioxide amount or density sensed by the first sensor 520*a* is greater than or equal to a first predetermined amount, yellow or orange light when a sensed carbon dioxide amount is less than the first predetermined amount but greater than a second predetermined amount, and blue or white light when a sensed carbon dioxide amount is less than or equal to the second predetermined amount. As another example, a wavelength of light emitted by the LED 132 may be increased between violet or blue light (e.g., 400 nm) and red light (e.g., 700 nm) based on a sensed increase in carbon dioxide by the first sensor 520*a* between the second predetermined amount and the first predetermined amount. Alternatively, or in addition thereto, the display 130 may include a speaker to sound an alarm when a sensed amount of carbon dioxide sensed by the first sensor 520*a* is greater than or equal to the first predetermined amount. An implementation of the LED 132 behind the second notification may be similarly based off of detections by the second sensor 520*b*, and an implementation of the LED 132 behind the third notification may be similarly based off of detections by the third sensor 520*c*.

The display 130 may include a touch sensor assembly so that the user may input commands, such as to turn the light 703 on and off, to turn on or off the steam generator 612 to control steam cleaning, and to turn on and off and/or adjust a speed of the fan 300 to control air purifying and/or to lower or raise the second housing 200. The touch sensor assembly may use capacitive touch sensing technology so that a user touches the notifications formed by the through holes 133 to input commands. Such a touch sensing assembly may be provided on the PCB 131 near the light emitting diodes 132. The PCB 131 may also include a communication module (e.g., Wi-Fi or Bluetooth module) so that a user may wirelessly input commands via a mobile or web application or a remote device. Alternatively, a microphone may be used to control the various operations by voice command.

Figure 25B:
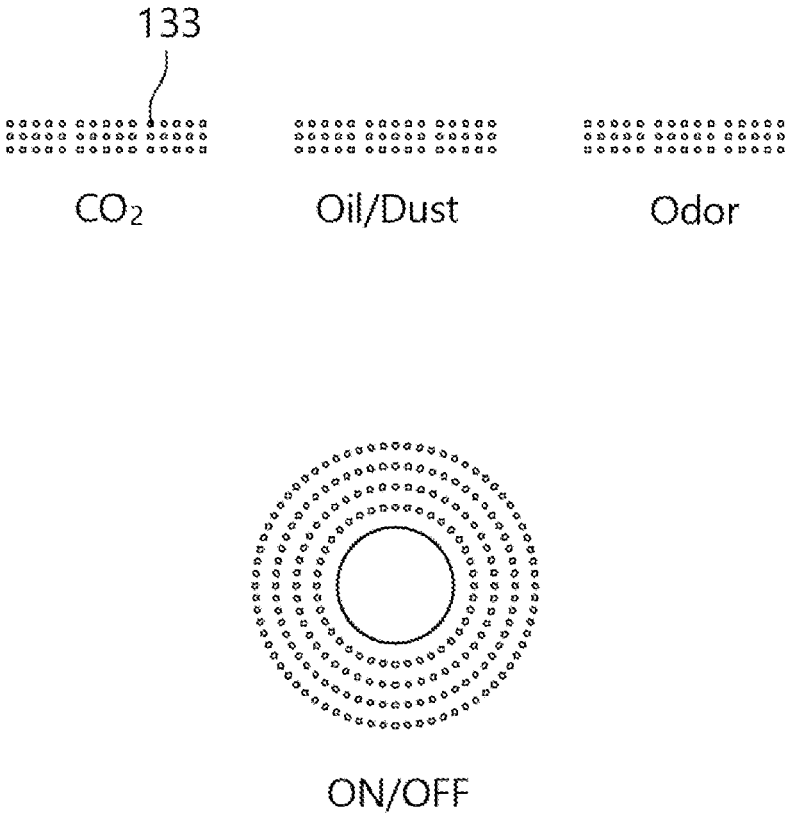
FIGS. 25B through 25F show implementations of the display.
Figure 25C:
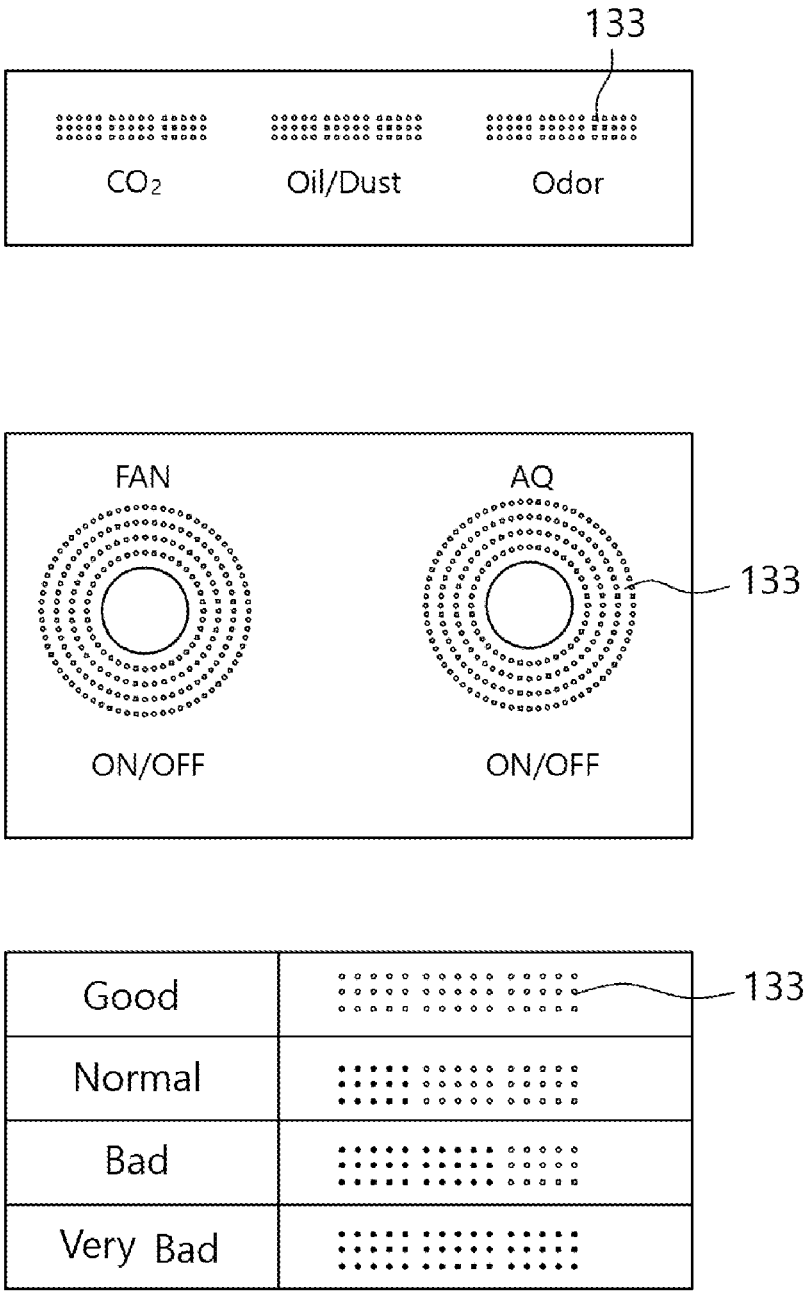
Figure 25D:
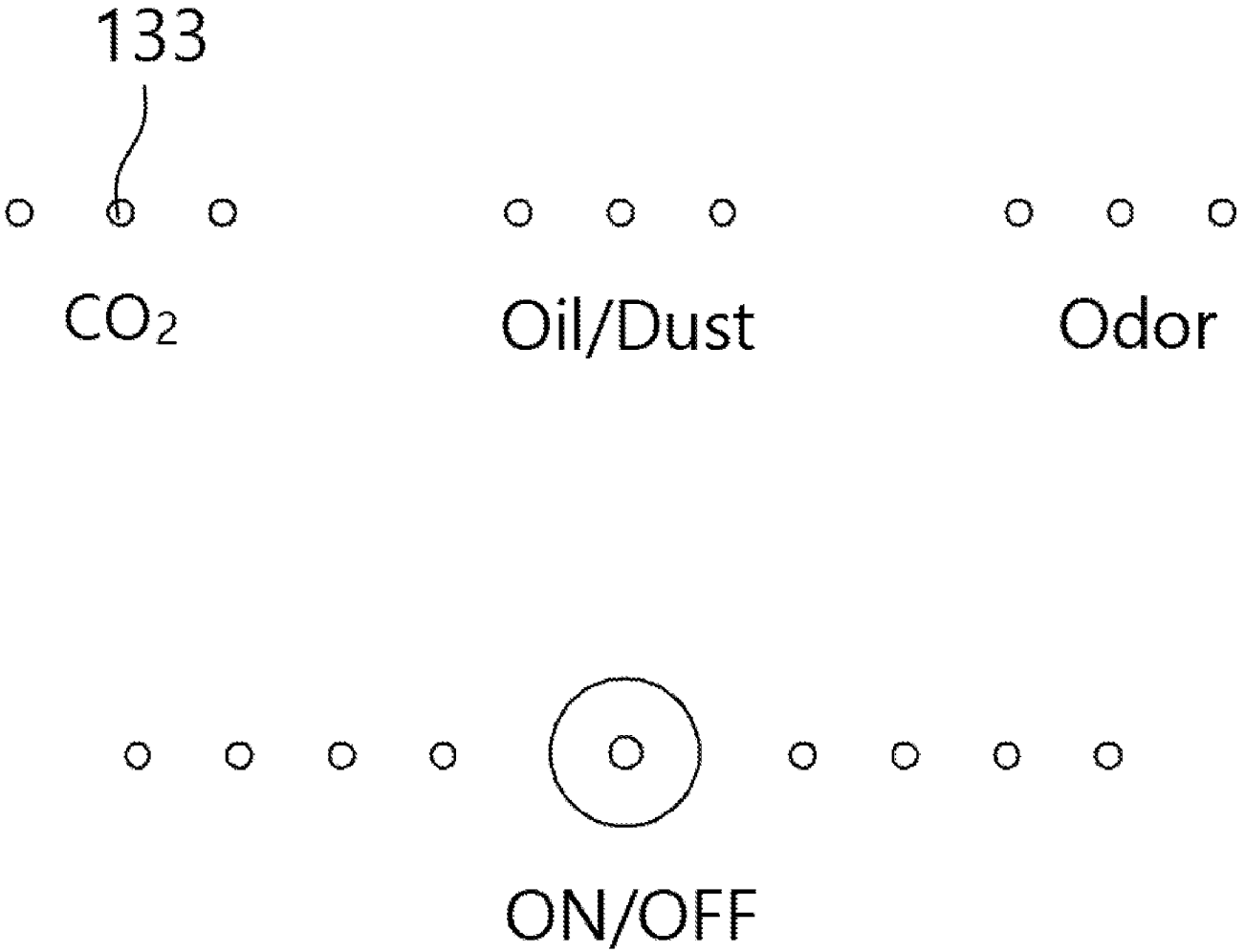
Figure 25E:
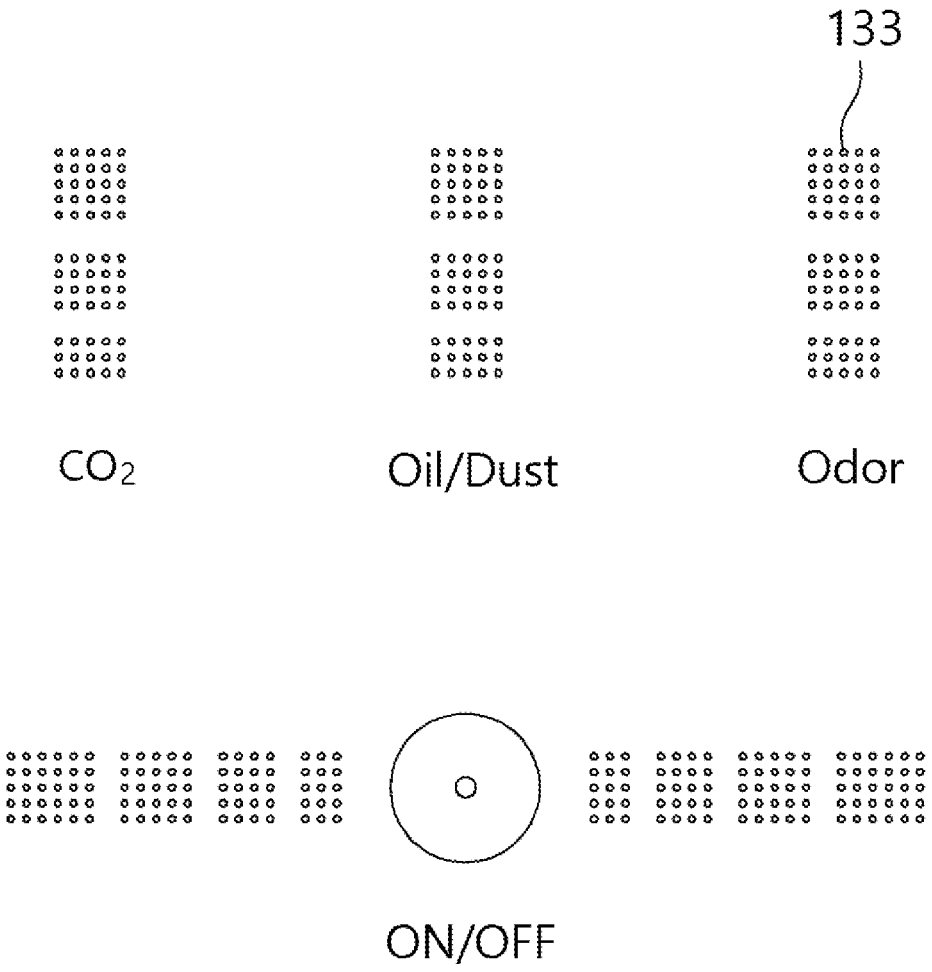
Figure 25F:
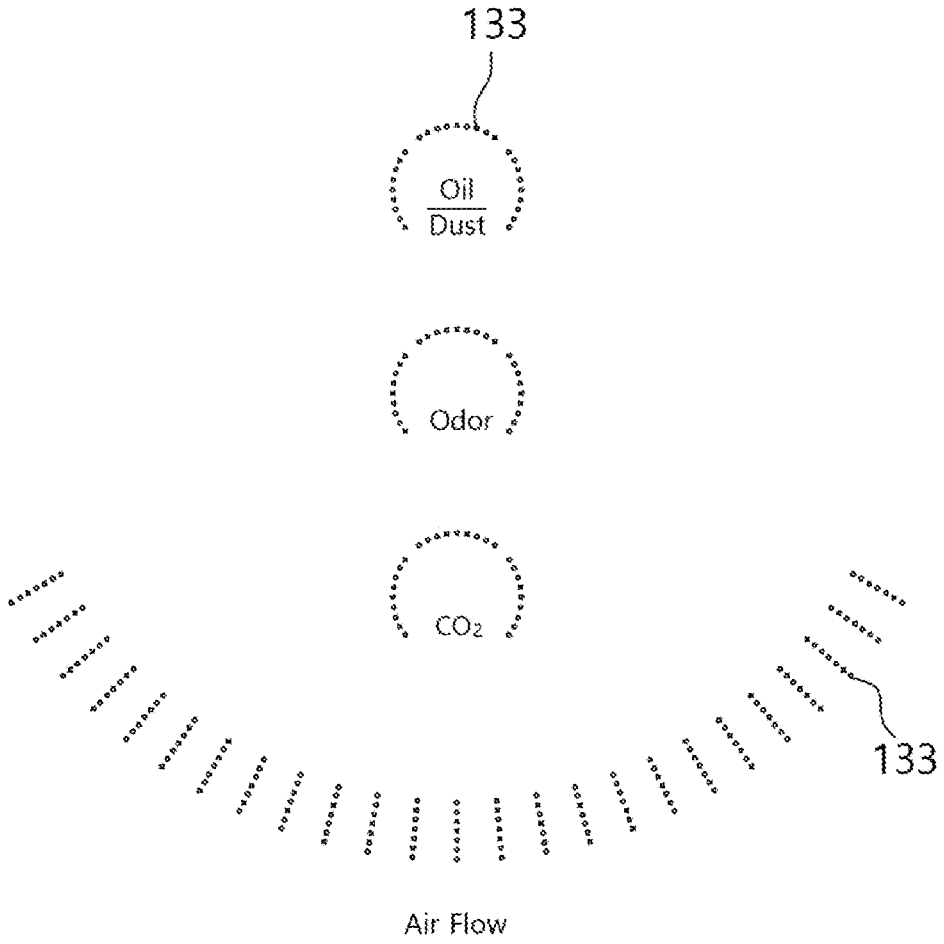

Referring to FIGS. 25B-25F, the display 130 may have a variety of implementations. For example, instead of or in addition to using different colored light to indicate levels of $CO_2$, oil/dust, and/or odors, the notifications may be provided with a plurality of through-holes 133 arranged in rows and columns, and a number of lights turned on may indicate respective levels. As shown in FIGS. 25B and 25C, the through-holes 133 may be arranged to form rectangles that are long in the left-right direction (e.g., 3 rows by 5-15 columns), and a number of columns illuminated (or a number of blocks defined by 3 rows by 5 columns) may correlate to a level of $CO_2$, oil/dust, and/or odors sensed by the first, second, and third sensors 520*a*, 520*b*, and 520*c*. As shown in FIG. 25, the through-holes 133 may be arranged to form rectangles that are long in the up-down direction (e.g., 5 columns by 5-12 rows), and a number of rows illuminated (or a number of blocks defined by 3 or more sets of rows by 5 columns) may correlate to a level of $CO_2$, oil/dust, and/or odors sensed by the first, second, and third sensors 520*a*, 520*b*, and 520*c*. As shown in FIGS. 25D and 25F, the through-holes 133 may be arranged in a straight horizontal line (FIG. 25D) or in a circular, semi-circular, or arc pattern (FIG. 25F), and a number of through-holes 133 illuminated may correlate to a level of $CO_2$, oil/dust, and/or odors sensed by the first, second, and third sensors 520*a*, 520*b*, and 520*c*.

Similarly, a speed of the fan 300 may be indicated by a number of illuminated through-holes 133. As shown in FIGS. 25B and 25C, the through-holes 133 may be arranged in concentric circles (each comprising at least a dozen through-holes 133) around a button allowing the user to turn on or turn off the fan 300. Alternatively, there may be a horizontal line or horizontal rows of through-holes on left and right sides of the button, as shown in FIGS. 25D and 25E. A number of concentric circles, a color of light illuminated, or a number of through-holes 133 may correspond to a speed of the fan 300.

Such a configuration of a touch button surrounded by through-holes 133 may also be used for the light 703 (e.g., the button may turn the light 703 on and off, and the through-holes 133 may indicate a current brightness), the AQ sensing assembly 500 itself (e.g., a user may want to temporarily turn off all of the sensors 520*a*-520*c* and control the kitchen hood 1 manually), or a height of the second housing 200 (e.g., the button may be held down to raise and/or lower the second housing 200, and the through-holes 133 may indicate a current height). As another alternative shown in FIG. 25F, there may not be a button to turn the fan 300 on and off, and instead the through-holes 133 may be arranged in radial lines (e.g., of 6 through-holes) spaced apart in a circumferential direction to create a semi-circle, and a number of radial lines or a number of through-holes may indicate a speed of the fan 300.

One of ordinary skill in the art should appreciate that an arrangement of through-holes 133, notifications, and other optional buttons and switches are not limited. In addition, the display 130 or another surface of the outer case 110 may include a switch (e.g., to turn the light 703 and/or the fan 300 on or off), a dial (to control a brightness, speed, height, e.g., according to a continuum of levels), a touch screen, a speaker, etc.

The bottom of the second housing 200 may include a recess or space in which a top of the cover 704 of the sensing assembly 700 is inserted. The cover 704 may be pressed-fit into the space via optional grooves and ribs, and may be further secured via bolts, screws, etc. A coupling of the cover 704 is not limited. For example, the cover 704 may be magnetically secured to the bottom of the second housing 200 to facilitate removal for cleaning or repairs. The cover 704 may be completely inserted into the recess or space so that a bottom of the cover 704 is flush with a bottom of the second housing 200, or alternatively the bottom of the cover 704 may protrude downward from the bottom of the second housing 200.

The entire cover 704 may be formed of a transparent or translucent material (e.g., plastic) so as not to interfere with electromagnetic radiation emitted from the light 703, height sensor 702, and proximity sensor 701. Alternatively, the sensor mount 705 and a bottom surface of the cover 704 below the light 703 and below the height sensor 705 may be transparent, while the rest of the cover 704 (e.g., side surfaces) may be opaque. Embodiments disclosed herein are not limited to a material forming the cover 704 so long as the light 703 may illuminate a stove top under the kitchen hood 1 and so long as the height sensor 702 and proximity sensor 701 may send and receive signals without obstruction.

There may be two or more (e.g., left and right) proximity sensors 701 provided in the sensor mount 705 and adjacent to each other. A left proximity sensor 701 may be in a left section of the sensor mount 705 and a right proximity sensor 701 may be in a right section of the sensor mount 705. Similarly, there may be two or more (e.g., left and right) height sensors 702 provided in the cover 704 between the proximity sensors 701 and the light 703. Each individual proximity sensor 701 may be configured to sense a user approaching the kitchen hood 1 in a left-right direction in addition to a front-rear direction. Alternatively, or in addition thereto, a left-right position of the user relative to the kitchen hood 1 may be determined by comparing data between left and right proximity sensors 701. Similarly, each individual height sensor 702 may be configured to sense a left-right position of cookware on the stove top in addition to a vertical height. Alternatively, or in addition thereto, a left-right position of the cookware relative to the kitchen hood 1 may be determined by comparing data between left and right height sensors 702. An opening and closing of the dampers 660 via the gears 661 may be controlled based on a determined left-right position of cookware.

The sensor mount 705 may be inclined downward from a rear to a front so as to protrude from the bottom of the second housing 200. The proximity sensor 701 may be placed in the sensor mount 705 so as to be oriented along the incline of the sensor mount 705. The proximity sensors 701 may transmit a signal at an angle so as to detect a user or other moving object approaching the proximity sensor 701 in a horizontal or front-rear direction. Alternatively, the sensor mount 705 may be a separate rectangular frame protruding or hanging below the rest of the cover 704 so as not to be inclined, and the proximity sensor 701 may be oriented to face horizontally along the front-rear direction (and not at an incline) to detect a user or other moving object approaching the proximity sensor 701 in a horizontal or front-rear direction.

Adjustments of the driving assembly 450 and optionally the fan 300 may be implemented in various ways so that an air cleaning or purifying function of the kitchen hood 1 may be customized based on the type of cookware and type of cooking a user is performing. As one example, the controller may have a memory that stores a stored distance. The stored distance may be a distance from the bottom of the first housing 100, which remains in a fixed position, to a stove top or other surface below the kitchen hood 1. Alternatively, the stored distance may be a distance from the bottom of the second housing 200 to the stove top when the second housing 200 is inserted into the first housing 100 by a maximum amount so as to be raised by a maximum amount. The stored distance may be calculated based on an initial sensing by the height sensor 702 and a known or sensed height of the second housing 200 relative to the first housing 100. The height of the second housing 200 relative to the first housing 100 may be sensed by an optional sensor in the driving assembly 450 of the sliding assembly 400, or calculated based on an operation of the motor 453 of the driving assembly 450. Alternatively, the stored distance may be manually measured and entered by a user.

When a distance is sensed by the height sensor 702, the controller may convert the sensed distance to a modified or calculated distance based on the height of the second housing 200 relative to the first housing 100. When the second housing 200 is inserted by a maximum amount into the first housing 100, the modified distance may be the same as the sensed distance.

The controller may determine a height of cookware provided on top of the stove top by comparing the modified distance to the stored distance. When the modified distance is the same as the stored distance, the controller may determine that no cookware is provided on the stove top, and may instead operate the fan 300 and optionally the drive assembly 450 primarily based on detections made by the AQ sensing assembly 500.

When the height of the cookware is less than or equal to a first predetermined height, the second housing 200 may slide out of the first housing 100 to a predetermined first position. Alternatively, the second housing 200 may slide to a position so as to be a predetermined first distance away from the cookware. The first predetermined first distance may, for example, correspond to an average height of a frying pan (e.g., 5 cm). The predetermined first height may, for example, be a relatively low position or represent a position where the second housing 200 is inserted a minimal distance into the first housing 100 so as to be lowered a maximum amount.

When the height of the cookware is less than or equal to a second predetermined height greater than the first predetermined height, the second housing 200 may slide out of the first housing 100 to a second predetermined position. Alternatively, the second housing 200 may slide to the second predetermined position when the height of the cookware is determined to be greater than or equal to the second predetermined height, but less than a third predetermined height. The second predetermined height may be a height representing an average or medium-sized sauce pan or pot (e.g., 12 cm), and the second predetermined position may correspond to a position where the second housing 200 is slid about halfway out of the first housing 100, but embodiments disclosed herein are not limited hereto. As yet another alternative, when the height of the cookware is determined to be in between the first predetermined height and the third predetermined height, a height of the second housing 200 may be adjusted so as to be a predetermined second distance away from the cookware.

When the height of the cookware is greater than or equal to a third predetermined height, the second housing 200 may slide out of the first housing 100 to a predetermined third position. Alternatively, the second housing 200 may slide to a position so as to be a predetermined third position away from the cookware. The third predetermined height may, for example, correspond to a height of a large sauce pan or pot (e.g., 15-18 cm).

This application is related to application Ser. No. 16/937,847 filed on Jul. 24, 2020, Ser. No. 16/937,879 filed on Jul. 24, 2020, Ser. No. 16/937,917 filed on Jul. 24, 2020, and Ser. No. 16/937,936 filed on Jul. 24, 2020, the entire disclosures of which are hereby incorporated by reference.

Embodiments disclosed herein are not limited to storing three predetermined heights. For example, there may be a fourth predetermined height that is greater than the first predetermined height and less than the second predetermined height, which may be equal to a size of a small pot (e.g., 8-10 cm). The fourth predetermined height may correspond to a fourth predetermined position between the first and second predetermined positions. Implementations of a control of the drive assembly 450 based on detections by the sensor assembly 700 are not limited hereto. In an alternative embodiment, the sensor assembly 700 may sense a surface area or radius of the cookware instead of a height and control the drive assembly 450 accordingly.

When the controller determines that no cookware is provided on the stove top, the second housing 200 may be raised to be inserted into the first housing 100 by a maximum amount so as to maintain a sleek appearance in the kitchen. Such a position may be referred to as a covered position or an initial position. Alternatively, the controller may not raise the second housing 200 until certain detections by the AQ sensor 500 are at or below predetermined levels. For example, when the controller determines that there is no cookware on the stove top but that a level of at least one of carbon dioxide, oil and dust, or odor is at or above a corresponding predetermined level, the second housing 200 may not be raised or alternatively further lowered, or, Alternatively, or in addition thereto, a speed of the fan 300 may be changed (i.e., increased or decreased) based on detections by the first, second, and third sensors 520*a*, 520*b*, and 520*c*. When all levels of carbon dioxide, oil and dust, or odor are below corresponding predetermined levels, the second housing 200 may be raised to be inserted into the first housing 100 by a maximum amount, and Alternatively, or in addition thereto, the fan 300 may be turned off or a speed of the fan 300 may be reduced.

Alternatively, or in addition thereto, there may be an optional timer to sense how long cookware has been removed from the stovetop. The second housing 200 may not be raised until a predetermined non-cookware time period or more has passed so that the second housing 200 may not be moved during minor intermediate cooking steps, such as emptying cookware, refilling cookware, or other steps that may require temporarily removing or adjusting the cookware.

As an alternative simpler implementation of a height adjustment of the second housing 200, a height of the second housing 200 may be adjusted to maintain a predetermined base distance between the height sensor 702 and a detected cookware below the height sensor 702. In such an embodiment, after a predetermined time period has passed or when detections by the AQ sensing assembly 500 are at or below predetermined levels, the second housing 200 may be raised to be inserted into the first housing 100 by a maximum amount.

A height of the second housing 200 may optionally be further adjusted based on detections by the AQ sensing assembly 500. For example, the controller may modify a value of the predetermined first, second, and third positions or distances based on sensed levels or densities by the first, second, and third sensors 520*a*, 520*b*, and 520*c*. The first, second, and third predetermined positions may be modified to be lower when sensed levels by the AQ sensing assembly 500 are higher, and the first, second, and third predetermined positions may be modified to be higher when sensed levels by the AQ sensing assembly 500 are lower. In another implementation, the controller may move the second housing 200 to the second predetermined position (unmodified), and then raise or lower the second housing 200 by a predetermined adjustment amount based on detections by the AQ sensing assembly 500.

As an example of such an implementation, when a medium-sized sauce pan is placed on the stove top, the second housing 200 may slide to the second predetermined position. In a case where the medium-sized sauce pan is boiling water, levels or densities of carbon dioxide, oil and dust, or odor sensed by the first, second, and third sensors 520*a*, 520*b*, and 520*c*, respectively, may be relatively low. In such a case, the second housing 200 may remain in the second position, or alternatively may be raised by a predetermined clean adjustment amount, which may be a fixed preset amount (e.g., 4 inches), or alternatively calculated based on the sensed levels of carbon dioxide, oil and dust, and odor. In a case where the medium-sized sauce pan is being used as a deep fryer or is cooking fragrant sauces, levels or densities of carbon dioxide, oil and dust, or odor sensed by the first, second, and third sensors 520*a*, 520*b*, and 520*c*, respectively, may be relatively high. In such a case, the second housing 200 may be lowered by a predetermined dirty adjustment amount, which may be a fixed preset amount (e.g., 4 inches), or alternatively calculated based on the sensed levels of carbon dioxide, oil and dust, and odor.

In the case of a frying pan having a low height, adjustments may be primarily raised based on cleaner air. When the frying pan is placed on the stovetop, the second housing 200 may slide to the first predetermined position, which may be a lowest position that the second housing 200 may slide to. When the frying pan is being used to fry ingredients with oil, the second housing 200 may remain at the first predetermined position (or, if the second housing 200 is capable of being lowered further, the second housing 200 may alternatively be lowered by a predetermined dirty adjustment amount). When the frying pan is instead being used to boil or steam a small amount of food or otherwise is producing relatively little smoke or odor (e.g., being used to brown sesame seeds), the second housing 200 may be raised by a predetermined clean adjustment amount.

The fan 300 may remain in an on-state for at least 30 minutes after cooking is finished, which may be determined based on the AQ sensor assembly 500 or on a detection of no cookware by the sensor assembly 700. Continued ventilation after cooking has stopped has shown to reduce an amount of fine dust in the kitchen. The fan 300 may remain in an on-state for 2 hours or based on a preference selected by the user. Before cooking, the user may manually turn on the fan 300, or alternatively, the sensor assembly 700, via the proximity sensor 701, may sense the user approaching the kitchen hood 1 and automatically turn on the fan 300.

A position of the second housing 200 or a speed of the fan 300 may also be controlled manually by a user command or based on an initiation of a steam cleaning operation. Periodically (e.g., every month or every three months), or alternatively based on a cooking frequency, detections by the AQ sensor assembly 500, or detections by an optional residue detector inside the first or second housing 100 or 200, the display 130 may output a notification to suggest to a user to initiate a steam cleaning operation. Outputting such a notification may be the first step (i.e., Step 1) in a steam cleaning operation.

Upon seeing the notification on the display 130, the user may input a command to initiate steam cleaning. The display 130 may receive the user command at a second step (Step 2). After receiving the user command in Step 2, the fan 300 may be turned off and the second housing 200 may be lowered by a maximum amount or amount to allow access to the liquid storage container 610 in a third step (Step 3).

After the second housing 200 has been lowered in Step 3, the display 130 may output a notification instructing the user to fill the liquid storage container 610 with liquid in a fourth step (Step 4). After seeing the notification, the user may withdraw the liquid storage container 610 from the container guide 611 and fill the first bin 610*a* with liquid. The liquid storage container 610 may be at a convenient position to be removed due to the second housing 200 being lowered. After filling, the user may insert the liquid storage container 610 back into the container guide 611. In a fifth step (Step 5), a sensor may detect a liquid level in the storage container 610. Upon sensing that a predetermined liquid level or more is in the liquid storage container 610 in Step 5, the second housing 200 may be raised by a maximum amount or the second housing 200 is inside of the first housing 100 in a sixth step (Step 6). After the second housing 200 has been raised, the dampers 660 may be closed in a seventh step (Step 7) to prevent leakage of the condensate. After the dampers 660 are closed, in an eighth step (Step 8), the steam generator 612 may be turned on.

The steam generator 612 may operate for a predetermined amount of steam time in a ninth step (Step 9). After the predetermined amount of steam time has passed, the steam generator 612 may be turned off in a tenth step (Step 10). The steam generator 612 and the fan 300 may be left off for a predetermined collection time in an eleventh step (Step 11). During Step 11, condensate may continue to collect in the second bin 610*b* of the liquid storage container 610 before the fan 300 is turned on. After the predetermined collection time has passed, the fan 300 may be turned on in a twelfth step (Step 12) to exhaust steam and residue to an outside, and the dampers 660 may be optionally opened. The fan 300 may be left on for a predetermined exhaust time in a thirteenth step (Step 13). After the predetermined exhaust time has passed, the fan 300 may be turned off in a fourteenth step (Step 14). After the fan 300 is turned off, the display 130 may provide a notification that instructs the user to empty the liquid storage container 610, and the dampers 660 may be closed in a fifteenth step if the dampers were optionally opened (Step 15).

Upon seeing the notification, the user may input a command to lower the second housing 200 so that the collected condensate may be discarded. Upon receiving the command in a sixteenth step (Step 16), the second housing 200 may be lowered. The user may withdraw the liquid storage container 610, discard the collected condensate, and insert the liquid storage container 610 back into the second housing 200. Upon detecting an empty liquid storage container 610 (or a liquid level less than the predetermined liquid level), the second housing 200 may be automatically raised in an seventeenth step (Step 17). After Step 17, the user may input a command into the display 130 to set the kitchen hood 1 back to an air cleaning mode where the AQ Sensing Assembly 500 constantly or periodically senses air quality in the kitchen. The fan 300 and/or a height of the second housing 200 may be automatically controlled based on the detections by the AQ Sensing Assembly 500 to maintain an acceptable air quality in the kitchen.

Embodiments disclosed herein are not limited to an order of the above steps so long as the fan 300 is turned off before steam is generated by the steam generator 612. For example, in Step 3, the fan 300 may be left on as the second housing 200 is lowered, and may not be turned off until Step 4, Step 5, Step 6, or Step 7. Similarly, the dampers 660 may be closed in any one of Steps 3, Step 4, Step 5, Step 6, or Step 7.

In Step 14 or after Step 15, Step 16, or Step 17, depending on a detection by the AQ Sensing Assembly 500, the fan 300 may be left on or turned on to continue to exhaust polluted air in the kitchen, or a speed may be adjusted based on a detection by the AQ sensing assembly 500, In such an arrangement of steps, the dampers 660 may be left open or closed. If the fan 300 is left on after Step 14, the fan 300 may be turned off when the user indicates a desire to remove the liquid storage container 610 to discard the collected condensate via a command input into the display 130.

The user may desire steam cleaning to occur at night. As an alternative to the process described above, upon seeing the notification in Step 1, the user may input a command into the display to program steam cleaning to start at a later time. The user may withdraw the liquid storage container 610 to fill the liquid storage container 610 with water, but upon sensing the predetermined liquid level and raising the second housing 200 in Step 6, then Steps 7 and/or 8 may be delayed until the pre-programmed time. In the meantime, the fan 300 may continue to run to exhaust contaminants in the kitchen, and the dampers 660 may be left open, depending on a need based on detections by the AQ sensing assembly 500 or manual commands. The user may pre-fill the liquid storage container 610 and pre-program steam cleaning for any time or periodically.

As another alternative, the user may decide to pre-fill the liquid storage container 610 before receiving a notification recommending a steam cleaning process. The user may input a command instructing steam cleaning to occur automatically based on a cooking frequency, an estimated dirt or residue level inside of the second housing 200, or otherwise based on whenever the display 130 would have suggested steam cleaning to the user. In such an arrangement, Steps 1-6 may be skipped, and in Step 7, the fan 300 may be turned off after the dampers 660 are closed. The user may pre-fill the liquid storage container after Step 16. As the user discards the collected condensate from the second bin 610*b*, the user may, at that time, fill the first bin 610*a*, and the user may not have to fill the liquid storage container 610 later at the next steam cleaning.

Steps 5 and 6 may alternatively be based on a weight sensing or a detection of the liquid storage container 610 being inserted into the container guide 611. As another alternative, the user may input a command into the display 130 after inserting the liquid storage container 610 to command the second housing 200 to be raised. Steps 7 and 8 may also be alternatively initiated based on a user command input into the display 130 instead of automatically after the second housing 200 has been raised.

In Step 15, instead of providing a notification to the user that steam cleaning has been completed, as an alternative, the second housing 200 may be automatically lowered to indicate to the user that the liquid storage container 610 may be removed to discard the collected condensate. In Step 17, instead of automatically raising the second housing 200 upon detection of the empty liquid storage container 610, the user may insert a command into the display 130 to instruct the second housing 200 to raise.

Instead of operating based on a predetermined steam time, collection time, and exhaust time, Steps 9-15 may alternatively be based on a detected liquid level in the second condensate bin 610*b* to prevent overfilling of condensate collected in the second condensate bin 610*b*. For example, in Step 9, the steam generator 612 may be operated until a first liquid level has been detected in the second bin 610*b*. Once the first liquid level has been reached, the steam generator 612 may be turned off in Step 10, The steam generator 612 and the fan 300 may be left off in Step 11 until a second liquid level greater than the first liquid level has been detected in the second bin 610*b*. Upon detection of the second liquid level, the fan 300 may be turned on in Step 12.

After Step 4, as the user is filling the liquid storage container 610, the user may choose to remove the suction grills 210 from the second housing 200 and place the suction grills 210 in the dishwasher for cleaning. The suction grills 210 may be reattached after Step 16 when the user discards the collected condensate. As an alternative to the dampers 660 closing in Step 8, the dampers 660 may be left opened, and the user may attach a container to a bottom of the second housing 200 below the suction grill 210 or provide a container below the suction grill 210 to catch any errant condensate. Although attaching a container may be inconvenient, the suction grill 210 may be cleaned by the steam cleaning process if the dampers 660 are left open. The container may be latched on, magnetically secured, pressed-fit, etc. Embodiments disclosed herein are not limited.

As a simpler implementation, the steam generator 312, the second housing 200, the dampers 660, and the fan 300 may operate on a simple time-based steam cleaning program, and operate at first, second, etc., predetermined times calculated from after a user's command, after detection of a filled liquid storage bin 610 being inserted into the condensate guide 611, or after the second housing 200 has been raised.

Figure 28:
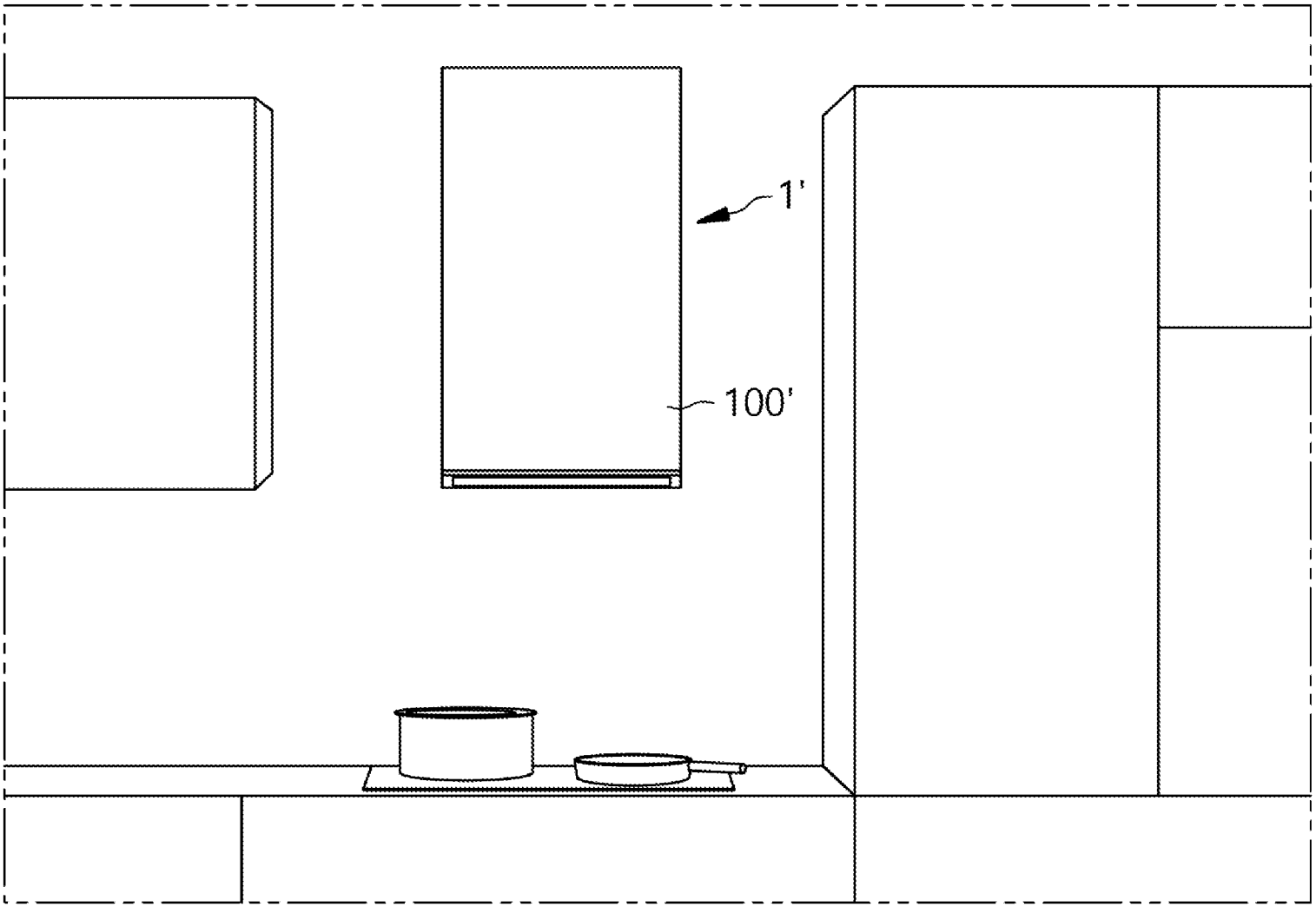
FIG. 28 is a front view of a kitchen hood according to another embodiment.
Figure 29:
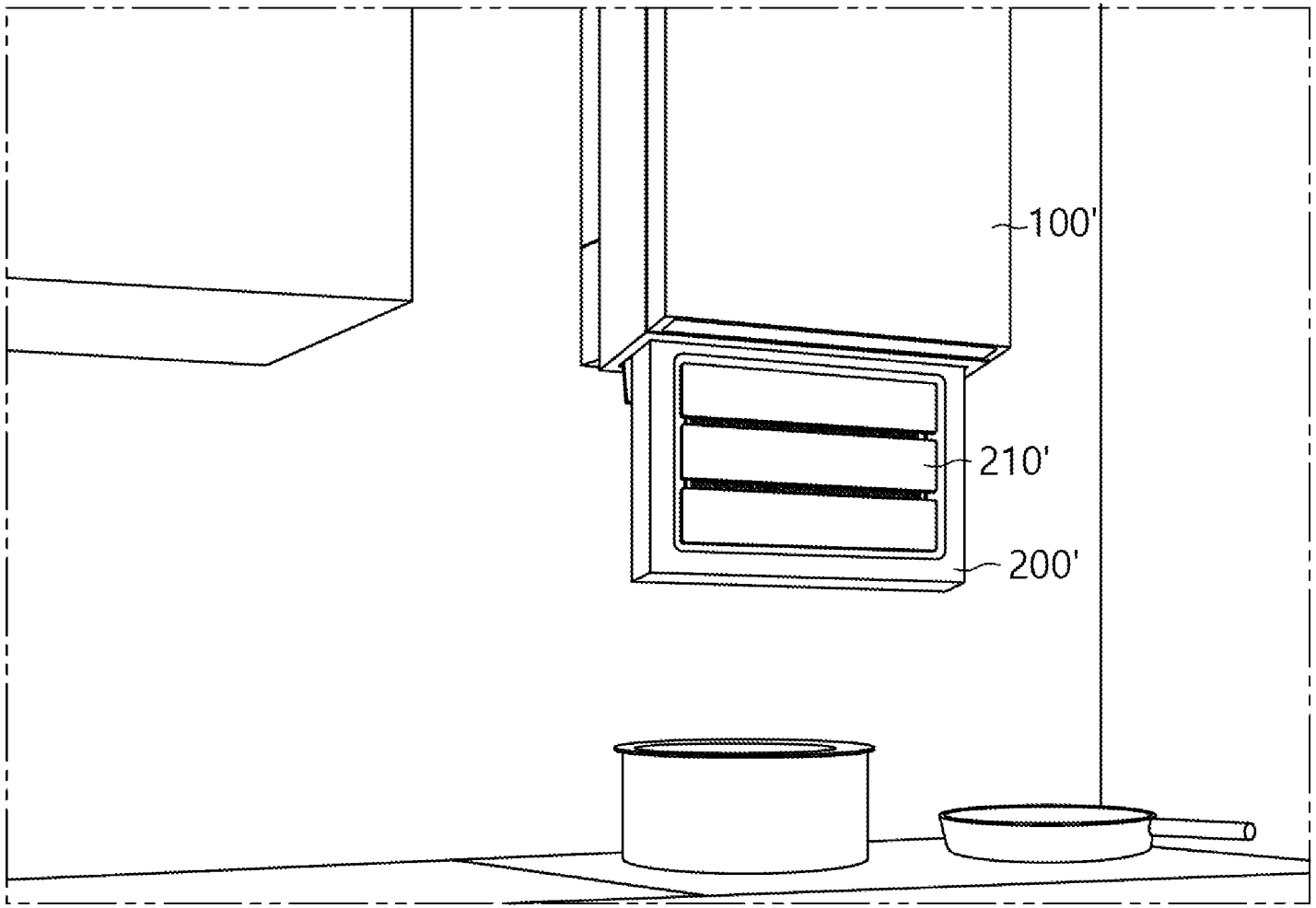
FIG. 29 is a perspective view of the kitchen hood of FIG. 28 in a lengthened state.
Figure 30:
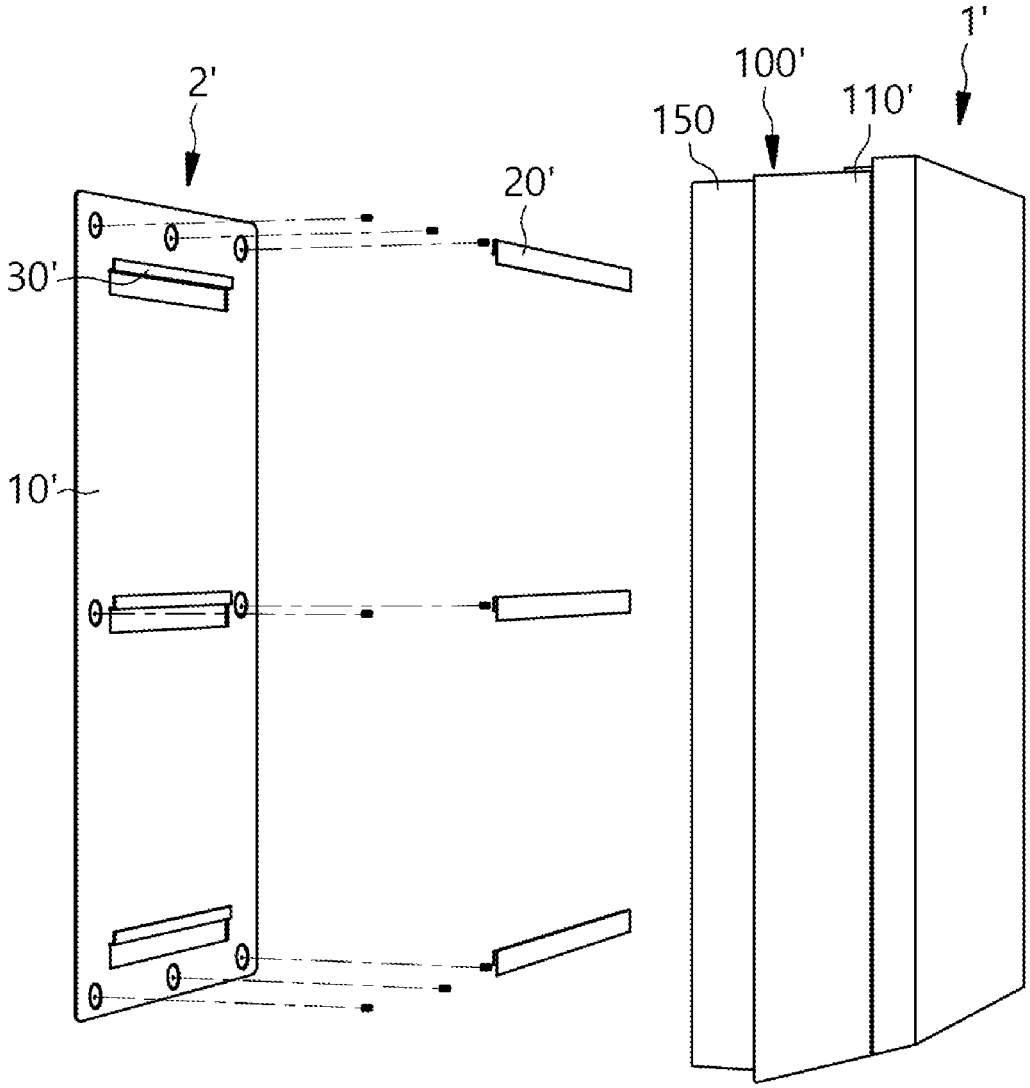
FIG. 30 is a side perspective view of the kitchen hood of FIG. 28 and a bracket.

Referring to FIGS. 28 and 29, an alternative embodiment of the kitchen hood 1 may be a kitchen hood 1'. A configuration of the kitchen hood 1' may be similar to the configuration of the kitchen hood 1 describe with reference to FIGS. 1-27, and a repetitive description will be omitted and differences will be primarily described. The kitchen hood 1' may be thought of as similar to the kitchen hood 1 but having a perpendicular orientation. The kitchen hood 1' may be wider in the left-right direction and shorter in the front-rear direction than the kitchen hood 1. As an example, a depth in the front-rear direction may be less than 20 cm (e.g., 19.5 cm). The kitchen hood 1' may not protrude too far over the cooktop so that a front facing suction grill 210' may effectively suction cooking fumes emanated from the cooktop.

The kitchen hood 1' may include a first housing or case 100' and a second housing or case 200' configured to slide relative to the first housing 100'. A suction grill 210' may be provided on a front surface of the second housing 200'. When the second housing 200' is lowered, the suction grill 210' may face a user standing in front of a stove top.

The kitchen hood 1' may be coupled to a wall via a bracket 2'. The bracket 2' may be wider in the left-right direction so as to support the wider kitchen hood 1'. The bracket 2' may include a wide plate 10' that is bolted or screwed onto a wall. The wide plate 10' may be formed with wide bracket hooks 30' from which wide hooks 20' coupled to the kitchen hood 1 may hang.

The first housing 100' may include a rear inner case 150, a front inner case 160 (FIGS. 32 and 34), and an outer case 110' covering the front inner case. The rear inner case 150 may not be covered by an outer case 110'. Alternatively, the rear inner case 150 may be covered by the outer case 110'.

The rear inner case 150 may be coupled (e.g., screwed, bolted, welded, bonded, or adhered) to the hooks 20'. The hooks 20' may hang from the bracket hooks 30', and the kitchen hood 1' may be lifted and removed from the wall by removing the hooks 20' from the bracket hooks 30'.

Figure 31:
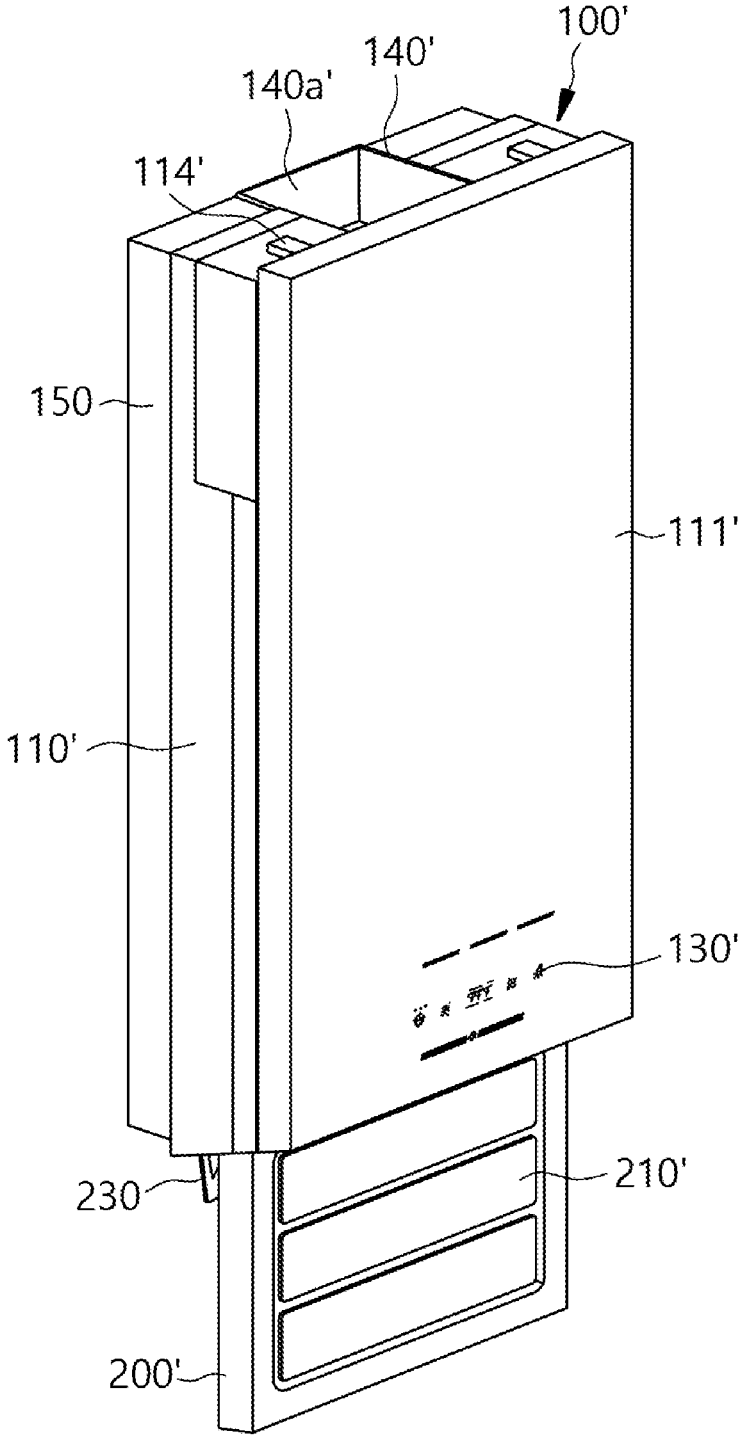
FIG. 31 is a side perspective view of the kitchen hood of FIG. 28 to show a display, door, and suction grill in a lengthened state.
Figure 32:
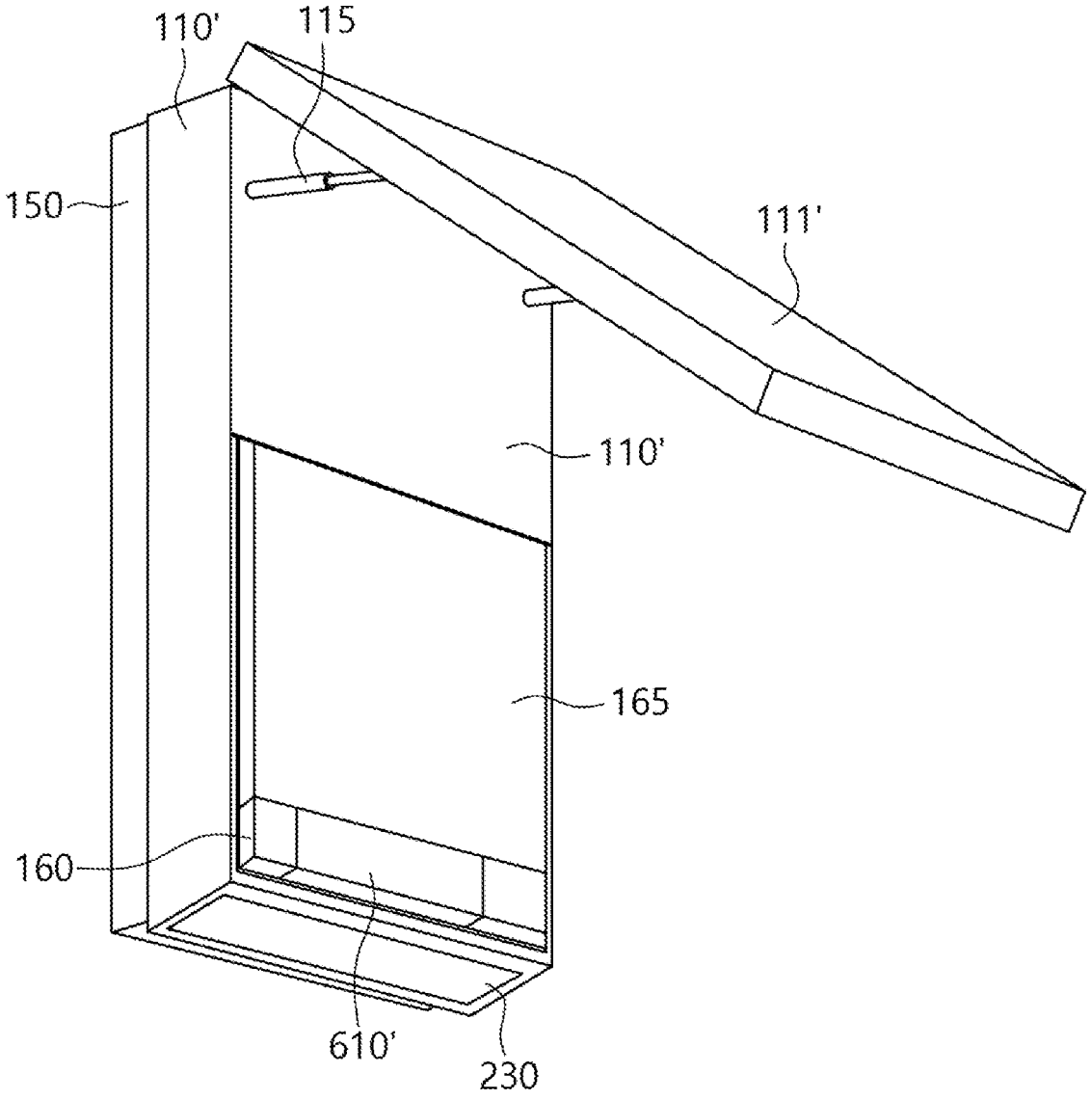
FIG. 32 is a side perspective view of the kitchen hood of FIG. 28 with the door opened.
Figure 33:
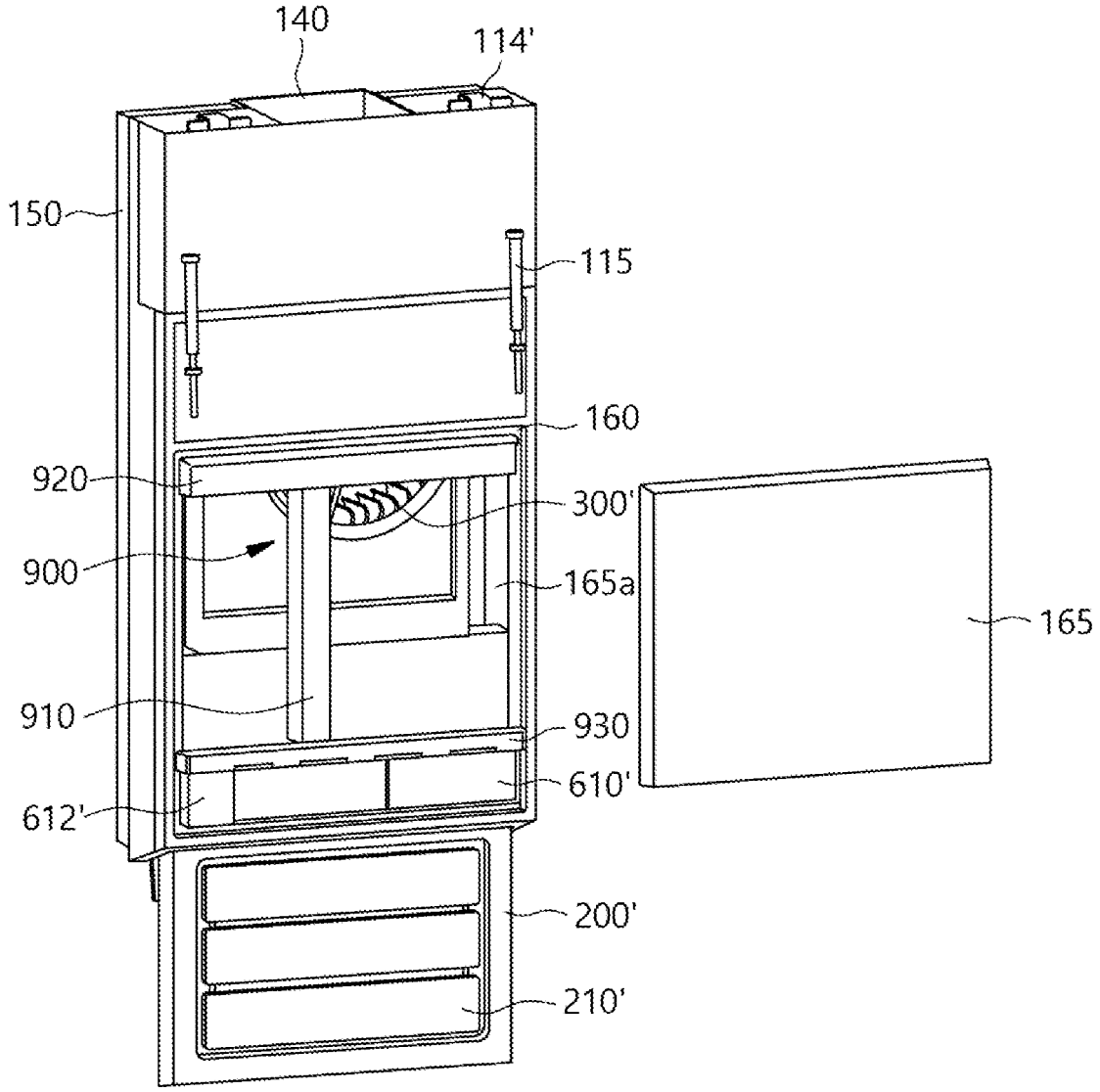
FIG. 33 is a front view of the kitchen hood of FIG. 28 with the door and a front cover removed.

Referring to FIGS. 31-33, the first housing 100' may include a door 111' hinged to a top so as to open and close a bottom section of the outer case 110'. The door 111' may be pushed open or closed via a door closer 115 (e.g., a hydraulic pump, a spring pump, a gas or pneumatic pump, or a hood hinge) that rotates upward to push the door 111' outward. When the door 111' is closed, the door closer 115 may be bent or compressed. When the door closer 115 is released and/or activated, the door closer 115 may exert a restoring force to open the door 111' and keep the door 111' open at a predetermined angle so that a user may use both hands to access the inner case 160.

The door 111' may be a solid rectangular panel or frame hinged to a top of the outer case 110.' When the door 111' is opened, an upper section of the outer case 110' may be exposed, along with a removable liquid storage container 610' for steam cleaning and a removable cover 165. The liquid storage container 610' may be housed at a bottom of a front side of the front inner case 160. A steam generator 612' may be provided adjacent to the liquid storage container 610 in the left-right direction. The liquid storage container 610' may include two or more sections so that condensate may be deposited in a section separate from where cleaning fluid is filled and/or so that different types of liquid (e.g., water and detergent or other cleaning solution) may be filled in the liquid storage container 610.

The removable cover 165 may cover a sweeping assembly 900. The sweeping assembly 900 may include a sweeper 910 configured to remove debris, oil, and other foreign matter from the suction grill 210', a top guide or header 920, and a bottom guide or header 930. A hole or opening 165*a* may be formed in the front inner case 165 through which the suction grill 210' may be exposed when the second housing 200' is raised to be inserted into the front inner case 160. The sweeper 910 may be configured to move in a left-right direction between the top and bottom guides 920 and 930. Details of the sweeper assembly 900 will be described with reference to FIGS. 37-38C. The liquid storage container 610' and steam generator 612' may be provided under the bottom guide 930.

A front of the door 111' may include a display 130', which may be similarly implemented as the display 130 of the kitchen hood 1 described with reference to FIGS. 1-27. The display 130' may indicate detected air quality and an operation status. The display 130' may also optionally include a touch screen.

The outer case 110' may cover an upper section of the front inner case 160 and left and right sides of the front inner case 160. The second housing 200' may be configured to slide into and out of a lower opening of the front inner case 160 and also a lower opening of the outer case 110' which surrounds the front inner case 160. The second housing 200' may be configured to be completely inserted into the lower opening of the outer case 110'. A door 230 may be hinged to a bottom of the front inner case 160 to cover the bottom of the second housing 200' such that the door 230 is flush with a bottom of the outer case 110'. A material forming the door 230 may match a material forming the outer case 110' so as to give a sleek appearance. As an example, the outer case 110' and the door 230 may be formed of a brushed stainless steel or a glass-coated stainless steel, but embodiments disclosed herein are not limited hereto. The door 230 may be optional. At least one of the door 230 or a bottom of the front or rear inner housings 160 or 150 may include height or proximity sensors.

A top of the first housing 100' may be formed with a top opening 140*a'* defined by a top frame 140'. The opening 140*a'* may serve as an optional outlet for discharged air depending on a configuration of the fan 300' described with reference to FIG. 34.

Figure 34:
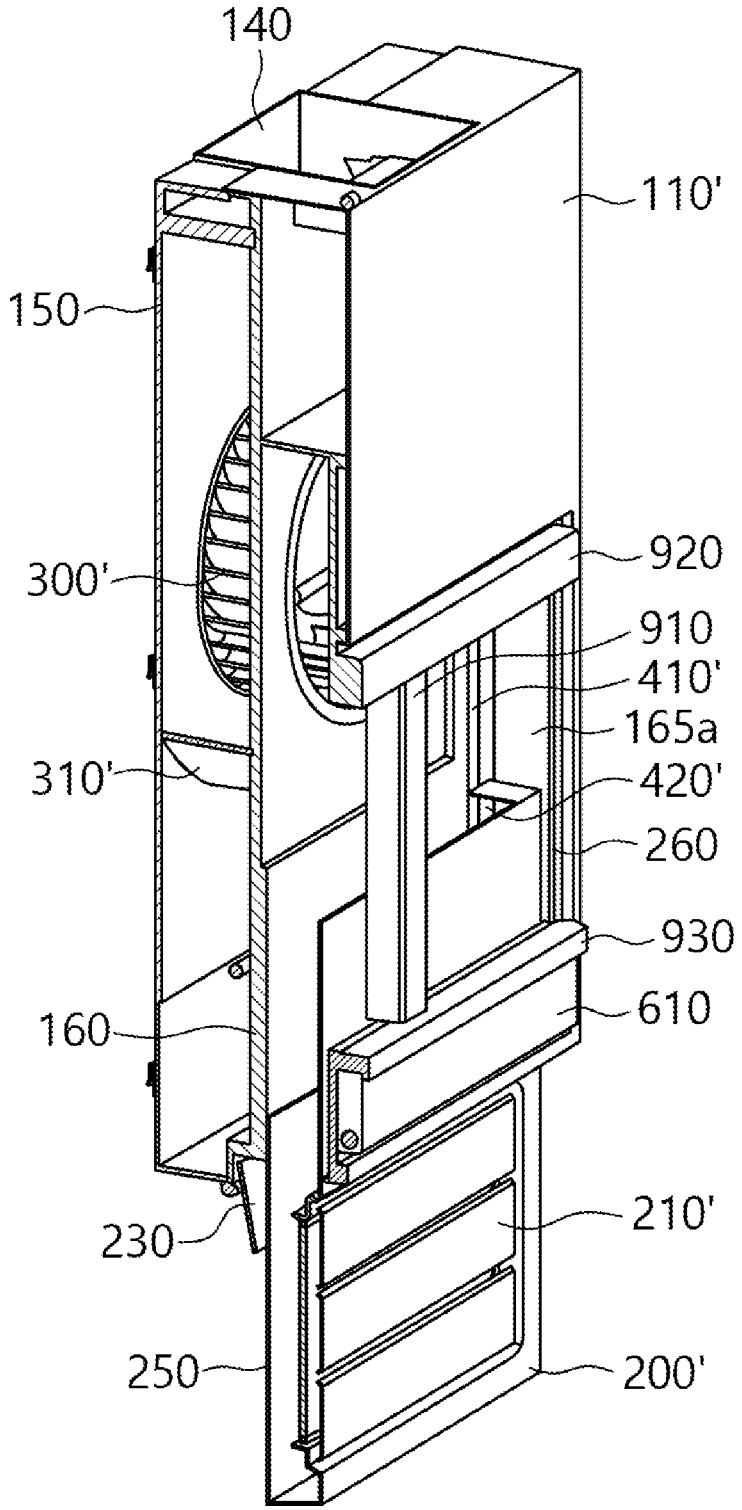
FIG. 34 is a side perspective view of the kitchen hood of FIG. 33.
Figure 35:
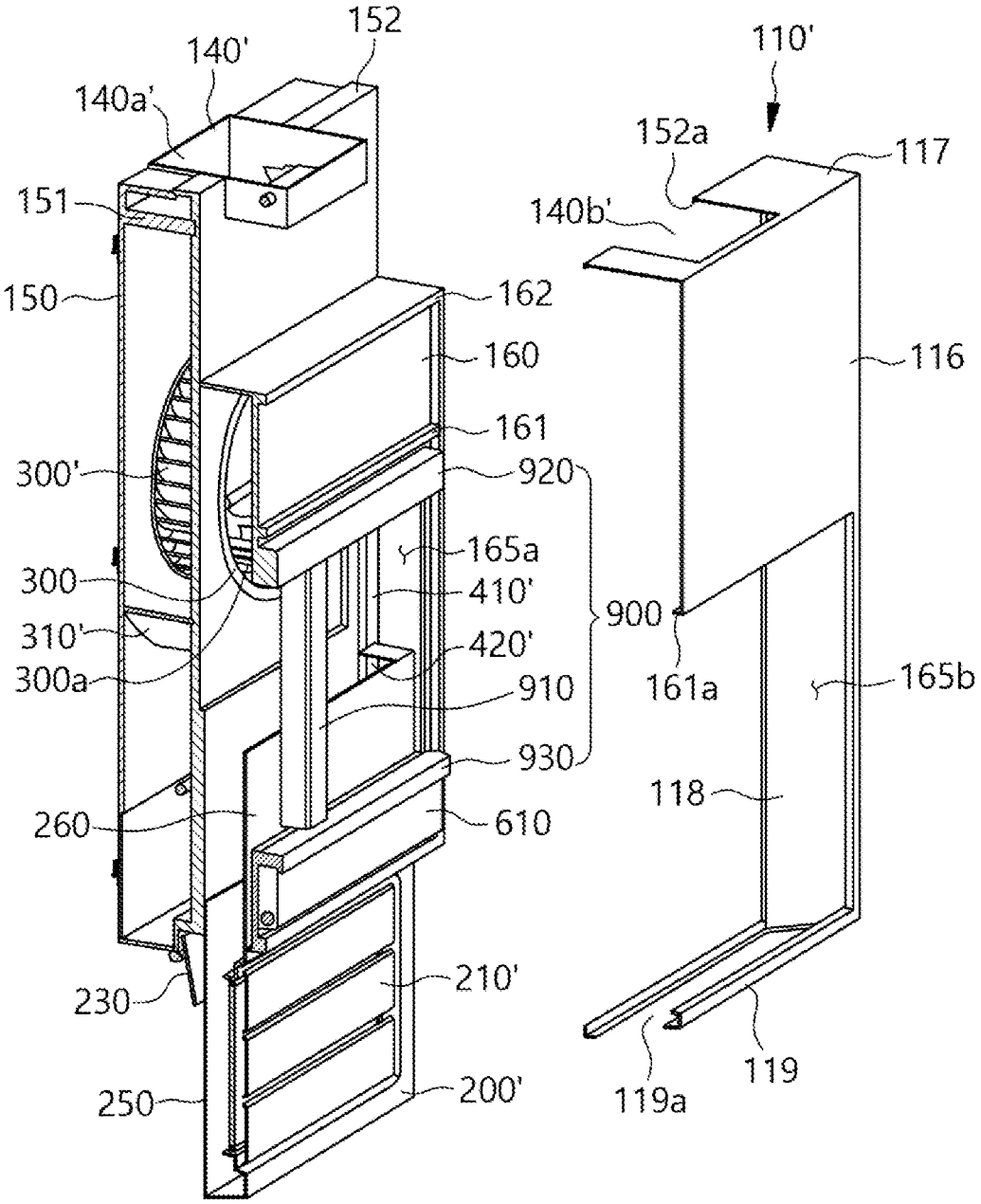
FIG. 35 is an exploded perspective view of the kitchen hood of FIG. 34 to show an outer case and an inner case.
Figure 36:
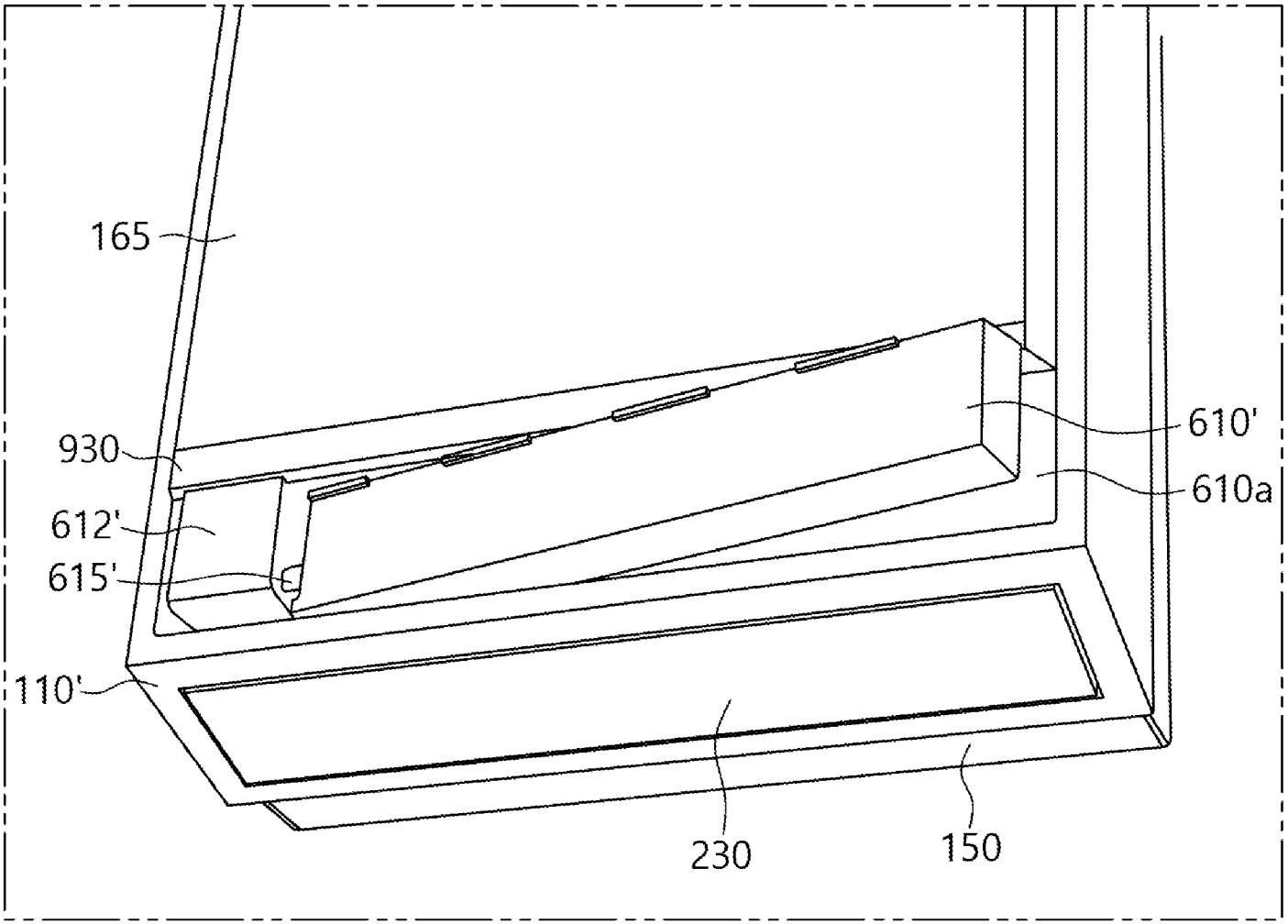
FIG. 36 is a view of the kitchen hood of FIG. 28 from below and with the door removed to show a liquid storage container.

Referring to FIGS. 34-36, the second housing 200' may slide into and out of the first housing 100' via first and second rails 410' and 420'. Similar to the kitchen hood 1 described with reference to FIGS. 1-27, a plurality of first rails 410' may be coupled to an inner surface of the front inner case 160, and a plurality of second rails 420' may be coupled to an outer surface of the second housing 200' at positions corresponding to the first rails 410'. For example, there may be two or more first rails 410' coupled to a rear inner surface of the front inner case 160, and two or more second rails 420' coupled to an outer rear surface of the second housing 200' so as not to interfere with the suction grill 210' and a sweeper 910 described later. For added stability, there may be two more first rails 410' provided on left and right inner surfaces, respectively, of the front inner case 160, and two more second rails 420' provided on left and right outer surfaces of the second housing 200', respectively, to engage with the first rails 410'.

Figure 40A:
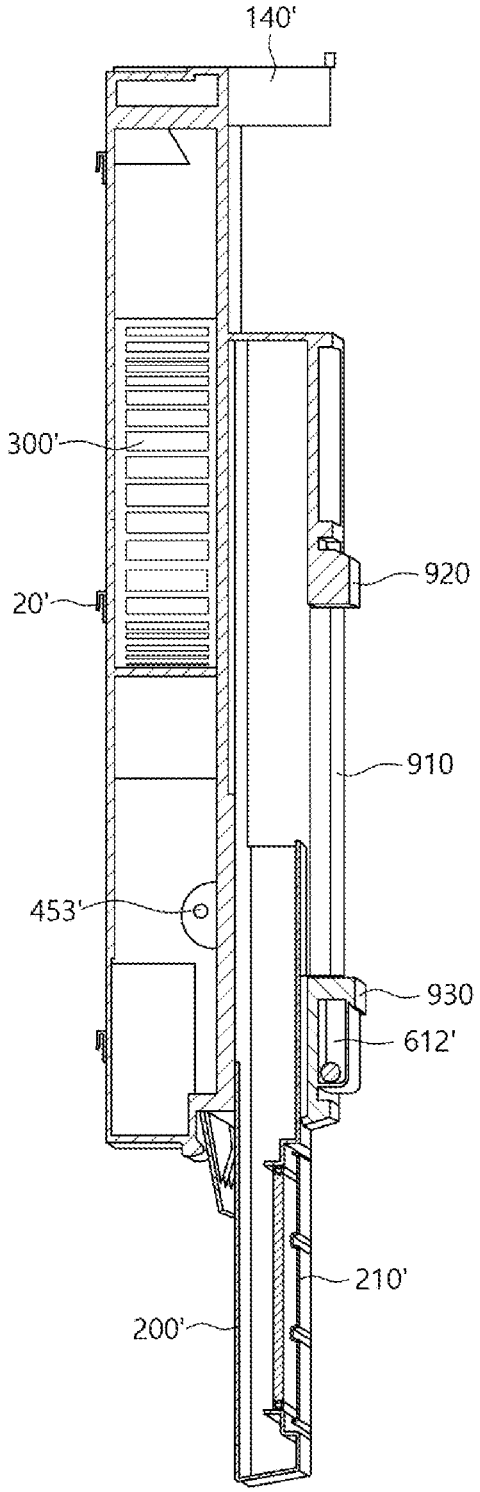
FIG. 40A is a left side view of the kitchen hood of FIG. 28 showing an interior.
Figure 40B:
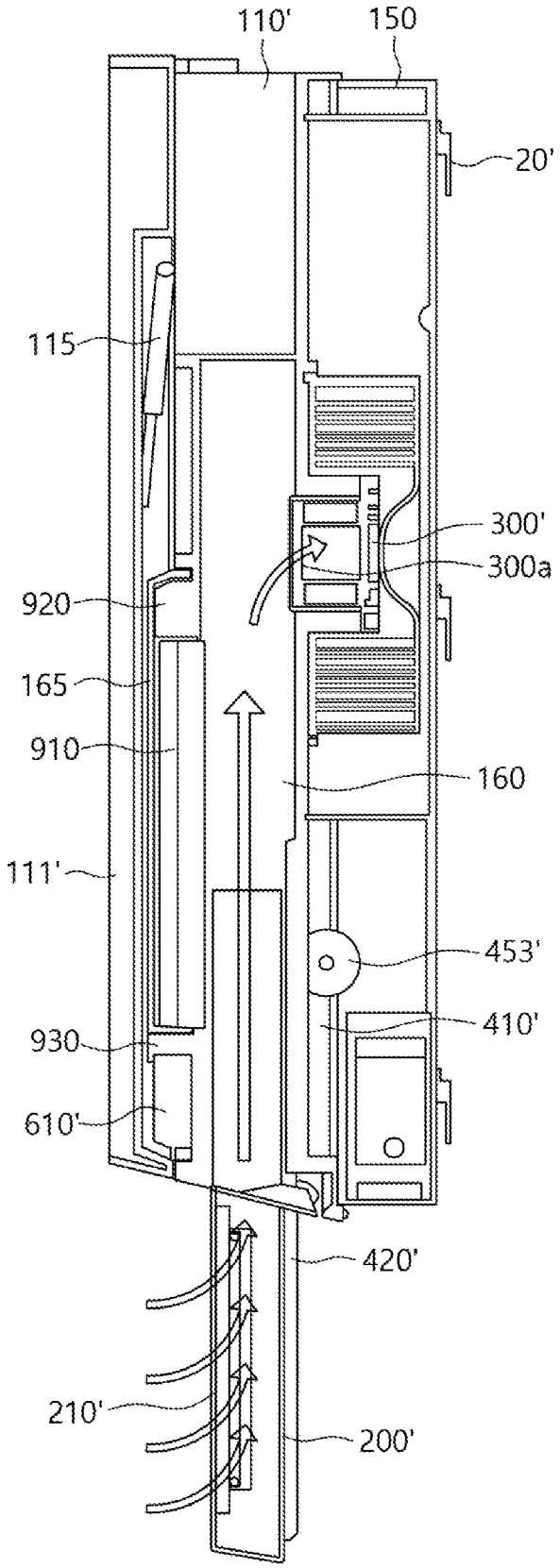
FIG. 40B is a right side view of the kitchen hood of FIG. 28 showing an interior and an air flow.

A driving assembly (e.g., a motor and rack and pinion configuration) may raise and lower the second housing 200' with respect to the front inner case 160 to slide the second housing 200' into and out of the front inner case 160. The driving assembly may include a drive or motor 453' (FIGS. 40A and 40B).

A ledge or plate 151 may be formed below the top surface of the rear inner case 150. The ledge 151 may be spaced apart from the top surface. The top frame 140' and top opening 140*a'* may penetrate the top surface of the rear inner case 150, and a rear section of the top frame 140' may be provided on the ledge 151. A front section of the top frame 140' may protrude forward from the rear inner case 150. A flange or protruding section 152 may be formed in a front section of the top surface of the rear inner case 150.

The outer case 110' may be configured to cover a front upper section of the front inner case 160, a top surface of the front inner case 160, and the flange 152 of the rear inner case 150. The outer case 110' may be formed primarily as a front plate or panel 116, a top plate or panel 117 extending rearward from a top of the front plate 116, side plates or panels 118 extending downward from left and right sides of the top plate 117 and rearward from left and right sides of the front plate 116, and a bottom plate or panel 119 extending between the side plates 118. The outer case 110' may not have a rear plate or surface, as the rear inner case 150 may be directly coupled to the wall via the bracket 2 (FIGS. 28-29).

An opening or space 165*b* may be formed in the front plate 116. The opening 165*b* may be configured to surround the sweeper opening 165*a*, the sweeper assembly 900, and the liquid storage container 610, A support ledge or protrusion 161*a* may protrude rearward from the front plate 116 at a position adjacent to a top of the opening 165*b*. A support ledge 161 may be formed to protrude forward from the front surface of the front inner case 160, and the support ledge 161*a* of the outer case 110' may be supported by the support ledge 161 of the front inner case 160. Alternatively, the front inner case 160 may have a recess in which the support ledge 161*a* of the outer case 110' is inserted. A top of the front inner case 160 may have a ledge or protrusion 162 that protrudes the same amount as the support ledge 161 to provide structural rigidity to the front plate 116 so that the front plate 116 may remain straight. The outer cover 110' may be secured to the front inner cover 160 via the support ledges 161*a* and 161, and also via the bottom plate 119, which may be snap-fitted to a bottom of the front inner case 160 at a position under the liquid storage container 610.

The top plate 117 may have an opening 140*b'* through which the top frame 140' and top opening 140*a'* may be exposed. A protrusion or hook 152*a* may be formed on a rear end of the top plate 117 to extend or curve downward. The hook 152*a* may be hooked onto the flange 152 to secure the outer cover 110' to the rear inner cover 150.

The bottom plate 119 may be configured to cover a bottom surface of the front inner case 160 and a portion of the door 230, and may be formed of the same material as the door 230. The bottom plate 119 may form a bottom opening 119*a* through which the second housing 200' may slide. When the second housing 200' is completely inserted into the front inner case 160, the door 230 may cover the bottom of the second housing 200', and a section of the door 230 may be flush with a bottom surface of the bottom plate 119. The door 230 may include an elastic member or spring at a hinge so as to close via a restoring force of the elastic member. The hinge of the door 230 may be covered by the bottom plate 119.

When the outer case 110' is coupled to the rear and front inner cases 150 and 160, the front plate 116 may contact the ledges 161 and 162 of the front inner case 160, while an upper section of the front plate 116 may be spaced apart from a front surface of the rear inner case 150. A rear portion of the top plate 117 may contact the flange 152 of the rear inner case 150, while a front portion of the top plate 117 may be spaced apart from the top surface of the front inner case 160. The side plates 118 may contact side surfaces of the front inner case 160. Alternatively, or in addition there, the side plates 118 may be long enough in the front-rear direction to at least partially contact sides of the rear inner case 150.

The rear inner case 150 and the front inner case 160 may share a wall. (i.e., a portion of a front wall of the rear inner case 150 may be defined by the same wall or plate defining a rear wall of the front inner case 160). Alternatively, the front and rear inner cases 160 and 150 may be formed separately, and the rear of the front inner case 160 may be coupled to (e.g., welded, fused, bolted, screwed, or adhered) to a front of the rear inner case 150.

The fan 300' may be housed in the rear inner case 150, and may have a front-rear length that is equal or similar to a front-rear length of the rear inner case 150. A fan guide 310' may be formed as a curved or spiraling wall extending between front and back surfaces of the rear inner case 150 to add rigidity to the rear inner case 150. The fan 300' may be an axial fan. An intake or inlet of the fan 300' may be exposed through a fan hole 300*a* formed through the front of the rear inner case 150 and the rear of the front inner case 160. An outtake or outlet of the fan 300' may face a rear of the rear inner case 150, and the rear of the rear inner case 150 may be formed with a discharge opening through which air is discharged. Alternatively, the user may wish to use a centrifugal fan like the fan 300 described with the reference to FIGS. 1-27. In such a case, air may be discharged out of the top opening 140*a'*.

A front panel or plate 260 of the second housing 200' may be longer than a rear panel or plate 250 of the second housing 200'. When the second housing 200' is completely inserted into the front inner case 160, the rear plate 250 of the second housing 200' may be provided below the fan hole 300*a* so as to not obstruct the fan hole 300*a*, Alternatively, the rear plate 250 of the second housing 200' may be formed with a fan hole configured to at least partially align with the fan hole 300*a* when the second housing 200' is completely inserted into the front inner case 160. The fan 300' may suction air inside of the front inner case 160 and the second housing 200', and discharge air out of the rear of the rear inner case 150 and/or the top opening 140*a'* in the case of a centrifugal fan. Alternatively, side surfaces of the rear inner case 150 may include discharge openings through which air may be discharged.

The liquid storage container 610' may be pulled from and pushed into a space 610*a* formed between the bottom guide 930 of the sweeping assembly 900 and a bottom of the front inner case 160. The steam generator 612' may be provided in the space 610*a*. A seal 615' may be formed in the liquid storage container 610', and the steam generator 612' may include a protrusion having an opening that opens the seal 615' when the liquid storage container 610' is provided in the space 610*a*. Liquid may flow from the liquid storage container 610' into the steam generator 612' via the seal 615' and the opening of the protrusion. Like the seal 615 described with reference to FIGS. 1-27, the seal 615' may be made of an elastic material having a slit that is closed until the protrusion of the steam generator 612' fits inside of the slit. Alternatively, or in addition thereto, at least one of the steam generator 612' or the seal 615' may have a valve configured to open and close so as to control a flow of liquid into the steam generator 612'.

A length of the liquid storage container 610' may be configured such that the liquid storage container 610' may be secured between the steam generator 612' and a side surface of the front inner case 160. The liquid storage container 610' may be inserted into the space 610*a* at an angle so as to align the slit of the seal 615 with an opening penetrating the protrusion of the steam generator 612'. The seal 615' may be formed at a first (e.g., left) side to couple to the steam generator 612', which may be provided at a first (e.g., left) side of the space 610*a*. Once the seal 615' is aligned with the opening of the protrusion of the steam generator 612', the user may push a second (e.g., right) side of the liquid storage container 610' opposite the first side into the space 610*a*. There may be a slight gap or space formed between the right side of the liquid storage container 610' and an inner side surface of the front inner case 160 so that the user may insert a finger and pull the liquid storage container 610' out of the space 610*a*.

The steam generator 612' may generate steam, which may be emitted upward toward the sweeper assembly 900 and/or to interiors of the front and rear inner cases 160 and 150. A top of the steam generator 612' and the bottom guide 930 may include openings through which steam generated by the steam generator 612' may be discharged. The steam may loosen debris, oil, dust, or other foreign matter accumulated on the suction grill 210', making it easier for the sweeper 910 to wipe off the foreign matter and clean the suction grill 210.

Figure 37:
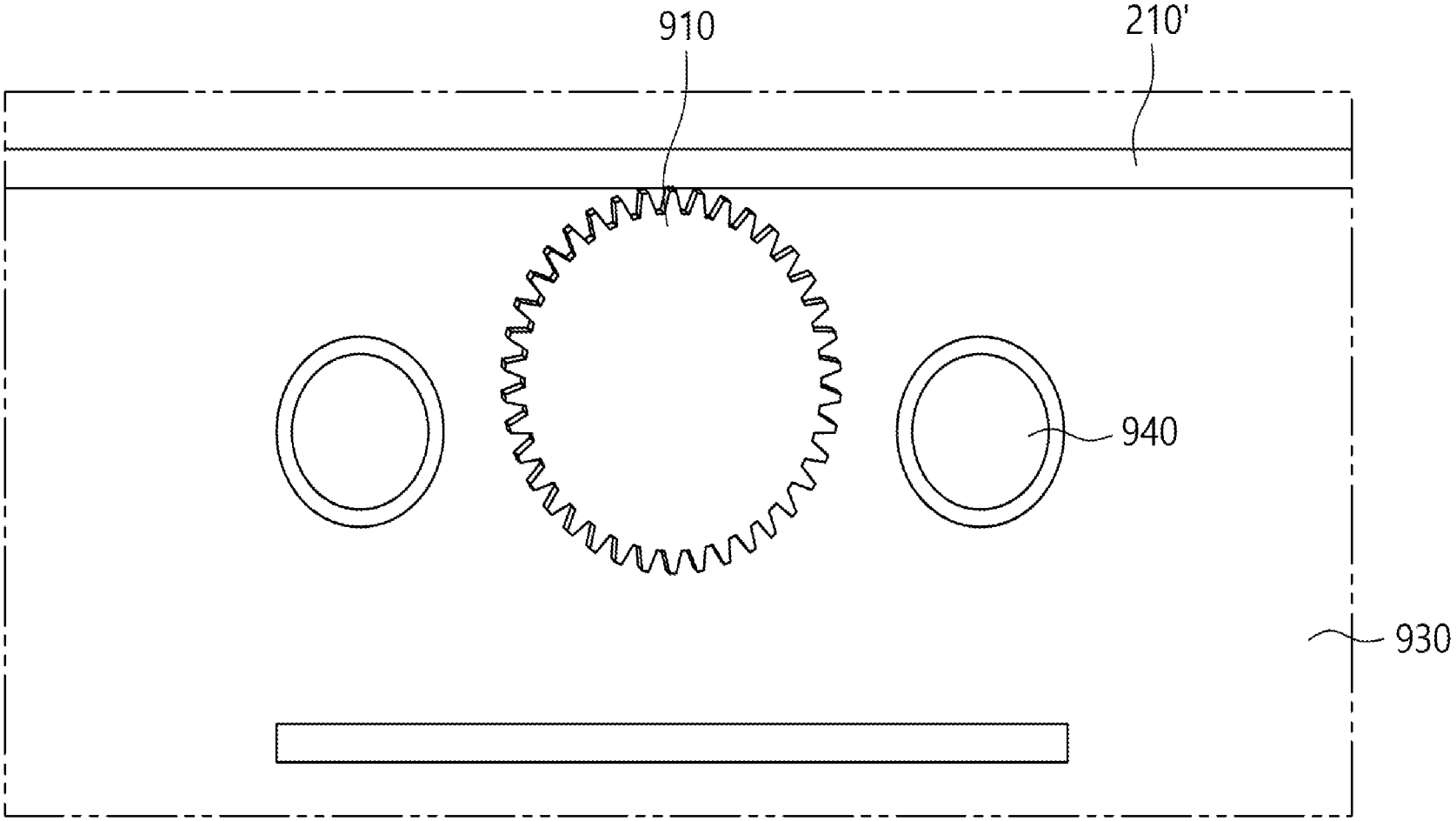
FIG. 37 is a bottom view of a sweeper assembly from below a bottom guide.
Figure 38A:
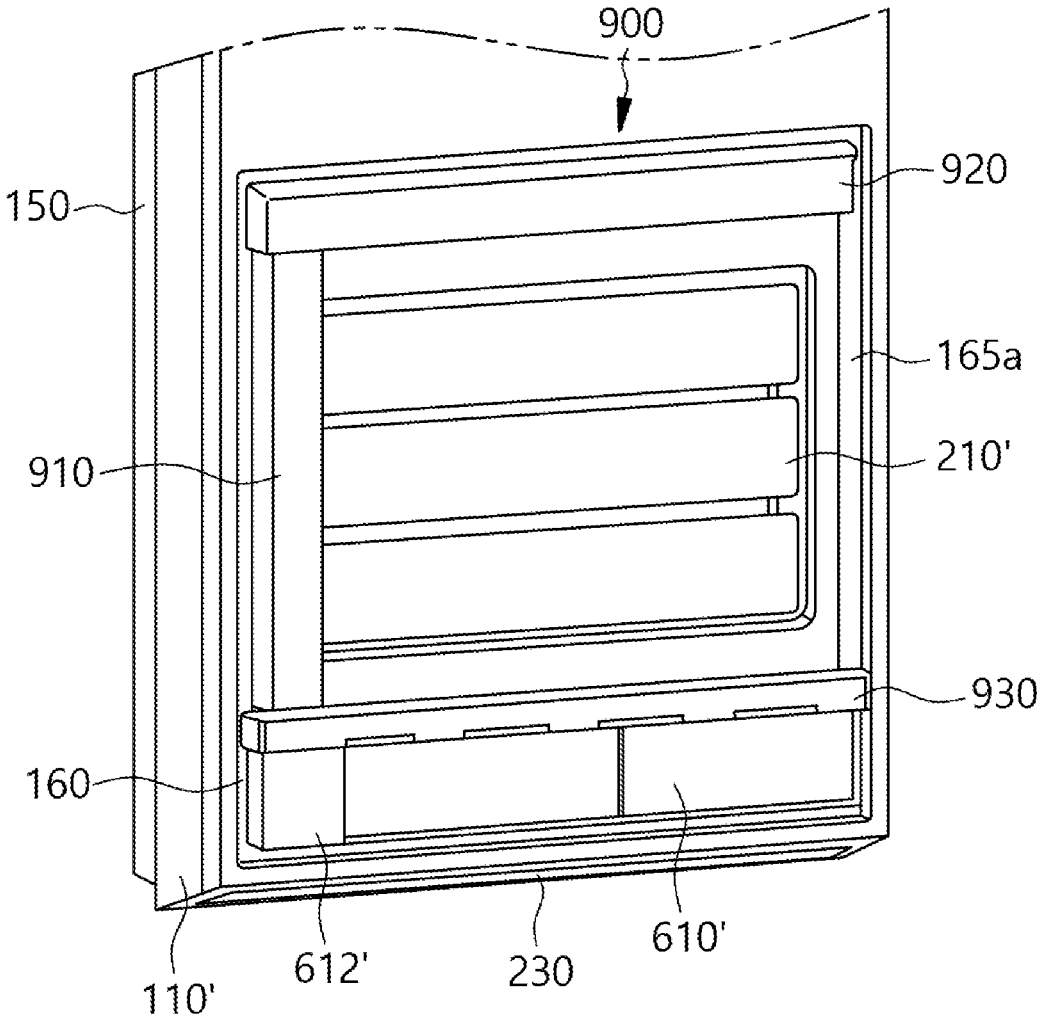
FIGS. 38A-38C are perspective views of the sweeper assembly to show a movement a sweeper.
Figure 38B:
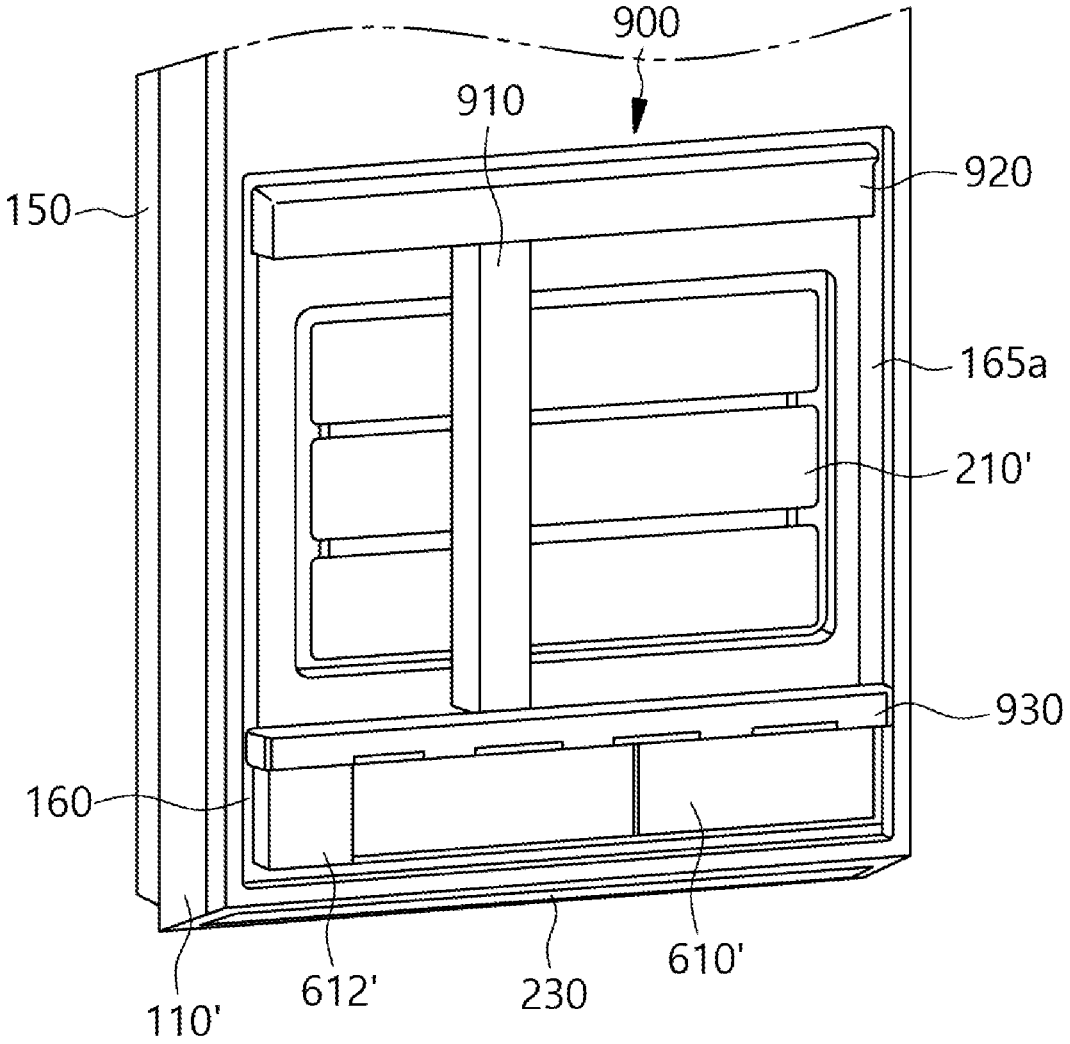
Figure 38C:
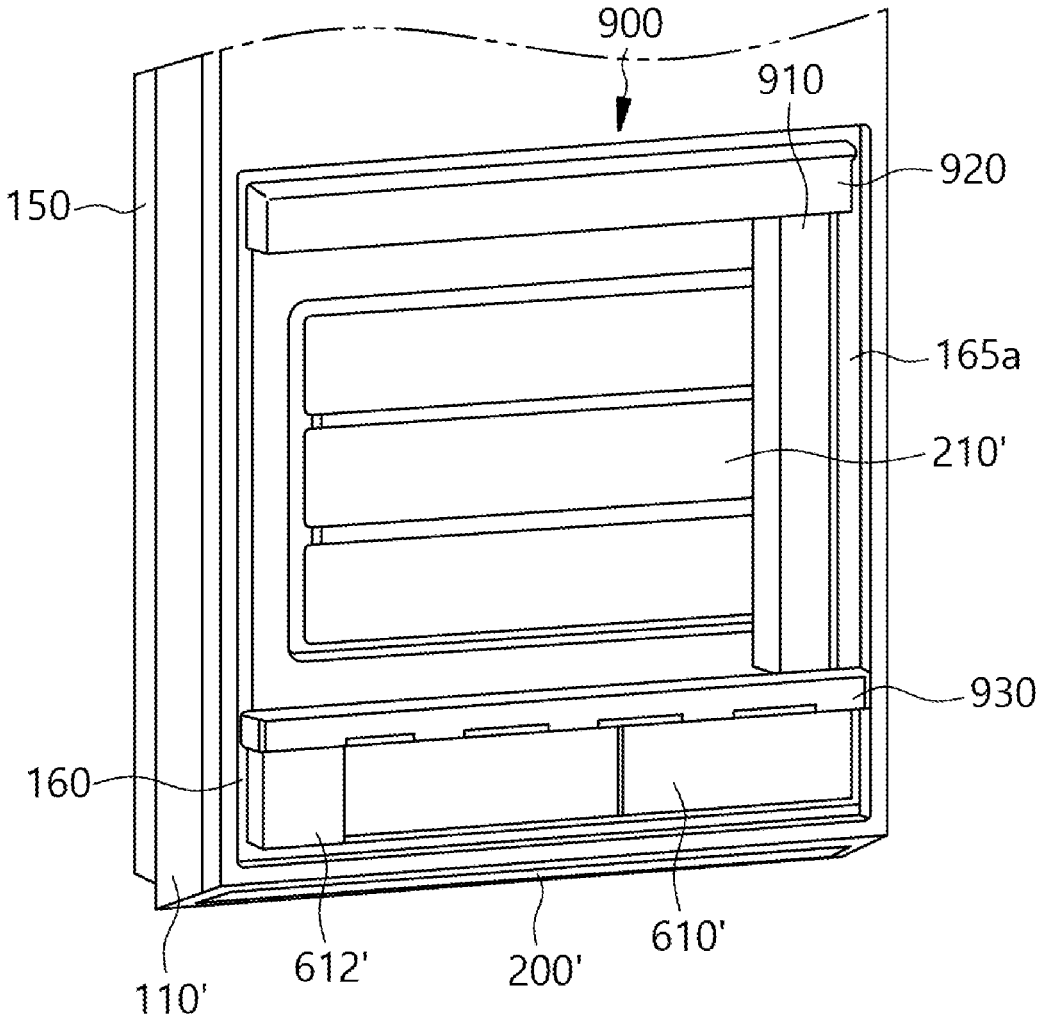

Referring to FIGS. 37-38C, the bottom guide 930 may include at least one steam nozzle or spout 940. The steam nozzle 940 may be coupled to the steam generator 612' via an internal pipe or channel provided in the bottom guide 930. There may be a left steam nozzle 940 provided at a left side above the steam generator 612' and a right steam nozzle 940 provided at a right side, and there may be additional steam nozzles 940. The steam nozzles 940 may be spaced apart at equal intervals. Alternatively, or in addition thereto, the top guide 920 may include at least one steam nozzle 940, which may be coupled to the steam generator 612' via a pipe or channel running along a side of the front inner case 160 and/or the outer case 110'.

An interior of the bottom guide 930 may include a passage configured to guide falling debris downward and back into the liquid storage container 610'. Like the liquid storage container 610 described with reference to FIGS. 1-27, the liquid storage container 610' may be divided into a first (i.e., left) bin in which cleaning fluid is filled, and a second (i.e., right) bin to collect condensate, debris, or other residue swept off the suction grill 210' by the sweeper 910. A top of the bottom guide 930 may be inclined toward an entry of the passage so as to guide residue down the passage and to the second bin of the liquid storage container 610'.

A rear surface of the sweeper 910 may brush against the suction grill 210'. The sweeper 910 may include bristles, a brush, a felt material, or other soft material configured to scrape off debris. A rectangular frame or case may surround a front surface of the sweeper 910 (i.e., a surface facing away from the suction grill 210'). The brush of the sweeper 910 may be a cylindrical round brush that spins or rotates inside of the rectangular frame to brush off debris. A motor to rotate the sweeper 910 may be provided inside of the rectangular frame or inside one of the top or bottom guides 920 or 930.

Alternatively, the sweeper 910 may be formed as a rectangular block or bar where only a rear surface facing the suction grill 210' includes bristles, a brush, a felt material, or other soft material. As another alternative, the entire sweeper 910 may be cylindrical and may not include the rectangular frame. Embodiments disclosed herein are not limited to the described configurations of the sweeper 910.

The suction grill 210' may include a variety of grooves or crevices, as a structure of the suction grill 210' may be configured to filter suctioned air. The bristles of soft material of the sweeper 910 may be configured to enter grooves and crevices of the suction grill 210' so as to efficiently scrape out or loosen debris.

The entire sweeper 910 may be configured to slide in a left-right direction between the top and bottom guides 920 and 930. The top and bottom guides 920 and 930 may, for example, include a rail or recess configured to engage with a rail or recess formed at a top and bottom of the sweeper 910. A motor or actuator may drive a sliding movement of the sweeper 910. As an example, the sweeper 910 may slide to the right and left via a rack, gear, and pinion, but embodiments disclosed herein are not limited hereto.

An automatic sweeping operation by the sweeper assembly 900 may be performed periodically at regular operations, after a cooking operation, or based on detections by air quality sensors provided in the front inner case 160 and/or the outer case 110'. The user may also command a manual sweeping operation via the display 130'. A first step of the sweeping operation may be raising the second housing 200' such that the suction grill 210' is exposed through the opening 165*a* of the front inner case 160. Such a position may correspond to the suction grill 210' being completely inserted in the front inner case 160. The fan 300' may be turned off.

A release of steam via the steam generator 612' and the steam nozzles 940 may be optional. For example, there may be a water or liquid sensor provided in the liquid storage container 610'. If the liquid sensor senses that there is not enough water in the liquid storage container 610' to generate steam, the sweeper 910 may slide to the left and right so as to brush off debris without the steam generator 612' being turned on and without steam being dispensed through the steam nozzles 940.

Figure 39:
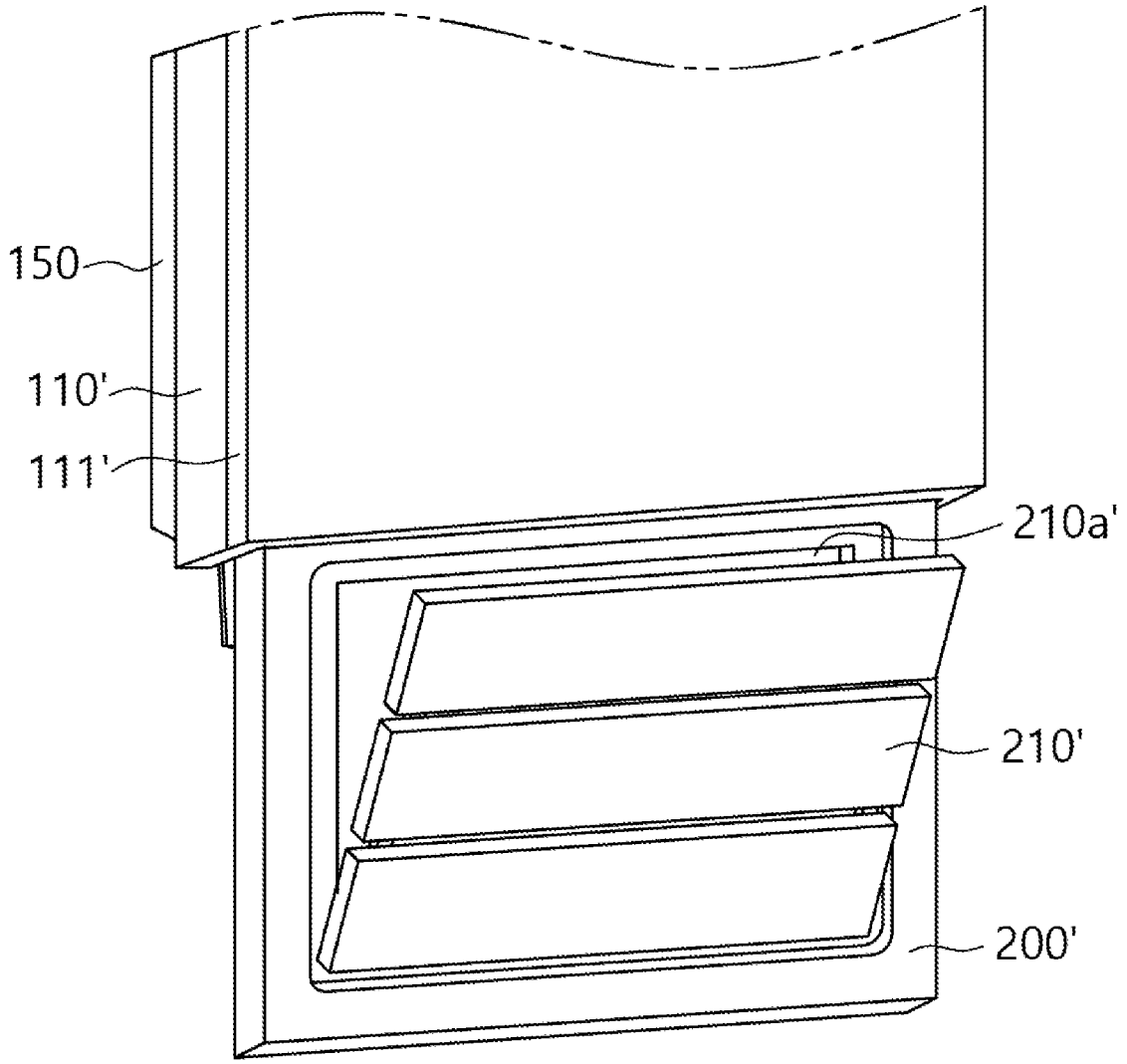
FIG. 39 is a front perspective view of the kitchen hood of FIG. 28 in a lengthened state with the suction grill partially removed.

Referring to FIG. 39, when the suction grill 210' requires a more intensive cleaning, the suction grill 210' may be removed from a hole or opening 210*a'* formed in a front surface of the second housing 200' so as to be cleaned, repaired, or replaced by a user or dishwasher. The suction grill 210' may be unscrewed, or alternatively may simply be lifted depending on a coupling to the second housing 200'. After cleaning, reparation, or replacement, the suction grill 210' may be inserted and pressed-fit back into the opening 210*a'*. The suction grill 210' may be optionally further secured to the second housing 200' via screws, magnetic coupling, and/or a plurality of grooves and ribs formed at edges of the suction grill 210' and the opening 210*a'* for press-fitting. A coupling of the suction grill 210' to the second housing 200' may be secure enough to withstand force from the sweeper assembly 900.

Referring to FIGS. 40A and 40B, when the fan 300' is operating, air may be suctioned through the suction grill 210' upwards through the second housing 200' and the front inner case 160, through the fan hole 300*a*, and into the rear inner case 150' to be discharged by the fan 300'. The suction grill 210' may be formed on the front side of the second housing 200' to suction ambient air from above a stove top, while the rear side of second housing 200' may be coupled to the second rail 420', which may engage with the first rail 410' and the motor 453'. A bottom of the rear inner case 150 may include a height sensing assembly similar to the sensor assembly 700 described with reference to FIGS. 1-27. A height adjustment of the second housing 200' and a control of the motor 453' may be based on detections by the height sensing assembly. Alternatively, or in addition thereto, the user may manually raise and lower the second housing 200' by entering commands into the user interface of the display 130', via a mobile or web application, or via a voice command.

A side of at least one of the front inner case 160 or the rear inner case 150 may include an air quality (AQ) sensor assembly that is similar to the AQ sensor assembly 500 described with reference to FIGS. 1-27. An operation of the fan 300' and the sweeper assembly 900 may be controlled based on detections by the AQ sensor assembly and based on a height of the second housing 200'. Alternatively, or in addition thereto, the user may manually control an operation of the sweeper assembly 900 by entering commands into the user interface of the display 130', via a mobile or web application, or via a voice command. The sweeper assembly 900 may not operate when the second housing 200' is lowered. The sweeper assembly 900 may be configured to automatically operate when the second housing 200' is raised to be completely inserted into the first housing 100' after an air purifying or cleaning operation during cooking.

Figure 41:
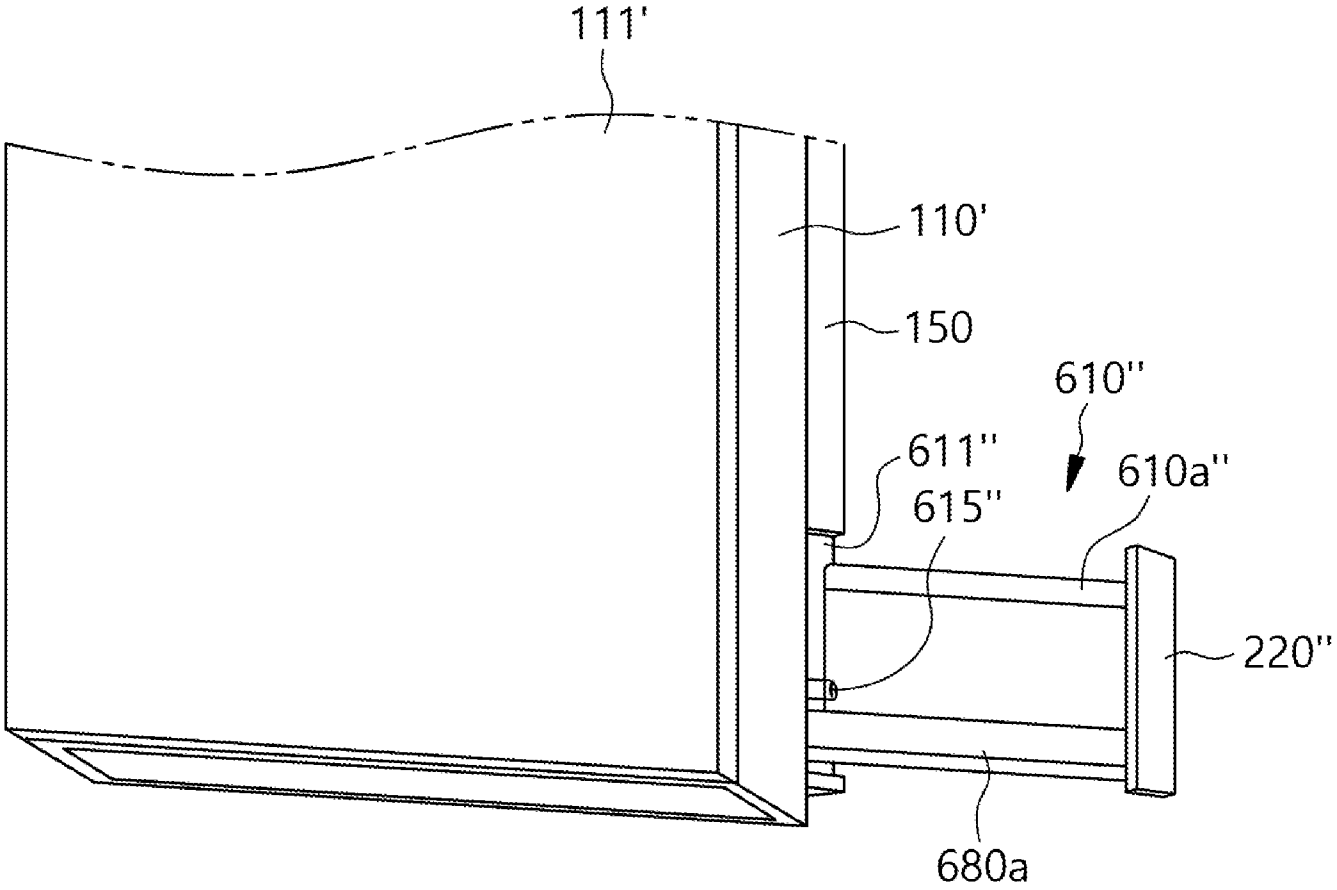
FIG. 41 shows an alternative embodiment of a left bin of a liquid storage container in the kitchen hood of FIG. 28.
Figure 42:
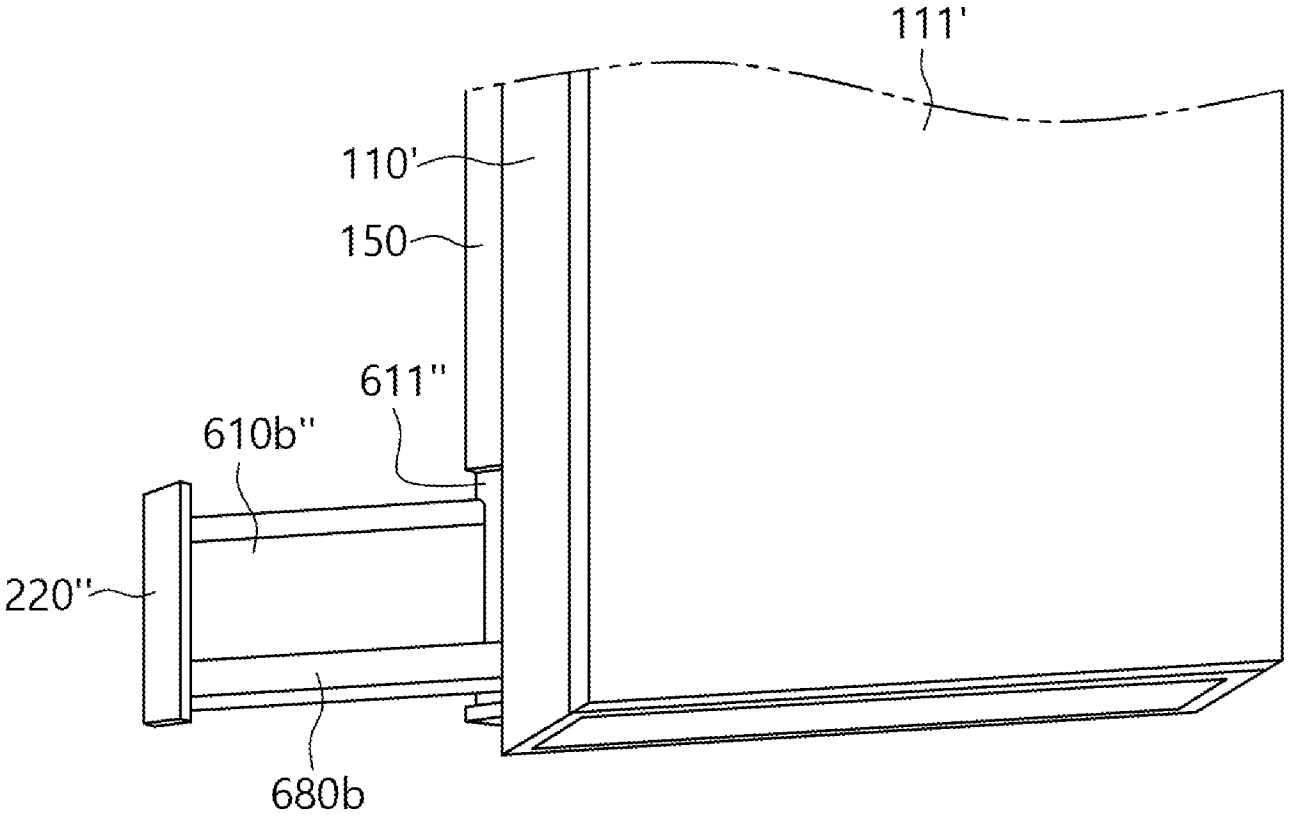
FIG. 42 shows a right bin of the liquid storage container of FIG. 41.

FIGS. 41 and 42 show an alternative liquid storage container 610" that slides into and out of the rear inner case 150 instead of being attached to a front of the front inner case 160 (as in FIG. 38C) behind the door 111'. The liquid storage container 610" may have a first (i.e., right) bin or container 610*a"* and a second (i.e., left) bin or container 610*b"* so that one may be filled with cleaning fluid and the other may collect debris, condensate or residue collected during steam cleaning. The rear inner case 150 may include a container guide or frame 611" defining openings in which the first and second containers 610*a"* and 610*b"* are inserted. The container guide 611" may be provided at a bottom of the rear inner case 150", and may not be covered by the outer case 110".

The first and second containers 610*a"* and 610*b"* may be configured to slide into and out of the container guide 611" via rails 680*a* and 680*b*, respectively. The rails 680*a* and 680*b* may engage with a rail or groove formed on a bottom of the container guide 611" inside of the rear inner case 150. The rails 680*a* and 680*b* may each be coupled to a cover 220", which may serve as a handle that a user may pull to withdraw the containers 610*a"* and 610*b"* from the container guide 611". The containers 610*a"* and 610*b"* may be lifted and removed from the rails 680*a* and 680*b* and covers 220" to be filled with liquid or to have debris disposed. The covers 220" may be formed of a same or similar material as the rear inner case 150 so as to provide a uniform and sleek appearance when the containers 610*a"* and 610*b"* are fully inserted into the container guide 611".

The first container 610*a"* may include a seal 615" which is similar to the seals 615 and 615' described with reference to FIGS. 1-27 and 28-40B, respectively, and which is configured to couple to a water heater provided inside of the container guide 611" between the first and second containers 610*a"* and 610*b"* (e.g., at a center). The seal 615" may be elastic so as to open upon being pressed fit to a hollow protrusion extending from the water heater, or alternatively may include a valve that is configured to open and close. Condensate may be collected in the second container 610*b"*.

Alternatively, there may only be one container 610*a"* inserted at a first side of the container guide 611", while the water heater may be provided inside of a second side of container guide 611" or inside of the rear inner case 150 at a position adjacent to the container 610*a"*. The seal 615" may couple to the steam generator 612 at a first side.

As an alternative to magnetic coupling of the suction grill 210 as explained with reference to FIG. 5, a periphery of the opening 210*a* may include at least one of a groove or rib configured to fit within at least one of a rib or groove, respectively, provided in a periphery of the suction grill 210 to secure the suction grill 210 into the opening 210*a*.

As an alternative to the configuration of the fan 300 described with reference to FIG. 12, the fan 300 may be positioned so that the axial direction of the fan 300 aligns with a left-right direction. As another alternative, if a discharge grill is formed in a side surface of first housing 100 instead of at a top, the fan 300 may be positioned so that the axial direction of the fan 300 aligns with a vertical direction, and the fan housing 310 may be oriented to guide air out of the discharge grill at the side. Although the fan 300 is described as being turned off when the steam generator 312 is generating steam, as another alternative, the fan 300 may be turned on during an operation of the steam generator 312 (e.g., a certain amount of time or more after the steam generator 312 has started) and exhaust newly generated steam out of the kitchen hood 1.

As an alternative to the structure of the condensate guide 650 and the first and second condensate passages 662*a* and 663*a* described with reference to FIGS. 11 and 12, the condensate guide 650 may be formed integrally with the first condensate passage 662*a*, which may be inserted through the damper assembly 662 to communicate with the second condensate passage 663*a*. In a similar alternative, the bottom plate 655 of the condensate guide 650 may be formed integrally with both the first and second condensate passages 662*a* and 663*a* to form one long passage that is inserted through the damper assembly 662 and the liquid guide 663 to communicate with the liquid storage container 610. The lid 614 may be optional in such an embodiment.

In yet another alternative, the inner walls 664 and 665 may be rectangular plates extending from the front to the rear to partition left and right side portions of the damper assembly 662. In such an embodiment, the gears 661 (FIG. 12) that rotate the dampers 660 may be housed inside of the left and right side portions of the damper assembly 662 so as to be protected from condensate guided down to the liquid guide 663. The first condensate passage 662*a* (FIG. 21) may be provided between the inner walls 664 and 665, or as yet another alternatively, the first condensate passage 662*a* may be omitted, and condensate may be guided down to the liquid guide 663 via a space defined between the inner walls 664 and 665. The hole 650*a* may be formed as a slit that extends from the front to the rear of the bottom surface 655 of the condensate guide 650, and liquid may be dropped between the inner walls 664 and 665. In a similar alternative, there may be a plurality of holes 650*a* arranged linearly from the front to the rear of the condensate guide 650. The inner walls 664 and 665 may be optionally formed as a plurality of tabs or ribs or form a plurality of first condensate passages 662*a* that correspond to the plurality of holes 650*a*. In such an arrangement, the bottom surface 655 may be inclined from left and right sides down toward the slit or plurality of holes 650*a*.

As another alternative, the first and second condensate passages 662*a* and 663*a* may be omitted, and liquid may drop through the opening 650*a* directly through the damper assembly 662 and the liquid guide 663 to the liquid storage container 610, and dimensions and positions of the opening 650*a*, damper assembly 662, water guide 663 and liquid storage container 610 may be configured so as to guide condensate, oil, dust, and other liquid back into the second bin 610*b*. In such an alternative, bottoms of the damper assembly 662 and liquid guide 663 may be formed with aligning openings or slits and be inclined to guide liquid toward the openings.

As another alternative to the AQ sensor assembly 500 and height adjustment process described with reference to FIG. 25, the AQ sensor assembly 500 may be provided on the second housing 200 adjacent to the suction grill 210, and a height of the second housing 200 may be continuously adjusted to a position where contamination levels sensed by the AQ sensor assembly 500 are highest.

Although the tabs 651 of the condensate guide 650 (FIGS. 17-20) are inclined to facilitate a downward movement of condensate toward the liquid storage container 610, alternatively, the tabs 651 may protrude to be flat or perpendicular to the side plate 654.

The kitchen hood 1 may be implemented as a rental unit that is easy to install via the bracket 2. The display 130 may periodically alert the user when the kitchen hood 1 should be serviced (e.g., every four months) so that the appearance, AQ sensor assembly 500, sensor assembly 700, and suction grill 210 may be checked.

Embodiments disclosed herein may provide an autonomous kitchen hood that automatically operates and self-cleans. The kitchen hood may reduce or remove vapors, odors, dust, oil mist, and hazardous substances and provide ventilation inside of a kitchen. The kitchen hood may automatically steam clean at regular intervals (e.g., once a month) or upon detection of a certain pollution or contamination level.

Embodiments disclosed herein may provide a kitchen hood having an intake or suction grill with an adjustable length to better filter contaminants in the air. The kitchen hood may detect a height of cookware and infer whether a person is frying food in a frying pan (which generates more smoke and harmful substances) or boiling water in a sauce pan or pot (which may not generate many harmful substances), and adjust a height of the intake accordingly. In the case of a frying pan, the height may be lowered to be closer to the pan and suction air before the air is further dispersed in the kitchen. In the case of a sauce pan or pot, the height may be raised to allow steam to flow upward.

Embodiments disclosed herein may provide a kitchen hood that prevents or reduces a spread of pollutants and bacteria.

Embodiments disclosed herein may provide a kitchen hood that is easy to replace, easy to remove and transport, easy to maintain, and easy to clean. The kitchen hood may be easily installed on a kitchen wall via brackets and lifted from the brackets to be removed.

Embodiments disclosed herein may provide a kitchen hood that is portable and includes a replaceable filter or grill. Alternatively, or in addition thereto, the filter may be configured to be dishwasher-safe and attach via magnetic coupling.

Embodiments disclosed herein may provide a kitchen hood that detects contaminants or pollutants in the air and automatically purifies or cleans the air upon detection of the pollutants. The kitchen hood may continuously detect contaminants such as oil, dust, odor, nitrogen dioxide, carbon monoxide, carbon dioxide, smoke, and/or formaldehyde and operate accordingly over a 24 hour period. The kitchen hood may include a photoionization sensor (PID) on an underside of the hood to detect an increase in smoke or contaminants during cooking, and the kitchen hood may adjust a fan speed, operating time, and a height of the air intake or discharge based on the detected contaminants.

Embodiments disclosed herein may provide a kitchen hood that operates 24 hours a day and exhausts dirty air from a kitchen. Although the kitchen hood may be installed above a stove to exhaust contaminants from cooking on the stove, the kitchen hood may also exhaust contaminants generated from other kitchen appliances (e.g., a microwave or a toaster). The kitchen hood may also exhaust non-cooking pollution such as yellow dust, pollen, or dirt that may enter the kitchen, and an overall air quality of the kitchen and house may be improved. The kitchen hood may continuously sense an air quality in the kitchen and respond by turning on a fan and/or lowering a suction grill.

Embodiments disclosed herein may provide a kitchen hood having an air intake or suction grill with an adjustable position. The air intake may be raised and lowered to a position to effectively suction contaminated air and smoke. The kitchen hood may include an ultrasonic sensor or light sensor to detect a height of a pot, pan, or other dish (collectively referred to as cookware) on a stovetop below the kitchen hood, and the air intake may be raised or lowered based on the detected height. The kitchen hood may also include a proximity sensor (e.g., laser or light sensor) to detect a proximity of cookware or a user approaching the kitchen hood.

Embodiments disclosed herein may provide a kitchen hood having a user interface (e.g., a display and/or a light) so that an operation of the kitchen hood and a detected air quality may be displayed on the display or indicated via the light. The kitchen hood may have an optional user interface (e.g., touchscreen or speaker) so that a user may operate the kitchen hood. The user may be able to control the kitchen hood remotely. The kitchen hood may have a WiFi and/or BlueTooth module for control via a mobile or web application. The display may also display service reminders to the user reminding the user to check filters and sensors.

Embodiments disclosed herein may provide a kitchen hood having a fan configured to reduce noise. An object of the present disclosure is to provide a kitchen hood having a battery. The kitchen hood may operate even in the event of a power outage due to the battery.

Embodiments disclosed herein may provide a kitchen hood that has a speaker, microphone, and voice recognition software so that the kitchen hood is controlled via voice commands. An object of the present disclosure is to provide a kitchen hood that links to or communicates with other kitchen or smart home appliances, such as a refrigerator, stove, oven, or air purifier, etc. and operates accordingly.

Embodiments disclosed herein may provide a kitchen hood having an automatic light configured to illuminate a kitchen or stovetop when a user enters the kitchen or approaches the kitchen hood. The kitchen may also optionally include a sterilizing light (e.g., ultraviolet light emitting diode) that may further reduce pollutants on the kitchen hood and/or to sterilize a stove top provided below the kitchen hood.

Embodiments disclosed herein may be implemented as a kitchen hood comprising a fan to suction air, a first housing, a second housing having an inlet of a predetermined shape and size through which suctioned air enters, the second housing being configured to slide within the first housing, a suction grill to cover the inlet, and a first sensor configured to detect a height of an object. The second housing may be moveable between a first position to expose a side of the suction grill and a second position to fully cover the side of the suction grill. A bottom of the second housing may automatically extend toward an object based on a height of the object detected by the first sensor and based on the second housing sliding out of the first housing to a third position, which may be between the first and second positions.

When the first sensor detects that a height of the object is less than or equal to a first predetermined height, the second housing may be moved to the first position. When the first sensor detects that the height of the object is greater than the first predetermined height but less than a second predetermined height, the second housing may be moved to the third position. When the first sensor does not detect an object, the second housing may be moved to the second position.

A light may be provided on a bottom of the second housing. A second sensor may be configured to detect an object approaching the second sensor. The light may be operated based on a detection by the second sensor.

The first housing may include an outlet through which air may be discharged. The inlet may include a left inlet and a right inlet formed on left and right sides of the second housing. The suction grill may include a left suction grill provided to cover the left inlet and a right suction grill provided to cover the right inlet. A left suction passage may be formed from the left suction grill to the outlet. A right suction passage may be formed from the right suction grill to the outlet. A left damper may be provided to open and close the left suction passage. A right damper may be provided to open and close the right suction passage. The left and right dampers may be controlled based on a position of the object on the surface detected by the first sensor relative to the left and right inlets.

The suction grill may have an inner grill and an outer grill. The inner and outer grills may be staggered with each other. At least one of the inner grill or the outer grill of the suction grill may include a plurality of slats.

The inlet may have a side section formed in a side of the second housing and a bottom section formed in the bottom of the second housing. The second housing may include a recess to accommodate an upper end of the suction grill. The side of the suction grill may cover the side section of the inlet. The suction grill may include a bottom to cover the bottom section of the inlet. At least one of the bottom section of the inlet or the bottom of the suction grill may include a magnet.

The second housing may overlap a cooktop surface. The first housing may have a width in a left-right direction that may be less than or equal to a width of the cooktop surface.

A rear of the first housing may include hooks configured to hook onto a wall bracket.

The kitchen hood may have a fan housing in which the fan may be provided. An outlet may be formed in a top or a rear of the first housing. The fan housing may be coupled to the top of the first housing such that an outtake of the fan aligns with the outlet.

A steam cleaning assembly may include a container to store liquid, a steam generator to convert the stored liquid, and a distributor to dispense the steam. An operation of the steam cleaning assembly may be based on at least one of a detection by the first sensor, a passage of time, or a manual command.

The second housing may further include a condensate collector configured to collect condensate during the operation of the steam cleaning assembly and guide the collected condensate back to the container.

A third sensor may be provided. An operation of the fan may be based on a detection of at least one of oil, dust, smoke, or odor by the third sensor.

Embodiments disclosed herein may be implemented as a kitchen hood comprising an upper housing having a fan configured to suction air, an outlet through which air may be discharged, and a first guide, the upper housing and the first guide configured to be stationary, a lower housing having a suction grill provided in a lower section and a second guide configured to engage with the first guide, and a motor configured to raise and lower the lower housing relative to the upper housing between a first position and a second position such that the second guide moves with respect to the first guide. When the lower housing is raised to the first position, a side of the suction grill may be covered by the upper housing. When the lower housing is lowered to a second position, the suction grill may be exposed from the upper housing.

A rack may be provided on an outer surface of the lower housing, and a gear may be provided between the upper housing and the lower housing and configured to engage with the rack. The motor may be configured to rotate the gear such that, when the gear is rotated in a first direction, the lower housing may be lowered, and when the gear is rotated in a second direction opposite to the first direction, the lower housing may be raised.

Each of the upper and lower housings may be formed as rectangular frames having front, rear, left, and right sides. The first guide may include a first left rail provided on a left side of an inner surface of the upper housing, and a first right rail provided on a right side of the inner surface of the upper housing. The second guide may include a second left rail provided on a left side of an outer surface of the lower housing so as to align with the first left rail, and a second right rail provided on a right side of the outer surface of the lower housing so as to align with the first right rail. The rack may include a left rack provided on a right side of the second left rail, and a right rack provided on a left side of the second right rail. The gear may include a left gear configured to engage with the left rack, and a right gear configured to engage with the right rack.

A motor housing may be provided between the first left rail and the first right rail. The motor may include a left motor and a right motor. The left motor may be provided in the motor housing and configured to rotate the left gear. The right motor may be provided in the motor housing and configured to rotate the right gear.

The first left rail may include a first rear left rail provided on the rear of the upper housing and a first front left rail provided on the front of the upper housing. The first right rail may include a first rear right rail provided on the rear of the upper housing and a first front right rail provided on the front of the upper housing. The second left rail may include a second rear left rail provided on the rear of the lower housing and a second front left rail provided on the front of the lower housing. The second right rail may include a second rear right rail provided on the rear of the lower housing and a second front right rail provided on the front of the lower housing.

A height sensor may be provided on a bottom of the lower housing. The height sensor may be configured to detect a height of an object provided below the lower housing. An operation of the motor to move the lower housing relative to the upper housing may be based on a detection by the height sensor.

Embodiments disclosed herein may be implemented as a kitchen hood comprising a case having an upper section and a lower section and configured to be installed over a cooktop surface, a vertical height of the lower section above the cooktop surface being adjustable, a fan provided inside of an upper section of the case to suction air, an outlet formed in the upper section of the case through which air may be discharged, an inlet formed in the lower section of the case through which air may be suctioned so as to be raised and lowered when the vertical height may be adjusted, a suction grill to cover the inlet, and a steam cleaning assembly provided inside of the case and configured to generate and disperse steam inside of the case.

A first sensor may be configured to sense an object provided on the cooktop surface. The vertical height of the lower section may be controlled based on a detection by the first sensor. A second sensor may be configured to sense at least one of smoke, oil, dust, or odor. A third sensor may be configured to sense an object approaching the third sensor. A light may be provided on a bottom of the case. The light may be configured to operate based on a detection by the third sensor. A magnet may secure the suction grill to the lower section of the case. A display may be provided on an outer surface of the case to display detections by the first, second, and third sensors and to display an operation status.

Embodiments disclosed herein may be implemented as a kitchen hood comprising a housing, a fan provided inside of the housing to suction air, an inlet formed in the housing through which air may be suctioned, an outlet formed in the housing through which air may be discharged, a suction grill covering the inlet, and a steam cleaning assembly provided inside of the housing and configured to generate and disperse steam inside of the housing. The steam cleaning assembly may include a container configured to store liquid, a heater configured to heat the liquid to generate steam from the stored liquid, and a steam distributor provided above the suction grill and coupled to the heater. The steam distributor may have at least one nozzle configured to release steam inside of the housing.

The steam distributor may be formed as a tube. An interior space of the tube may guide steam from the heater.

The tube may have an outer side and an inner side which may be opposite to each other. The outer side may face an inner surface of the housing. The nozzle may be formed on at least one of the outer side or the inner side. The nozzle on the inner side may be configured to discharge steam toward a middle of the housing. The at least one nozzle may include a plurality of nozzles spaced apart at equal intervals along at least one side of the steam distributor.

A condensate guide may be coupled to an inner surface of the housing and configured to collect condensate of the steam and guide the condensate toward the container. The steam distributor may be coupled to a top of the condensate guide. The container and heater may be provided below the condensate guide.

The condensate guide may include a front plate having an upper section and a lower section and a rear plate having an upper section and a lower section. The front and rear plates may be coupled to an inner surface of the housing. A plurality of plates may be provided between the front plate and the rear plate. The plurality of plates may be configured to guide condensate downward. The steam distributor may be coupled to the upper sections of the front and rear plates.

The plurality of plates may include a plurality of left plates provided between left edges of the front and rear plates and a plurality of right plates provided between right edges of the front and rear plates. The lower sections of the front and rear plates may have a trapezoid shape such that left and right edges may be inclined inward from top to bottom. The plurality of left plates may form left stairs and the plurality of right plates may form right stairs.

The condensate guide may further include left and right side plates that extend between left and right edges of the upper sections of the front and rear plates. The left and right side plates may be coupled to at least one of the inner surface of the housing or the plurality of plates.

A frame may be provided between a bottom of the condensate guide and a top of the container and may have a passage through which condensate flows from a bottom of the condensate guide to the container.

The heater may be provided at a rear of the housing. A first tube of the steam distributor may be connected to the heater through an opening at a top of the rear plate. The container may be configured to be removed from the housing to allow liquid to be manually filled in the container.

The housing may include a first housing and a second housing configured to move with respect to the first housing. The fan may be coupled to the first housing, the outlet may be formed in the first housing, an inlet may be formed in the second housing, and the steam cleaning assembly may be provided in the second housing.

Embodiment disclosed herein may be implemented as a kitchen hood comprising a housing, a fan provided inside of the housing to suction air, an inlet formed in the housing through which air may be suctioned, an outlet formed in the housing through which air may be discharged, a suction grill covering the inlet, and a steam cleaning assembly provided inside of the housing and configured to generate and disperse steam inside of the housing. The steam cleaning assembly may include a container having first and second sections, the container being configured to be manually withdrawn from the housing to allow filling of the first section of the container with liquid, a heater configured to heat liquid in the first section of the container to generate steam, and a condensate guide provided above the container and configured to guide condensate of the generated steam to the second section of the container to be discarded when the container is withdrawn.

The container may be configured to slide horizontally out of a front of the housing to be withdrawn. A lid may have a first section and a second section to cover first and second sections of the container, respectively. The second section of the lid may have an inclined surface to guide condensate into the second section of the container.

A steam distributor may be coupled to a top of the condensate guide and a tube of the steam distributor connected to the heater. The steam distributor may have a plurality of nozzles to release steam supplied through the tube.

A frame may be provided between the condensate guide and the container. The frame may form a passage from a bottom of the condensate guide to the second section of the container through which condensate may be guided.

The condensate guide may include a plurality of right plates forming right steps and a plurality of left plates forming left steps. Each of the left and right plates may have a downward inclination to guide the condensate downward.

A bottom of the housing may include a container passage in which the container may be configured to be inserted. The container may include a front plate having a handle. The front plate may be exposed to an outside of the housing so that the container may be removed from the housing by pulling the handle.

The housing may include a first housing and a second housing configured to move vertically within the first housing between a first position and a second position. In the first position, the container may be housed in the first and second housings to prevent the container from being withdrawn. In the second position, the container may be housed in the second housing and exposed from the first housing to allow the container to be withdrawn from the second housing.

Embodiments disclosed herein may be implemented as a kitchen hood comprising a first housing and a second housing, the second housing configured to vertically move relative to the first housing from a first position to a second position, a fan provided inside of an upper section of the first housing to suction air, an inlet formed in the second housing through which air may be suctioned, an outlet formed in the first housing through which air may be discharged, a suction grill covering the inlet, wherein, in the first position, a side of the suction grill may be at least partially exposed from the first housing, and in the second position, the side of the suction grill may be covered by the first housing, and a steam cleaning assembly provided inside of the second housing and configured to generate and disperse steam. The steam cleaning assembly may include a container having a first section and a second section, a heater to heat liquid in the first section to generate steam, a plurality of tubes to guide the generated steam, and at least one nozzle to disperse the steam from at least one of the plurality of tubes.

During a steam cleaning operation, the second housing may be moved to the second position, the heater may be turned on to generate steam that may be distributed by the steam cleaning assembly, and the fan may be maintained in an off state for a first prescribed period of time to allow condensate to form and be collected in the second section of the container. After the first prescribed period of time, the fan may be turned on. The steam cleaning operation may be automatically performed based on at least one of a passage of time, a past history of air quality or usage, or a user preference.

Embodiments disclosed herein may be implemented as a kitchen hood comprising a housing having a front, rear, top, and bottom, and left and right sides provided between the front, rear, top and bottom, the rear being configured to be installed on a wall, a fan provided inside of an upper section of the housing to suction air, a left inlet formed on the left side of the housing through which air may be suctioned, a right inlet formed on the right side of the housing through which air may be suctioned, a left grill covering the left inlet, a right grill covering the right inlet, an outlet formed in the top of the housing through which air may be discharged, and a user interface formed on the front of the housing. A depth in the front-rear direction of the housing may be longer than a width in the left-right direction.

The left inlet may be partially formed at the bottom of the housing, the right inlet may be partially formed at the bottom of the housing, and the left and right grills may be bent at a bottom so as to cover the entire left and right inlets, respectively.

A guide may extend between the front and the rear of the housing and spaced apart from the left and right sides of the housing so as to form a left suction passage from the left inlet to the outlet and a right suction passage from the right inlet to the outlet.

The guide may include a left damper configured to open and close the left suction passage and a right damper configured to open and close the right suction passage.

A first sensor may detect a position of an object in a left-right direction provided below the housing. The left and right dampers may be controlled based on the detected position of the object.

The housing may be provided over a cooktop surface. A width of the housing in a left-right direction may be narrower than a width of the cooktop surface in the left-right direction.

The fan may be automatically maintained in an on state for a prescribed period of time greater than thirty minutes after an operation of the cooktop surface may be completed or stopped.

A second sensor may detect at least one of a smoke level, odor level, oil level, or dust level. The fan may be controlled based on a detection by the second sensor.

A light may be provided on the bottom of the housing. A third sensor may detect an object approaching the third sensor. The light and the fan may be controlled based on a detection by the third sensor.

A container passage may be formed in a front-rear direction of a lower section of the housing. A container may be configured to store liquid and having a front-rear length longer than a left-right length and configured to be inserted into and removed from the container passage, A heater provided at a rear of the container and configured to heat liquid supplied from the container to generate steam. A steam distributor provided in the upper section of the housing and configured to release steam generated from the heater. A condensate collector may be provided under the steam distributor and above the container. The condensate collector may be configured to guide condensate created from the steam down to the container.

The housing may include a female housing and a male housing provided at least partially inside of the female housing and configured to move relative to the female housing. The female housing may include the fan, the outlet, and the user interface. The male housing may include the left inlet, right inlet, left suction grill, and right suction grill.

Embodiments disclosed herein may be implemented as a kitchen hood comprising a housing having a front, rear, top, and bottom, and left and right sides provided between the front, rear, top and bottom, the rear being configured to be installed on a wall, a fan provided inside of an upper section of the housing to suction air, a left inlet formed on the left side of the housing through which air may be suctioned, a right inlet formed on the right side of the housing through which air may be suctioned, a left suction grill provided in the left inlet, a right suction grill (210R) provided in the right inlet, an outlet formed in a top of the housing through which suctioned air may be discharged, a left suction passage formed between the left inlet and the outlet, and a right suction passage formed between the right inlet and the outlet. The left suction passage may be configured to be selectively opened and closed and the right suction passage may be configured to be selectively opened and closed. An opening and closing of the left and right suction passages may be controlled independently.

A volume of suctioned air passing through the left and right passages may be controlled based on a left-right position of an object below the housing.

A guide may be provided inside of the housing and spaced apart from the right and left sides of the housing. The right suction passage may be defined between a right side of the guide and the right side of the housing and the left suction passage may be defined between a left side of the guide and the left side of the housing. A left damper may be coupled to the guide and configured to change a degree of opening of the left suction passage. A right damper coupled to the guide and configured to change a degree of opening of the right suction passage. A left motor may be provided inside of the guide to control the left damper between an opened position and a closed position. A right motor may be provided inside of the guide to control the right damper between an opened position and a closed position.

A left gear may be provided inside the guide and configured to be rotated by the left motor. A right gear may be provided inside the guide and configured to be rotated by the right motor. A left rack may have an arc shape with first and second ends. The first end of the left rack may be coupled to the left damper and the second end of the left rack may be provided inside of the guide. The left rack may be configured to engage with the left gear. A right rack may have an arc shape with first and second ends. The first end of the right rack being coupled to the right damper and the second end of the right rack being provided inside of the guide, wherein the right rack may be configured to engage with the right gear.

A left hinge may be coupled between the left damper and the guide. The left damper may be configured to rotate around the left hinge such that, when the left damper may be completely opened, the left damper may be parallel to the left side of the guide. A right hinge may be coupled between the right damper and the guide. The right damper may be configured to rotate around the right hinge such that, when the right damper may be completely opened, the right damper may be parallel to the right side of the guide.

An inner surface of the left side of the housing may be formed with a left curved portion that may be curved inward toward the guide. An inner surface of the right side of the housing may be formed with a right curved portion that may be curved inward toward the guide. The left damper may be configured to contact the left curved portion to close the left suction passage. The right damper may be configured to contact the right curved portion to close the right suction passage.

The left curved portion may be formed with a left recess in which a top of the left grill may be inserted. The right curved portion may have a right recess in which a top of the right grill may be inserted.

The guide may include a passage for condensate to flow therethrough.

A sensor may be configured to sense a position of an object provided below the housing. When the sensor senses that the object may be closer to the left inlet than to the right inlet, the left suction passage may be opened and the right suction passage may be closed. When the sensor senses that the object may be closer to the right inlet than to the left inlet, the left suction passage may be closed and the right suction passage may be opened.

A housing may be configured to be installed on a wall. The housing may have a top section and a bottom section. A length of the housing may change based on movement of the bottom section into the top section. A fan may be coupled to the top section of the housing. A first inlet may be formed at the bottom section of the housing. A first grill may cover the first inlet. An outlet may be formed in the top section of the housing through which air may be discharged. A first suction passage may be formed from the first inlet to the outlet. When the length of the housing is increased, a length of the first suction passage may be increased. When the length of the housing is decreased, a length of the first suction passage may be decreased.

The length of the first suction passage may change based on exposure of the first grill based on a position of the bottom section within the top section.

A damper may be configured to change a degree of opening of the first suction passage. A sensor may be configured to sense a height of an object below the bottom section of the housing. When the height of the object is sensed to be less than or equal to a first predetermined height, the bottom section of the housing may be moved to a first position so that the first suction passage may have a first length. When the height of the object is sensed to be greater than or equal to a second predetermined height, the bottom section of the housing may be moved to a second position so that the first suction passage may have a second length shorter than the first length.

A second inlet may be formed at the bottom section of the housing at a side opposite to a side where the first inlet may be formed. A second grill may cover the second inlet. A second suction passage may be formed from the second inlet to the outlet). When the length of the housing is increased, a length of the second suction passage may be increased. When the length of the housing is decreased, a length of the second suction passage may be decreased.

Embodiments disclosed herein may be implemented as a kitchen hood comprising a housing having a front housing and a rear housing, the rear housing being configured to be installed on a wall, the front housing having first and second housings, the second housing configured to move vertically downward, a fan provided inside the rear housing to suction air, an inlet formed at a front of the second housing, a grill to cover the inlet, and an outlet formed in the rear housing through which suctioned air may be discharged. The second housing may be configured to move between a first position and a second position. The grill may be covered by the first housing at the first position and exposed at the second position. A width of the housing in a left-right direction may be greater than a depth of the housing in a front-rear direction.

A fan hole may be formed between the rear housing and the first housing so that inner spaces of the rear and first housing communicate with each other. An intake of the fan may be aligned with the fan hole. A driving assembly may be configured to raise and lower the second housing inside of the first housing, such that, when the driving assembly raises the second housing to move the grill to the first position, the grill may be completely inserted into the first housing, and when the driving assembly lowers the second housing to move the grill to the second position, the grill may be not inside of the first housing.

A sweeper may be coupled to the first housing and configured to move in a left-right direction across the grill when the second housing may be moved to the first position.

The first housing may further include a steam cleaning assembly provided below the sweeper. The steam cleaning assembly may include a container configured to store liquid, a heater configured to heat stored liquid to generate steam, and a nozzle configured to release generated steam when the sweeper may be operated.

The sweeper may rotate when moving in the left-right direction. The outlet may be formed in the rear of the rear housing behind the fan. The fan may be configured to suction and discharge air in an axial direction of the fan.

A plurality of hooks may be provided on the rear of the rear housing. A bracket may be configured to be screwed onto a wall. A plurality of bracket hooks may be formed on the bracket and configured to engage with the plurality of hooks provided on the rear housing.

A first sensor may be configured to sense a height of an object below the bottom of the second housing. The driving assembly may be controlled based on a detection by the first sensor.

A second sensor may be configured to sense at least one of smoke, dust, oil, or odors. A user interface may be configured to indicate detections by the second sensor. The fan may be operated based on a detection by the second sensor.

A third sensor may be configured to sense an object approaching the third sensor. A light may be provided on a bottom of the housing to illuminate a space below the housing. At least one of the light or the fan may be operated based on a detection by the third sensor.

Embodiments disclosed herein may be implemented as a kitchen hood comprising a housing configured to be installed on a wall, a fan provided inside the housing to suction air, an inlet formed in the housing through which suctioned air enters, an outlet through which suctioned air may be discharged, a grill to cover the inlet, and a sweeper assembly having a roller brush configured to move across the grill.

The roller brush may be made of one of a bristle, felt, or fabric material configured to remove residue from the grill. A steam cleaning assembly may be configured to generate and release steam during an operation of the sweeper assembly.

The housing may include a first housing having a front opening. The roller brush may be configured to move across the front opening in the left-right direction. A second housing may be provided in the first housing and have the inlet and grill. The front opening may align with the inlet so that the grill may be exposed through the front opening.

The sweeper assembly may further include a bottom guide provided below the front opening and having a bottom groove, and a top guide provided above the front opening and having a top groove. A top end of the roller brush may be inserted into the top groove. A bottom end of the roller brush may be inserted into the bottom groove. The roller brush may be moved in a left-right direction along the top and bottom grooves.

A container may be configured to receive liquid provided below the bottom guide. A heater may be configured to heat the received liquid to generate steam. A nozzle may be provided in the bottom guide and connected to the heater so as to discharge generated steam during an operation of the roller brush.

The container may have a first section to receive liquid and a second section in which residue removed from the roller brush may be deposited. The container may be configured to be pulled and removed from the first housing.

The second housing may be configured to move between a first position and a second position. The first position may be a position where the grill may be exposed through the front opening of the first housing. The second position may be a position where the grill may be provided below the first housing. The roller brush may be operated when the second housing may be moved to the first position.

The housing may include a third housing coupled to a rear of the first housing. The third housing may have the fan. A fan hole may be formed in the rear of the first housing so that inner spaces of the third housing and the first housing communicate with each other. The fan may be aligned with the fan hole, and when the grill is moved to the first position, the grill may be aligned with the fan and the fan hole.

Embodiments disclosed herein may be implemented as a kitchen hood,=comprising a first housing including a front housing and a rear housing coupled to the front housing, the rear housing being configured to be installed on a wall, a fan provided in the rear housing, a second housing provided at least partially inside of the front housing and configured to move between a first position and a second position, an inlet formed on a front of the second housing, a grill to cover the inlet, the grill being exposed when the second housing may be lowered to the first position, a sweeper provided in the front housing and configured to sweep residue off of the grill when the second housing may be moved upward to the second position, and a steam cleaning assembly provided below the sweeper and configured to release steam during an operation of the sweeper.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A kitchen hood, comprising:

a housing;

a fan provided inside of the housing to suction air;

an inlet formed in the housing through which air is suctioned;

an outlet formed in the housing through which air is discharged;

a suction grill covering the inlet;

a steam cleaning assembly provided inside of the housing and configured to generate and disperse steam inside of the housing, the steam cleaning assembly including:

a container configured to store liquid;

a heater configured to heat the liquid to generate steam from the stored liquid; and a steam distributor provided above the suction grill and coupled to the heater, the steam distributor having at least one nozzle configured to release steam inside of the housing; and a condensate guide coupled to an inner surface of the housing and configured to collect condensate of the steam and guide the condensate toward the container, wherein the steam distributor is coupled to a top of the condensate guide, and the container and heater are provided below the condensate guide.

2. The kitchen hood of claim 1, wherein the steam distributor is formed as a tube, an interior space of the tube guiding steam from the heater.

3. The kitchen hood of claim 2, wherein the tube has an outer side and an inner side which are opposite to each other, the outer side facing an inner surface of the housing, and the nozzle is formed on at least one of the outer side or the inner side, the nozzle on the inner side being configured to discharge steam toward a middle of the housing.

4. The kitchen hood of claim 1, wherein the at least one nozzle includes a plurality of nozzles spaced apart at equal intervals along at least one side of the steam distributor.

5. The kitchen hood of claim 1, wherein the condensate guide includes:

a front plate having an upper section and a lower section;

a rear plate having an upper section and a lower section, the front and rear plates being coupled to an inner surface of the housing; and a plurality of plates provided between the front plate and the rear plate, the plurality of plates being configured to guide condensate downward, wherein the steam distributor is coupled to the upper sections of the front and rear plates.

6. The kitchen hood of claim 5, wherein the plurality of plates includes a plurality of left plates provided between left edges of the front and rear plates and a plurality of right plates provided between right edges of the front and rear plates, the lower sections of the front and rear plates having a trapezoid shape such that left and right edges are inclined inward from top to bottom, and the plurality of left plates form left stairs and the plurality of right plates form right stairs.

7. The kitchen hood of claim 5, wherein the condensate guide further includes left and right side plates that extend between left and right edges of the upper sections of the front and rear plates, the left and right side plates being coupled to at least one of the inner surface of the housing or the plurality of plates.

8. The kitchen hood of claim 5, wherein a frame is provided between a bottom of the condensate guide and a top of the container and has a passage through which condensate flows from a bottom of the condensate guide to the container.

9. The kitchen hood of claim 5, wherein the heater is provided at a rear of the housing, and a first tube of the steam distributor is connected to the heater through an opening at a top of the rear plate.

10. The kitchen hood of claim 1, wherein the container is configured to be removed from the housing to allow liquid to be manually filled in the container.

11. The kitchen hood of claim 1, wherein the housing includes a first housing and a second housing configured to move with respect to the first housing, the fan is coupled to the first housing, the outlet is formed in the first housing, an inlet is formed in the second housing, and the steam cleaning assembly is provided in the second housing.

12. The kitchen hood of claim 1, wherein:

the housing includes a first housing and a second housing configured to move vertically within the first housing between a first position and a second position, in the first position, the container is housed in the first and second housings to prevent the container from being withdrawn, and in the second position, the container is housed in the second housing and exposed from the first housing to allow the container to be withdrawn from the second housing.

13. The kitchen hood of claim 1, wherein the steam cleaning operation is automatically performed based on at least one of a passage of time, a past history of air quality or usage, or a user preference.

14. A kitchen hood, comprising:

a housing;

a fan provided inside of the housing to suction air;

an inlet formed in the housing through which air is suctioned;

an outlet formed in the housing through which air is discharged;

a suction grill covering the inlet;

a steam cleaning assembly provided inside of the housing and configured to generate and disperse steam inside of the housing, the steam cleaning assembly including:

a container having first and second sections, the container being configured to be manually withdrawn from the housing to allow filling of the first section of the container with liquid;

a heater configured to heat liquid in the first section of the container to generate steam; and a condensate guide provided above the container and configured to guide condensate of the generated steam to the second section of the container to be discarded when the container is withdrawn; and a frame provided between the condensate guide and the container, the frame forming a passage from a bottom of the condensate guide to the second section of the container through which condensate is guided.

15. The kitchen hood of claim 14, wherein the container is configured to slide horizontally out of a front of the housing to be withdrawn.

16. The kitchen hood of claim 14, further comprising a steam distributor coupled to a top of the condensate guide and a tube of the steam distributor connected to the heater, the steam distributor having a plurality of nozzles to release steam supplied through the tube.

17. The kitchen hood of claim 14, wherein a bottom of the housing includes a container passage in which the container is configured to be inserted, and the container includes a front plate having a handle, the front plate being exposed to an outside of the housing so that the container is removed from the housing by pulling the handle.

18. A kitchen hood, comprising:

a housing;

a fan provided inside of the housing to suction air;

an inlet formed in the housing through which air is suctioned;

an outlet formed in the housing through which air is suctioned;

a suction grill covering the inlet;

a steam cleaning assembly provided inside of the housing and configured to generate and disperse steam inside of the housing, the steam cleaning assembly including;

a container having first and second sections, the container being configured to be manually withdrawn from the housing to allow filling of the first section of the container with liquid;

a heater configured to heat liquid in the first section of the container to generate steam; and a condensate guide provided above the container and configured to guide condensate of the generated steam to the second section of the container to be discarded when the container is withdrawn; and a lid having a first section and a second section to cover first and second sections of the container, respectively, the second section of the lid having an inclined surface to guide condensate into the second section of the container.

19. A kitchen hood, comprising:

a housing;

a fan provided inside of the housing to suction air;

an inlet formed in the housing through which air is suctioned;

an outlet formed in the housing through which air is discharged;

a suction grill covering the inlet;

a stream provided inside of the housing and configured to generate and disperse steam inside of the housing, the steam cleaning assembly including:

a container having first and second sections, the container being configured to be manually withdrawn from the housing to allow filling of the first section of the container with liquid;

a heater configured to heat liquid in the first section of the container to generate steam; and a condensate guide provided above the container and configured to guide condensate of the generated steam to the second section of the container to be discarded when the container is withdrawn, wherein the condensate guide includes a plurality of right plates forming right steps and a plurality of left plates forming left steps, each of the left and right plates having a downward inclination to guide the condensate downward.

20. A kitchen hood, comprising:

a first housing and a second housing, the second housing configured to vertically move relative to the first housing from a first position to a second position;

a fan provided inside of an upper section of the first housing to suction air;

an inlet formed in the second housing through which air is suctioned;

an outlet formed in the first housing through which air is discharged;

a suction grill covering the inlet, wherein, in the first position, a side of the suction grill is at least partially exposed from the first housing, and in the second position, the side of the suction grill is covered by the first housing; and a steam cleaning assembly provided inside of the second housing and configured to generate and disperse steam, the steam cleaning assembly including a container having a first section and a second section, a heater to heat liquid in the first section to generate steam, a plurality of tubes to guide the generated steam, and at least one nozzle to disperse the steam from at least one of the plurality of tubes, wherein, during a steam cleaning operation, the second housing is moved to the second position, the heater is turned on to generate steam that is distributed by the steam cleaning assembly, and the fan is maintained in an off state for a first prescribed period of time to allow condensate to form and be collected in the second section of the container, and after the first prescribed period of time, the fan is turned on.

* * * * *